US009115503B2

(12) United States Patent
Ciuperca

(10) Patent No.: US 9,115,503 B2
(45) Date of Patent: Aug. 25, 2015

(54) INSULATED CONCRETE FORM AND METHOD OF USING SAME

(71) Applicant: Romeo Ilarian Ciuperca, Norcross, GA (US)

(72) Inventor: Romeo Ilarian Ciuperca, Norcross, GA (US)

( * ) Notice: Subject to any disclaimer, the term of this patent is extended or adjusted under 35 U.S.C. 154(b) by 0 days.

(21) Appl. No.: 14/311,310

(22) Filed: Jun. 22, 2014

(65) Prior Publication Data

US 2014/0332658 A1 Nov. 13, 2014

Related U.S. Application Data

(63) Continuation of application No. 13/247,133, filed on Sep. 28, 2011, now Pat. No. 8,756,890.

(51) Int. Cl.

| | |
|---|---|
| ***E04G 11/06*** | (2006.01) |
| ***E04B 1/21*** | (2006.01) |
| ***E04B 1/38*** | (2006.01) |
| ***E04B 2/40*** | (2006.01) |
| ***E04C 2/20*** | (2006.01) |
| ***E04B 1/16*** | (2006.01) |
| ***E04B 5/38*** | (2006.01) |

(Continued)

(52) U.S. Cl.

CPC ..... *E04G 11/06* (2013.01); *E04B 1/161* (2013.01); *E04B 1/21* (2013.01); *E04B 1/38* (2013.01); *E04B 2/40* (2013.01); *E04B 5/38* (2013.01); *E04C 2/20* (2013.01); *E04B 1/4178* (2013.01); *E04B 2/8647* (2013.01); *E04B 9/245* (2013.01); *E04B 2002/8688* (2013.01); *E04C 5/168* (2013.01); *E04C 5/18* (2013.01); *E04C 5/20* (2013.01); *E04F 13/0803* (2013.01); *E04F 13/0832* (2013.01); *Y10T 29/49632* (2015.01)

(58) Field of Classification Search

CPC . E04B 2/842; E04B 2/847; E04B 2002/8682; E04B 2002/8688; E04B 9/245; E04B 1/21; E04B 1/38; E04B 1/161; E04B 1/4178; E04B 2/40; E04B 2/20; E04B 2/8647; E04B 5/38; E04F 13/0803; E04F 13/0832; E04G 11/06; E04C 5/168; E04C 5/18; E04C 5/20; Y10T 29/49632

USPC ..... 52/426; 249/189, 190

See application file for complete search history.

(56) References Cited

U.S. PATENT DOCUMENTS

| | | | | |
|---|---|---|---|---|
| 357,855 | A * | 2/1887 | Phillippi | 16/14 |
| 1,680,923 | A * | 8/1928 | Williams | 249/42 |

(Continued)

FOREIGN PATENT DOCUMENTS

| | | |
|---|---|---|
| EP | 2065530 A2 | 6/2009 |
| JP | 11172820 | 12/1997 |

OTHER PUBLICATIONS

U.S. Appl. No. 14/610,744, filed Jan. 30, 2015.

(Continued)

*Primary Examiner* — James Ference

(74) *Attorney, Agent, or Firm* — Richards IP Law; Robert E. Richards

(57) ABSTRACT

A connector for a pair of opposed spaced concrete forming panels. The connector comprises an elongate spacer member having flanges formed thereon intermediate a central portion thereof and each opposite end thereof. A portion of at least one end of the spacer member is sized and shaped to selectively engage an elongate panel bracing member. A composite insulated concrete form and a method of using the insulated concrete form are also disclosed.

18 Claims, 33 Drawing Sheets

(51) Int. Cl.

| | |
|---|---|
| *E04B 1/41* | (2006.01) |
| *E04B 2/86* | (2006.01) |
| *E04B 9/24* | (2006.01) |
| *E04C 5/16* | (2006.01) |
| *E04C 5/18* | (2006.01) |
| *E04C 5/20* | (2006.01) |
| *E04F 13/08* | (2006.01) |

(56) References Cited

U.S. PATENT DOCUMENTS

| | | | | | |
|---|---|---|---|---|---|
| 1,723,631 | A | * | 8/1929 | Pollock et al. | 249/42 |
| 2,053,135 | A | | 9/1936 | Dalton | |
| 2,057,732 | A | * | 10/1936 | Navarre | 249/19 |
| 2,076,472 | A | * | 4/1937 | London | 52/279 |
| 2,139,907 | A | * | 12/1938 | Nielsen et al. | 52/206 |
| RE21,905 | E | * | 9/1941 | Nielsen et al. | 52/206 |
| 2,281,833 | A | * | 5/1942 | De Canio | 249/217 |
| 2,718,138 | A | * | 9/1955 | Jones | 52/381 |
| 2,887,757 | A | * | 5/1959 | Leslie | 52/699 |
| 3,199,828 | A | | 8/1965 | Newton | |
| 3,260,495 | A | * | 7/1966 | Buyken | 249/214 |
| 3,325,198 | A | * | 6/1967 | Cruse | 403/168 |
| 3,405,904 | A | * | 10/1968 | Williams | 249/40 |
| 3,649,725 | A | * | 3/1972 | Olson | 264/40.6 |
| 3,730,476 | A | * | 5/1973 | Prichard, Jr. | 249/191 |
| 3,732,138 | A | | 5/1973 | Almog | |
| 3,767,158 | A | * | 10/1973 | Mikus | 249/192 |
| 3,892,516 | A | | 7/1975 | McGrew et al. | |
| 3,985,329 | A | | 10/1976 | Liedgens | |
| 4,085,495 | A | | 4/1978 | Hebert | |
| 4,090,336 | A | | 5/1978 | Carroll | |
| 4,157,638 | A | | 6/1979 | Della-Donna | |
| 4,303,722 | A | * | 12/1981 | Pilgrim | 428/213 |
| 4,349,398 | A | | 9/1982 | Kearns et al. | |
| 4,370,840 | A | * | 2/1983 | Bisbee et al. | 52/410 |
| 4,426,061 | A | * | 1/1984 | Taggart | 249/45 |
| 4,462,949 | A | | 7/1984 | Fehlmann | |
| 4,489,121 | A | * | 12/1984 | Luckanuck | 428/192 |
| 4,516,372 | A | | 5/1985 | Grutsch | |
| 4,534,924 | A | | 8/1985 | Kariakin | |
| 4,578,915 | A | * | 4/1986 | Schneller | 52/309.12 |
| 4,646,498 | A | | 3/1987 | Schneller et al. | |
| 4,669,234 | A | | 6/1987 | Wilnau | |
| 4,698,947 | A | | 10/1987 | McKay | |
| 4,744,849 | A | * | 5/1988 | Michaud-Soret | 156/245 |
| 4,765,109 | A | | 8/1988 | Boeshart | |
| 4,774,794 | A | * | 10/1988 | Grieb | 52/309.7 |
| 4,811,927 | A | | 3/1989 | Slonimsky et al. | |
| 4,866,897 | A | | 9/1989 | Yount | |
| 4,885,888 | A | | 12/1989 | Young | |
| 4,889,310 | A | | 12/1989 | Boeshart | |
| 4,907,386 | A | * | 3/1990 | Ekroth | 52/169.14 |
| 4,936,540 | A | * | 6/1990 | Boeshart | 249/216 |
| 4,938,449 | A | * | 7/1990 | Boeshart | 249/216 |
| 4,944,127 | A | * | 7/1990 | Clear | 52/309.12 |
| 4,974,381 | A | * | 12/1990 | Marks | 52/309.12 |
| 5,107,648 | A | | 4/1992 | Roby | |
| 5,140,794 | A | * | 8/1992 | Miller | 52/309.12 |
| 5,171,118 | A | * | 12/1992 | Rothenbuhler | 411/480 |
| 5,217,339 | A | * | 6/1993 | O'Connor et al. | 411/531 |
| 5,323,578 | A | | 6/1994 | Chagnon et al. | |
| 5,332,189 | A | * | 7/1994 | Tseng | 249/40 |
| 5,493,837 | A | | 2/1996 | Hepler | |
| 5,497,592 | A | | 3/1996 | Boeshart | |
| 5,519,973 | A | * | 5/1996 | Keith et al. | 52/410 |
| 5,570,550 | A | | 11/1996 | Roby | |
| 5,598,675 | A | * | 2/1997 | Pruss | 52/309.4 |
| 5,606,832 | A | * | 3/1997 | Keith et al. | 52/410 |
| 5,611,182 | A | * | 3/1997 | Spude | 52/426 |
| 5,761,874 | A | | 6/1998 | Hayakawa | |
| 5,765,318 | A | | 6/1998 | Michelsen | |
| 5,771,648 | A | * | 6/1998 | Miller et al. | 52/309.7 |
| 5,792,552 | A | | 8/1998 | Langkamp et al. | |
| 5,809,723 | A | | 9/1998 | Keith et al. | |
| 5,809,725 | A | * | 9/1998 | Cretti | 52/426 |
| 5,809,726 | A | * | 9/1998 | Spude | 52/426 |
| 5,809,728 | A | | 9/1998 | Tremelling | |
| 5,836,126 | A | | 11/1998 | Harkenrider et al. | |
| 5,849,489 | A | * | 12/1998 | Heller | 435/6.12 |
| 5,852,907 | A | * | 12/1998 | Tobin et al. | 52/714 |
| 5,861,105 | A | * | 1/1999 | Martineau | 249/44 |
| 5,966,885 | A | | 10/1999 | Chatelain | |
| 5,992,114 | A | | 11/1999 | Zelinsky et al. | |
| 5,996,297 | A | * | 12/1999 | Keith et al. | 52/410 |
| 6,079,176 | A | * | 6/2000 | Westra et al. | 52/404.2 |
| 6,086,349 | A | | 7/2000 | Del Monte | |
| 6,134,861 | A | * | 10/2000 | Spude | 52/745.1 |
| 6,138,981 | A | | 10/2000 | Keith et al. | |
| 6,230,462 | B1 | * | 5/2001 | Beliveau | 52/426 |
| 6,234,736 | B1 | * | 5/2001 | Miescher | 411/533 |
| 6,263,638 | B1 | * | 7/2001 | Long, Sr. | 52/794.1 |
| 6,272,805 | B1 | * | 8/2001 | Ritter et al. | 52/309.11 |
| 6,276,104 | B1 | * | 8/2001 | Long et al. | 52/309.4 |
| 6,279,285 | B1 | * | 8/2001 | Kubica | 52/426 |
| 6,296,067 | B1 | * | 10/2001 | Slaughter et al. | 175/228 |
| 6,305,135 | B1 | | 10/2001 | Inaba | |
| 6,314,694 | B1 | * | 11/2001 | Cooper et al. | 52/309.12 |
| 6,318,040 | B1 | * | 11/2001 | Moore, Jr. | 52/426 |
| 6,336,301 | B1 | * | 1/2002 | Moore, Jr. | 52/426 |
| 6,360,505 | B1 | | 3/2002 | Johns | |
| 6,389,758 | B1 | * | 5/2002 | Martin, Jr. | 52/125.2 |
| 6,412,245 | B1 | * | 7/2002 | Lane et al. | 52/586.1 |
| 6,426,029 | B1 | | 7/2002 | Hiscock et al. | |
| 6,609,340 | B2 | * | 8/2003 | Moore et al. | 52/309.11 |
| 6,612,083 | B1 | | 9/2003 | Richards | |
| 6,647,686 | B2 | * | 11/2003 | Dunn et al. | 52/426 |
| 6,688,066 | B1 | | 2/2004 | Cottier et al. | |
| 6,725,616 | B1 | | 4/2004 | Pease | |
| 6,729,090 | B2 | | 5/2004 | Messenger et al. | |
| 6,729,094 | B1 | * | 5/2004 | Spencer et al. | 52/414 |
| 6,898,908 | B2 | | 5/2005 | Messenger et al. | |
| 6,898,912 | B2 | | 5/2005 | Bravinski | |
| 6,915,613 | B2 | * | 7/2005 | Wostal et al. | 52/426 |
| 6,935,081 | B2 | | 8/2005 | Dunn et al. | |
| 6,945,506 | B2 | * | 9/2005 | Long, Sr. | 249/213 |
| 6,948,289 | B2 | * | 9/2005 | Bravinski | 52/415 |
| 7,114,296 | B2 | * | 10/2006 | Klassen et al. | 52/127.2 |
| 7,124,547 | B2 | * | 10/2006 | Bravinski | 52/426 |
| 7,368,150 | B2 | * | 5/2008 | Pritchett | 427/412 |
| 7,398,131 | B2 | | 7/2008 | Trost et al. | |
| 7,409,800 | B2 | * | 8/2008 | Budge | 52/241 |
| 7,765,761 | B2 | | 8/2010 | Paradis | |
| 7,818,935 | B2 | | 10/2010 | Velickovic | |
| 7,934,693 | B2 | | 5/2011 | Bravinski | |
| 8,032,244 | B2 | | 10/2011 | Trost et al. | |
| 8,532,815 | B1 | | 9/2013 | Ciuperca | |
| 8,545,749 | B2 | | 10/2013 | Ciuperca | |
| 8,555,583 | B2 | | 10/2013 | Ciuperca | |
| 8,555,584 | B2 | | 10/2013 | Ciuperca | |
| 8,636,941 | B1 | | 1/2014 | Ciuperca | |
| 8,745,943 | B2 | | 6/2014 | Ciuperca | |
| 8,756,890 | B2 | | 6/2014 | Ciuperca | |
| 8,844,227 | B1 | | 9/2014 | Ciuperca | |
| 8,855,803 | B2 | | 10/2014 | Ciuperca | |
| 8,877,329 | B2 | | 11/2014 | Ciuperca | |
| 8,966,845 | B1 | | 3/2015 | Ciuperca | |
| 2002/0005725 | A1 | | 1/2002 | Scott | |
| 2002/0014048 | A1 | * | 2/2002 | Meendering | 52/426 |
| 2002/0017070 | A1 | * | 2/2002 | Batch | 52/309.11 |
| 2002/0035814 | A1 | * | 3/2002 | Sarver | 52/699 |
| 2002/0092253 | A1 | * | 7/2002 | Beliveau | 52/426 |
| 2003/0192272 | A1 | | 10/2003 | Bravinski | |
| 2004/0079860 | A1 | * | 4/2004 | Ward et al. | 249/33 |
| 2004/0129857 | A1 | | 7/2004 | Musk et al. | |
| 2004/0134158 | A1 | * | 7/2004 | Farrell et al. | 52/664 |
| 2004/0200176 | A1 | * | 10/2004 | Olsen | 52/633 |
| 2005/0108985 | A1 | | 5/2005 | Bravinski | |
| 2006/0010831 | A1 | * | 1/2006 | Skakie | 52/794.1 |
| 2007/0062143 | A1 | | 3/2007 | Noushad | |
| 2007/0094974 | A1 | * | 5/2007 | Velickovic | 52/426 |
| 2007/0095255 | A1 | | 5/2007 | Abbate et al. | |
| 2007/0107341 | A1 | * | 5/2007 | Zhu | 52/309.12 |
| 2007/0144653 | A1 | | 6/2007 | Padilla et al. | |

(56) References Cited

U.S. PATENT DOCUMENTS

| | | | | |
|---|---|---|---|---|
| 2008/0041004 | A1 | 2/2008 | Gibbar et al. | |
| 2008/0078134 | A1* | 4/2008 | Roby | 52/309.9 |
| 2008/0173788 | A1 | 7/2008 | Brewka et al. | |
| 2008/0221815 | A1* | 9/2008 | Trost et al. | 702/81 |
| 2008/0313991 | A1 | 12/2008 | Chouinard | |
| 2009/0057530 | A1* | 3/2009 | Sheckter et al. | 249/18 |
| 2009/0107065 | A1* | 4/2009 | LeBlang | 52/252 |
| 2009/0202307 | A1 | 8/2009 | Au et al. | |
| 2009/0218474 | A1* | 9/2009 | Bowman | 249/18 |
| 2009/0249725 | A1* | 10/2009 | McDonagh | 52/378 |
| 2009/0277103 | A1 | 11/2009 | De Jaham | |
| 2010/0037538 | A1* | 2/2010 | Sorich | 52/127.2 |
| 2010/0062667 | A1 | 3/2010 | Pan et al. | |
| 2010/0162659 | A1 | 7/2010 | Laprise | |
| 2010/0192498 | A1 | 8/2010 | Gleckman | |
| 2010/0232877 | A1 | 9/2010 | Sanvik et al. | |
| 2010/0319295 | A1* | 12/2010 | Nelson | 52/677 |
| 2011/0131892 | A1* | 6/2011 | Del Pino | 52/125.4 |
| 2011/0131911 | A1* | 6/2011 | McDonagh | 52/426 |
| 2011/0239566 | A1 | 10/2011 | Ciuperca | |
| 2011/0258944 | A1* | 10/2011 | Radoane | 52/62 |
| 2011/0272556 | A1* | 11/2011 | Lin | 249/190 |
| 2012/0058299 | A1 | 3/2012 | Serwin | |
| 2013/0074432 | A1 | 3/2013 | Ciuperca | |
| 2013/0074433 | A1 | 3/2013 | Ciuperca | |
| 2013/0119576 | A1 | 5/2013 | Ciuperca | |
| 2014/0041329 | A1 | 2/2014 | Ciuperca | |
| 2014/0083333 | A1 | 3/2014 | Ciuperca | |
| 2014/0084132 | A1 | 3/2014 | Ciuperca | |
| 2014/0087158 | A1 | 3/2014 | Ciuperca | |
| 2014/0088756 | A1 | 3/2014 | Ciuperca | |
| 2014/0174647 | A1 | 6/2014 | Ciuperca | |
| 2014/0212643 | A1 | 7/2014 | Ciuperca | |
| 2014/0260034 | A1 | 9/2014 | Ciuperca | |
| 2014/0263942 | A1 | 9/2014 | Ciuperca | |
| 2014/0272302 | A1 | 9/2014 | Ciuperca | |
| 2014/0312524 | A1 | 10/2014 | Ciuperca | |
| 2014/0332658 | A1 | 11/2014 | Ciuperca | |
| 2014/0333004 | A1 | 11/2014 | Ciuperca | |
| 2014/0333010 | A1 | 11/2014 | Ciuperca | |
| 2015/0007524 | A1 | 1/2015 | Ciuperca | |
| 2015/0014300 | A1 | 1/2015 | Ciuperca | |

OTHER PUBLICATIONS

U.S. Appl. No. 14/311,310, filed Jan. 30, 2015.
U.S. Appl. No. 14/227,490, filed Mar. 27, 2015.
U.S. Appl. No. 14/499,205, filed Sep. 28, 2014.
U.S. Appl. No. 14/531,644, filed Nov. 3, 2014.
U.S. Appl. No. 13/626,103, filed Sep. 25, 2012.
U.S. Appl. No. 14/610,772, filed Jan. 30, 2015.
U.S. Appl. No. 14/165,630, filed Jan. 28, 2014.
U.S. Appl. No. 14/499,208, filed Sep. 28, 2014.
U.S. Appl. No. 13/834,697, filed Mar. 15, 2013.
U.S. Appl. No. 14/214,815, filed Mar. 15, 2014.
U.S. Appl. No. 14/275,854, filed May 12, 2014.
U.S. Appl. No. 14/275,833, filed May 12, 2014.
U.S. Appl. No. 14/480,948, filed Sep. 9, 2014.
U.S. Appl. No. 14/480,967, filed Sep. 9, 2014.
U.S. Appl. No. 14/229,566, filed Mar. 28, 2014.
English translation of the Abstract of JP11172820.
Extended European Search Report dated Mar. 30, 3015, EPO application No. 12835221.8.

* cited by examiner

INSULATED CONCRETE FORM AND METHOD OF USING SAME

CROSS-REFERENCE TO RELATED APPLICATIONS

The present application is a continuation of application Ser. No. 13/247,133 filed Sep. 28, 2011, which is now U.S. Pat. No. 8,756,890.

FIELD OF THE INVENTION

The present invention generally relates to insulated concrete forms. More particularly, this invention relates to an insulated concrete form that is stronger than conventional insulated concrete forms so that it can hold the weight of a full lift of concrete and extend from floor to ceiling. The present invention also relates to an insulated concrete form that is easier to assemble and easier to use. The present invention also relates to an insulated concrete form that results in stronger concrete cured therein. The present invention also relates to an insulated concrete form that produces a wall that resists or prevents water intrusion. The present invention also related to an insulated concrete form for elevated slabs and roof systems. The present invention also relates to methods of using the insulated concrete form of the present invention. The present invention also related to a concrete structure that has a longer useful life than conventional concrete structures. The present invention further relates to a high efficiency building system that reduces energy consumption.

BACKGROUND OF THE INVENTION

Concrete walls, and other concrete structures, traditionally have been made by building a form. The forms are usually made from plywood, wood, metal and other structural members. Unhardened (i.e., plastic) concrete is poured into the space defined by opposed spaced form members. Once the concrete hardens sufficiently, although not completely, the forms are removed leaving a concrete wall, or other concrete structure or structural member. The unprotected concrete wall is then exposed to the elements during the remainder of the curing process. The exposure of the concrete to the elements, especially temperature variations, makes the curing of the concrete, and the ultimate strength it can achieve, as unpredictable as the weather. Therefore concrete structures are typically overdesigned with significant safety factors to make up for the unknown variables and uncertainty of the curing process.

Historically concrete has been placed in forms made of plywood reinforced by different types of framing members. Concrete placed in conventional forms is exposed to the temperature and humidity of the environment thus making the curing, and therefore the strength, dependent upon these variable factors. Concrete has high thermal mass and since most concrete buildings are built using conventional forms, the concrete assumes the ambient temperature. Thus, although they have many advantages, concrete buildings have relatively poor energy efficiency.

Insulated concrete form systems are known in the prior art and typically are made from a plurality of modular form members. In order to assist in keeping the modular form members properly spaced when concrete is poured between the stacked form members, transverse tie members are used in order to prevent transverse displacement or rupture of the modular form members due to the hydrostatic pressure created by fluid and unhardened concrete contained therein. U.S. Pat. Nos. 5,497,592; 5,809,725; 6,668,503; 6,898,912 and 7,124,547 (the disclosures of which are all incorporated herein by reference) are exemplary of prior art modular insulated concrete form systems.

Insulated concrete forms reduce heat transmission and provide improved energy efficiency to the building in which they are used. However the insulated concrete forms of the prior art have multiple shortcomings.

Concrete is a relatively heavy material. When placed into a vertical form the pressure at the bottom of a form filled with concrete is measured by multiplying the height of the wall by 150 lbs per square foot. In other words when pouring a 10 feet tall wall, the pressure at the bottom of a form will be 1500 lbs/ft$^2$. In addition, safety codes, and various concrete regulating bodies, demand that commercial forms be built to withstand approximately 2.5 times the static concrete pressure a form is actually intended to hold.

Conventional forms typically use aluminum or some type of plywood reinforced by a metal framing system. Opposed form members are held together by a plurality of metal ties that provide the form with the desired pressure rating. Conventional forms are designed to be strong, safe and durable to meet the challenges of any type construction, residential or commercial, low-rise or high-rise, walls, columns, piers or elevated slabs. While insulated concrete forms of the prior art provide relatively high energy efficiency, they lack the strength to withstand the relatively high fluid concrete pressures experienced by conventional concrete forms. Consequently, they are relegated mostly to residential construction or low-rise construction and find few applications in commercial construction.

In order to achieve relatively high energy efficiency, one must use insulated concrete forms made from foams with relatively high R values. However all types of foam have relatively low strength and structural properties. Therefore, insulated concrete forms of the prior art are relatively weak and cannot withstand the same high pressures experienced by conventional forms. Prior art insulated concrete forms have attempted to solve this problem by using higher density foams and/or by using a high number of ties between the foam panel members. However, such prior art insulated concrete form systems still suffer from several common problems.

First, in the construction of an exterior wall of a building, multiple insulated concrete form modules are stacked upon and placed adjacent to each other in order to construct the concrete form. In some insulated concrete form systems, the form spacers/interconnectors are placed in the joints between adjacent concrete form modules. Such form systems are not strong enough to build a form more than a few feet high. Concrete is then placed in the form and allowed to harden sufficiently before another course of insulating forms are added on top of the existing forms. Such systems result in cold joints between the various concrete layers necessary to form a floor-to-ceiling wall or a multi-story building. Cold joints in a concrete wall weaken the wall therefore requiring that the wall be thicker and/or use higher strength concrete than would otherwise be necessary with a wall that did not have cold joints. This generally limits current use of insulated concrete forms to buildings of a single story or two in height or to infill wall applications.

Second, the use of multiple form modules to form a wall, or other building structure, creates numerous joints between adjacent concrete form modules; i.e., between both horizontally adjacent form modules and vertically adjacent form modules. Such joints provide numerous opportunities for water from the concrete mix to leak out of the form. The proper amount of water and heat is necessary for concrete to harden to its maximum potential strength. Thus, the loss of water through leaky joints in adjacent form modules reduces the strength of the concrete.

Third, the use of multiple form modules to form a wall, or other building structure, creates numerous joints between adjacent concrete form modules; i.e., between both horizontally adjacent form modules and vertically adjacent form modules. The sum of all these joints makes the prior art insulated concrete forms inherently unstable and concrete blowouts are not uncommon. Since the wall forms are unstable, the use of additional forming materials, such as plywood, to stabilize the modular insulated concrete forms is required before concrete is poured. These additional materials are costly and time consuming to install. The multiple joints also provide numerous opportunities for water to seep into and through the concrete wall. Furthermore, some of the prior art wall spacer systems create holes in the insulated concrete forms through which water can seep, either in or out. Thus, the prior art modular insulated concrete forms do little, or nothing, to prevent water intrusion in the finished concrete wall.

Fourth, prior art modular insulated concrete form systems are difficult and time consuming to put together, particularly at a constructions site using unskilled labor.

Fifth, prior art modular insulated concrete form systems do little, or nothing, to produce a stronger concrete wall.

Sixth, prior art modular insulated concrete form systems do not meet the high pressure ratings that conventional concrete forms do.

Seventh, prior art modular insulated concrete form systems are designed to form walls and are not suitable for forming columns or piers or elevated concrete slabs.

Eighth, prior art modular insulated concrete form systems do not allow for forming of structural, load bearing high-rise construction Ninth, prior art modular insulated concrete form systems only allow for one type of wall cladding to be applied, such as a directly applied finish system. To install all other wall claddings, additional systems have to be installed, sometimes at greater expense than even in the conventional concrete forming systems. Some prior art modular insulated concrete form systems do not allow for the use of other types of wall cladding systems.

It would therefore be desirable to provide an insulated concrete form system that is relatively easy to assemble is stronger and permits the construction of floor-to-ceiling high walls without joints in the form and without cold joints in the concrete. It would further be desirable to provide an insulated concrete form system that reduces or eliminates water leakage from a plastic concrete mix placed in the form that would thereby allow the concrete to retain the moisture necessary for its proper curing to achieve its maximum strength. It would also be desirable to provide an insulated concrete form system that produces relatively harder concrete. It would also be desirable to provide an insulated concrete form system that prevents, or reduces, water intrusion through the finished wall. It would further be desirable to provide an insulated concrete form system that specifically accommodates and economically integrates different types of finished wall and/or ceiling cladding systems for both interior and exterior applications. Also, it would be desirable to provide an insulated concrete form system that can withstand the fluid concrete pressures equivalent to those of conventional concrete forms. In addition it would be desirable to provide an insulated concrete form system that can be used to form concrete walls, columns, piers, elevated slabs, roof systems and other concrete structures.

SUMMARY OF THE INVENTION

The present invention satisfies the foregoing needs by providing an improved insulated concrete form system. In a preferred disclosed embodiment, the present invention provides an insulated concrete form system that can withstand hydrostatic pressures equivalent to those of conventional concrete forms.

In one disclosed embodiment, the present invention comprises a connector for a pair of opposed spaced concrete forming panels. The connector comprises an elongate spacer member having flanges formed thereon intermediate a central portion of the spacer member and each opposite end thereof. The connector also comprises a portion of at least one end of the spacer member being sized and shaped to selectively engage an elongate panel bracing member. In an alternate disclosed embodiment thereof, the end of the spacer member comprises a head portion and a portion of reduced diameter intermediate the head portion and the flange.

In an alternate disclosed embodiment, the present invention comprises a form for concrete comprising a pair of opposed and spaced foam insulating panels. The form also comprises a plurality of spacer members disposed between the foam insulating panels for maintaining the foam insulating panels in a spaced relationship, a portion of each spacer member extending through and beyond a surface of at least one of the foam insulating panels.

In another alternate disclosed embodiment, the present invention comprises a concrete form. The concrete form comprises a pair of opposed and spaced foam insulating panels and a first plurality of elongate panel bracing members removably attached to one of the foam insulating panels, the first plurality of elongate panel bracing members being oriented horizontally and vertically spaced from each other. The concrete form also comprises a second plurality of elongate panel bracing members removably attached to the other of the foam insulating panels, the second plurality of elongate panel bracing members being oriented horizontally and vertically spaced from each other.

In another alternate disclosed embodiment, the present invention comprises a concrete form. The concrete form comprises a pair of opposed and spaced foam insulating panels and a plurality of elongate panel bracing members removably attached to one of the foam insulating panels, the plurality of elongate panel bracing members being oriented horizontally and vertically spaced from each other. The concrete form also comprises a first vertical elongate form bracing member contacting each of the elongate panel bracing members on a side thereof opposite the foam insulating panel.

In another alternate disclosed embodiment, the present invention comprises a concrete form. The concrete form comprises a pair of opposed and spaced foam insulating panels, each panel having an inner surface and an outer surface. The form also comprises a first reinforcing material disposed on the outer surface of at least one of the foam insulating panel.

In yet another alternate disclosed embodiment, the present invention comprises a concrete wall system. The concrete wall system comprises a pair of opposed spaced insulated concrete forming panels. A spacer member is disposed between the insulated concrete forming panels. At least one end of the spacer member extends through one of the insulated concrete forming panels and extends outwardly from an outer surface thereof. The end of the spacer member is adapted to selectively engage and alternately retain on the outer surface a horizontal bracing member or a vertical stud member. In a further alternate disclosed embodiment, the end of the spacer member comprises a head portion and a portion of reduced diameter between the head portion and the outer surface of the insulated concrete forming panel.

In another alternate disclosed embodiment, the present invention comprises a concrete form. The concrete form comprises a pair of opposed and spaced foam insulating panels, each panel having an inner surface and an outer surface. The form also comprises a reinforcing web disposed on the outer surface of at least one of the foam insulating panels.

In another alternate disclosed embodiment, the present invention comprises a concrete form. The concrete form comprises a foam insulating panel having an exterior surface. The concrete form also comprises a polymer coating on the exterior surface of the foam insulating panel, whereby the polymer coating provides a water-proof weather membrane on the exterior surface of the foam insulating panel.

In another alternate disclosed embodiment, the present invention comprises a connector for a pair of opposed spaced concrete forming panels. The connector comprises an elongate spacer member having flanges formed thereon intermediate a central portion of the spacer member and each opposite end thereof, a portion of at least one end of the spacer member being sized and shaped to selectively engage an elongate panel bracing member.

In another alternate disclosed embodiment, the present invention comprises a method. The method comprises inserting a first elongate spacer member into a first hole defined by a first concrete forming panel, the first spacer member having a flange formed thereon intermediate a central portion and an end portion thereof, the first spacer member being inserted into the first hole such that the flange contacts an inner surface of the first concrete forming panel and the end portion of the first spacer member extend outwardly from an outer surface of the first concrete forming panel. The method further comprises inserting a second elongate spacer member into a second hole defined by the first concrete forming panel, the second spacer member having a flange formed thereon intermediate a central portion and an end portion thereof, the second spacer member being inserted into the second hole such that the flange contacts an inner surface of the first concrete forming panel and the end portion of the second spacer member extend outwardly from an outer surface of the first concrete forming panel. The method also comprises attaching an elongate panel bracing member to the end portions of the first and second spacer members extending from the outer surface of the first concrete forming panel. In a further disclosed embodiment, the method comprises inserting a third elongate spacer member into a third hole defined by a second concrete forming panel, the third spacer member having a flange formed thereon intermediate a central portion and an end portion thereof, the third spacer member being inserted into the third hole such that the flange contacts an inner surface of the second concrete forming panel and the end portion of the second spacer member extend outwardly from an outer surface of the second concrete forming panel. The method also comprises attaching the elongate panel bracing member to the end portion of the third spacer member extending from the outer surface of the second concrete forming panel.

In another alternate disclosed embodiment, the present invention comprises a concrete form. The concrete form comprises a horizontal foam insulating panel. A plurality of anchor members are attached to the horizontal foam insulating panel, a portion of each anchor member extending through and beyond an upper surface of the horizontal foam insulating panel. An end of each panel anchor member distal from the horizontal foam insulating panel is enlarged.

In another alternate disclosed embodiment, the present invention comprises a method of forming an elevated horizontal concrete slab or roof system. The method comprises temporarily supporting at a desired height a horizontal foam insulating panel. The method also comprises placing a plastic concrete mix on the horizontal foam insulating panel and placing an insulating member on an upper surface of the plastic concrete mix.

Accordingly, it is an object of the present invention to provide an improved insulated concrete form system.

Another object of the present invention is to provide an insulated concrete form system that can be used to form walls, columns, piers, elevated slabs, roof systems and other concrete structures.

A further object of the present invention is to provide an insulated elevated concrete slab or insulated concrete roof system that has improved sound insulation properties.

Another object of the present invention is to provide an insulated concrete form system that is relatively easy to manufacture and/or to assemble.

Still another object of the present invention is to provide an insulated concrete form system that produces stronger concrete than prior art insulated concrete form systems, or any other concrete form system.

Another object of the present invention is to provide an insulated concrete form system that has a continuous weather membrane on an exterior surface, and also provides a drainage cavity, thereby reducing or preventing water intrusion.

Yet another object of the present invention is to provide an improved panel spacer member for an insulated concrete form system.

Another object of the present invention is to provide a system for constructing a relatively high, energy efficient exterior building envelope.

Still another object of the present invention is to provide a system for curing concrete that results in concrete with increased strength, durability and resistance to abrasion.

Another object of the present invention is to provide an insulated concrete form system that keeps concrete moist, by preventing the loss of moisture from the plastic concrete during the period in which it is gaining strength and durability.

Still another object of the present invention is to provide an insulated concrete form system that produces hard, dense concrete with improved resistance to corrosive actions in addition to minimizing shrinkage and permeability of the concrete.

Another object of the present invention is to provide an insulated concrete form system that provides improved temperature stability for the curing of concrete.

A further object of the present invention is to provide an insulated concrete form system that permits the placement of concrete during cold weather, which thereby allows construction projects to proceed rather than be shutdown due to inclement weather.

Yet another object of the present invention is to provide an insulated concrete form that has a reinforcing layer on an outer surface of a foam insulating panel that provides a substrate for attaching decorative surfaces, such as ceramic tile, stone, thin brick, stucco or the like.

A further object of the present invention is to provide an insulated concrete form system that can withstand pressures equivalent to conventional concrete form systems.

Another object of the present invention is to provide an insulated concrete form that retains the heat generated by the hydration of the cement during the early stage of concrete setting and curing.

Another object of the present invention is to provide an integrated anchor/attachment system for relatively easy and inexpensive attachment of a variety of exterior or interior wall and ceiling cladding systems.

Still another object of the present invention is to provide an insulated concrete form system that provides an improved curing environment for concrete.

Another object of the present invention is to provide an insulated concrete form system that provides a panel spacer member to which elongate panel bracing members can be attached.

A further object of the present invention is to provide an insulated concrete form system that provides a panel spacer member to which exterior or interior wall and ceiling cladding systems can be attached.

These and other objects, features and advantages of the present invention will become apparent after a review of the following detailed description of the disclosed embodiments and the appended drawing and claims.

DETAILED DESCRIPTION OF THE DISCLOSED EMBODIMENTS

Figure 1:
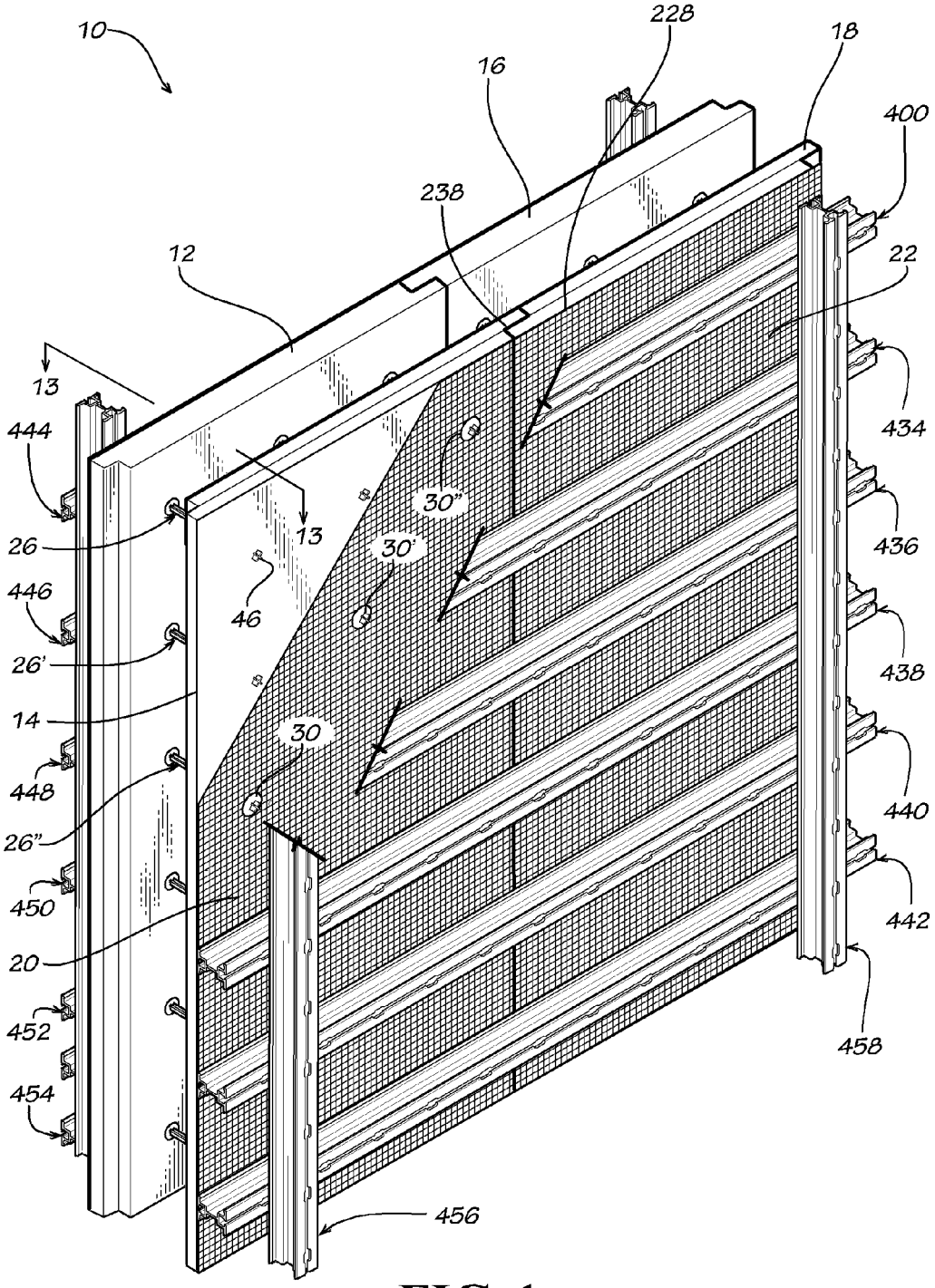
FIG. 1 is a perspective view of an insulated concrete form in accordance with a disclosed embodiment of the present invention.

Referring now to the drawing in which like numbers indicate like elements throughout the several views, there is shown in FIG. 1 a disclosed embodiment of an insulated concrete form 10 in accordance with the present invention. The insulated concrete form 10 includes a first exterior foam insulating panel 12 generally parallel to and spaced apart from a first interior foam insulating panel 14. Adjacent the first exterior foam insulating panel 12 is a second exterior foam insulating panel 16; adjacent the first interior foam insulating panel 14 is a second interior foam insulating panel 18. The foam insulating panels 12-18 can be made from any insulating material that is sufficiently rigid to withstand the pressures of the concrete placed in the form. The foam insulating panels 12-18 are preferably made from a polymeric foam material, such as molded expanded polystyrene or extruded expanded polystyrene. Other polymeric foams can also be used including, but nor limited to, polyisocyanurate and polyurethane. If the foam insulating panels are made from a material other than polystyrene, the foam insulating panels should have insulating properties equivalent to at least 1 inch of expanded polystyrene foam; preferably, between 2 and 8 inches of expanded polystyrene foam; especially at least 2 inches of expanded polystyrene foam; more especially at least 3 inches of expanded polystyrene foam; most especially, at least 4 inches of expanded polystyrene foam.

The foam insulating panels should also have a density sufficient to make them substantially rigid, such as approximately 1 to approximately 3 pounds per cubic foot, preferably approximately 1.5 pounds per cubic foot. High density extruded expanded polystyrene is available under the trademark Neopor® and is available from Georgia Foam, Gainesville, Ga. The foam insulating panels 12-18 can be made by molding to the desired size and shape, by cutting blocks or sheets of pre-formed expanded polystyrene into a desired size and shape or by extruding the desired shape and then cutting to the desired length. Although the foam insulating panels 12-18 can be of any desired size, it is specifically contemplated that the foam insulating panels will be of a height equal to the distance from a floor to a ceiling where a building wall or column is to be constructed. Thus, the height of the foam insulating panels will vary depending on the ceiling height of a particular building construction. However, for ease of handling, the foam insulating panels will generally be 9 feet 6 inches high and 4 feet 1 inches wide. These dimension will also vary depending on whether the panels are the interior panel or the exterior panel, as is explained in applicant's U.S. Pat. No. 8,555,583, the disclosure of which is incorporated herein by reference in its entirety.

Applied to the outer surface of each of the foam insulating panels 12-18 is a layer of reinforcing material, such as the layers of reinforcing material 20, 22 on the foam insulating panels 14, 18 respectively (FIG. 2), and as also disclosed in applicant's co-pending patent application Ser. No. 12/753,220 filed Apr. 2, 2010. The layers of reinforcing material 20-22 can be made from continuous materials, such as sheets or films, or discontinuous materials, such as fabrics, webs or meshes. The layers of reinforcing material 20-22 can be made from material such as polymers, for example polyethylene or polypropylene, from fibers, such as fiberglass, basalt fibers, aramid fibers or from composite materials, such as carbon fibers in polymeric materials, or from metal sheets, such as steel or aluminum sheets or corrugated sheets, and foils, such as metal foils, especially aluminum foil. The layers of reinforcing material 20, 22 can be adhered to the outer surfaces of the foam insulating panels 12-18 by a conventional adhesive. However, it is preferred that the layers of reinforcing material 20-22 be laminated to the outer surfaces of the foam insulating panels 12-18 using a polymeric material that also forms a weather or moisture barrier on the exterior surface of the foam insulating panels. The weather barrier can be applied to a layer of reinforcing material 20-22 on the surface of the foam insulating panels 12-18 by any suitable method, such as by spraying, brushing or rolling. The moisture barrier can be applied as the laminating agent for the layer of reinforcing material 20-22 or it can be applied in addition to an adhesive used to adhere the layer of reinforcing material to the outer surfaces of the foam insulating panels 12-18. Suitable polymeric materials for use as the moisture barrier are any waterproof polymeric material that is compatible with both the material from which the layer of reinforcing material and the foam insulating panels 12-18 are made; especially, liquid applied weather membrane materials. Useful liquid applied weather membrane materials include, but are not limited to, WeatherSeal® by Parex of Anaheim, Calif. (a 100% acrylic elastomeric waterproof membrane and air barrier which can be applied by rolling, brushing, or spraying) or Senershield® by BASF (a one-component fluid-applied vapor impermeable air/water-resistive barrier that is both waterproof and resilient) available at most building supply stores.

The foam insulating panels 12-18 are held in their spaced apart relationship by a plurality of spacer/locking cap assemblies 24. The spacer/locking cap assembly 24 (FIG. 3) is preferably formed from a polymeric material, such as polyethylene, polypropylene, nylon, glass filled thermoplastics or thermosetting plastics, such as vinyl ester fiberglass, or the like. For particularly large or heavy structures, the panel spacer member 26 is preferably formed from glass filled nylon. The spacer/locking cap assembly 24 can be formed by any suitable process, such as by injection molding or pultrusion.

Figure 5:
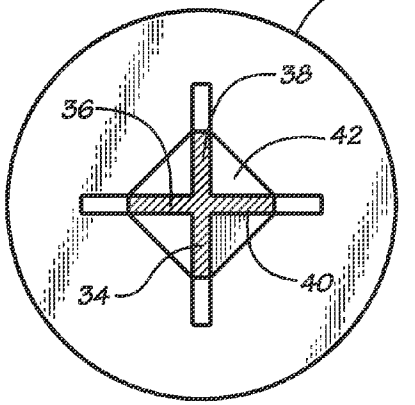
FIG. 5 is a cross-sectional view taken along the line 5-5 of the panel spacer member shown in FIG. 4.
Figure 4:
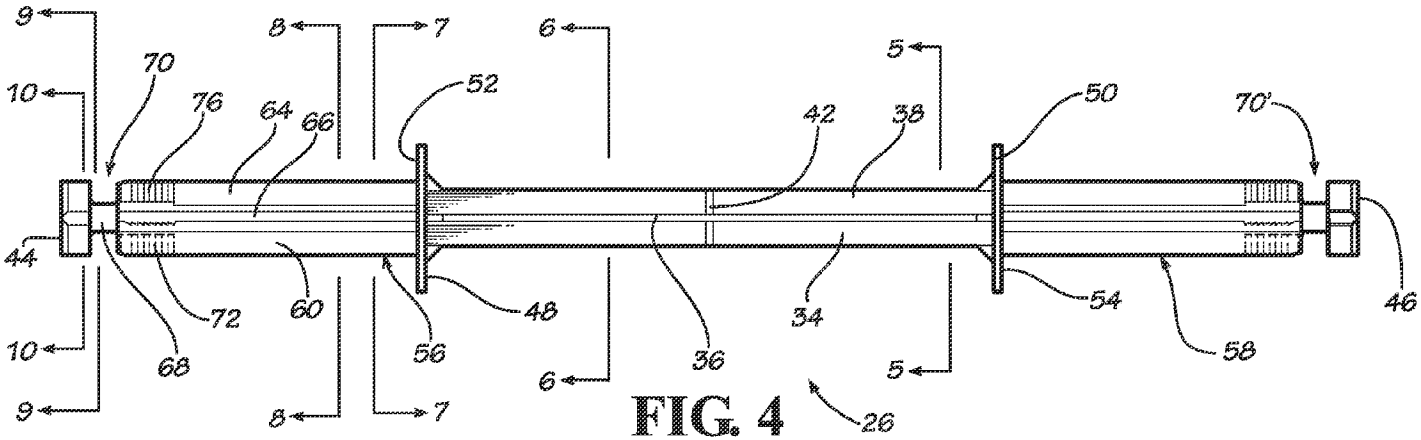
FIG. 4 is a top plan view of the panel spacer member shown in FIG. 3.

Each spacer/locking cap assembly 24 includes three separate pieces: a panel spacer member 26, a first locking cap 28 and a second locking cap 30. The panel spacer member 26 includes an elongate central member 32. The central member 32 can be any suitable shape, such as square, round, oval or the like, but in this embodiment is shown as having a generally plus sign ("+") cross-sectional shape. The central member 32 comprises four outwardly extending leg members 34, 36, 38, 40 (FIGS. 4 and 5). The plus sign ("+") cross-sectional shape of the central member 32 prevents the panel spacer member 26 from rotating around its longitudinal axis during concrete placement and especially once the concrete has hardened. A central flange 42 extends outwardly from the center of the central member 32. The central flange 42 is square in shape and is co-extensive with the legs 34-40. The central flange 42 prevents the panel spacer member 26 from longitudinal movement once the concrete has hardened.

Formed intermediate each end 44, 46 of the panel spacer member 26 and the central flange 42 are flanges 48, 50, respectively, that extend radially outwardly from the central member 32. Each of the flanges 48, 50 includes a generally flat foam insulating panel contacting portion 52, 54, respectively. The flanges 48, 50 can be any suitable shape, such as square, oval or the like, but in this embodiment are shown as circular. Reinforcing ribs can be provided to reinforce the flanges 48, 50.

Outboard of the flanges 48, 50; i.e., between each of the flanges 48, 50 and the ends 44, 46, respectively, are panel penetrating portions 56, 58, respectively, of the panel spacer member 26. The panel penetrating portions 56, 58 are identical in construction except that they are mirror images of each other. Therefore, only the panel penetrating portion 56 will be described in detail here.

Figure 3:
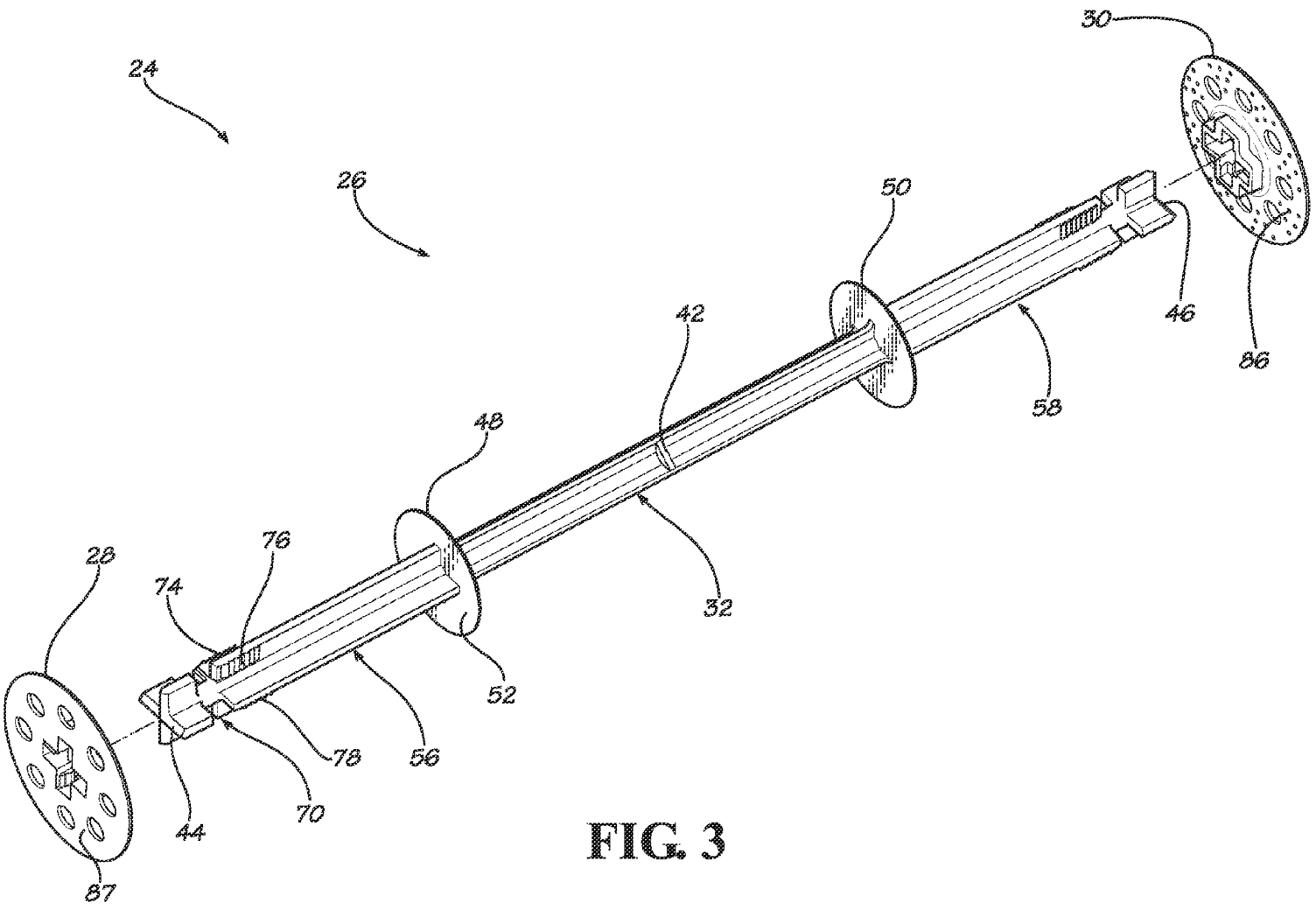
FIG. 3 is an exploded perspective view of a disclosed embodiment of a spacer/locking cap assembly in accordance with the present invention.
Figure 7:
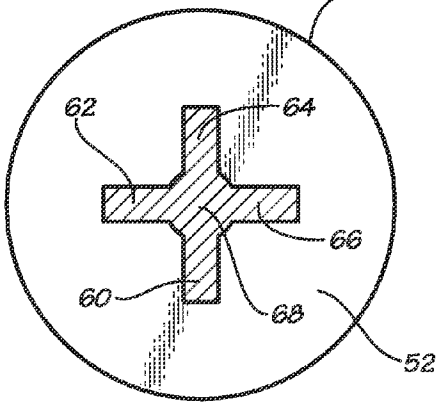
FIG. 7 is a cross-sectional view taken along the line 7-7 of the panel spacer member shown in FIG. 4.
Figure 6:
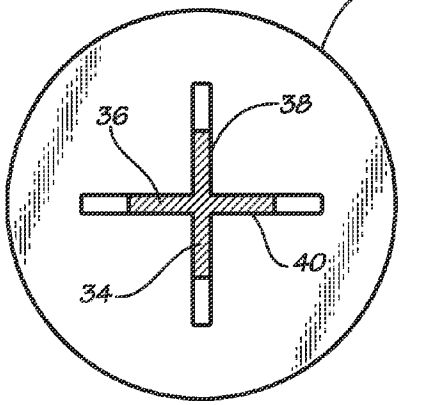
FIG. 6 is a cross-sectional view taken along the line 6-6 of the panel spacer member shown in FIG. 4.
Figure 8:
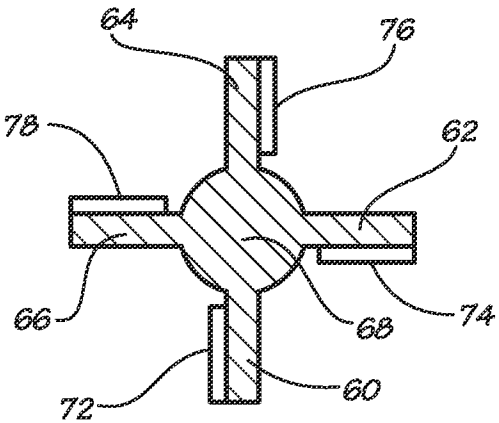
FIG. 8 is a cross-sectional view taken along the line 8-8 of the panel spacer member shown in FIG. 4.

The panel penetrating portion 56 of the panel spacer member 26 comprises four legs 60, 62, 64, 66 extending radially outwardly from a central round core 68 (FIGS. 4 and 7). The legs 60-66 extend longitudinally from the flange 48 to the end 44 of the panel spacer member 26. However, an annular slot 70 is formed in the panel penetrating portion 56 adjacent the end 44 thereof. The slot 70 is formed by essentially eliminating the legs 60-66 for a portion of the length of the panel penetrating portion 56 so that only the round core portion 68 extends longitudinally through the slot portion. On each of the legs 60-66 adjacent the slot 70 is formed a plurality of teeth 72, 74, 76, 78 (FIGS. 3, 4 and 8).

Figure 11:
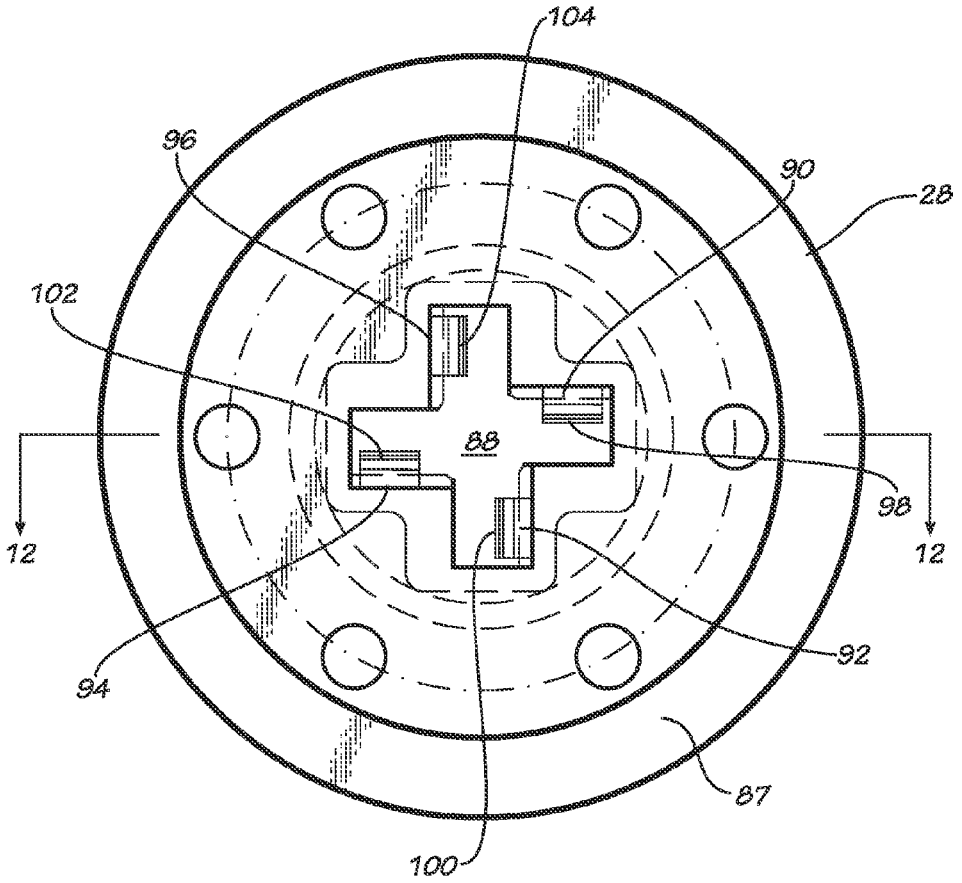
FIG. 11 is a top plan view of one of the locking caps shown in FIG. 3.
Figure 12:
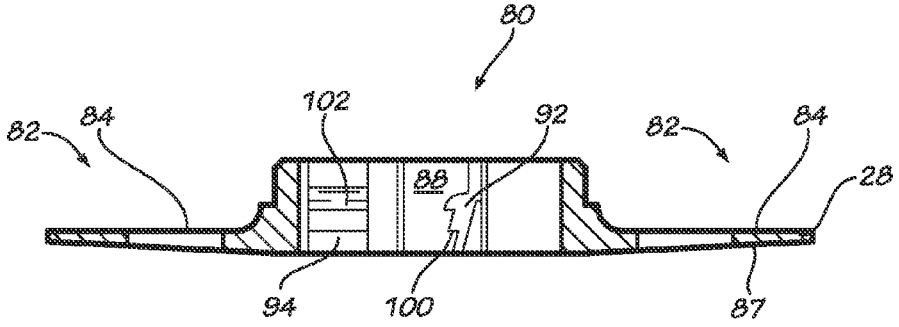
FIG. 12 is a cross-sectional view taken along the line 12-12 of the locking caps shown in FIG. 11.

The first and second locking caps 28, 30 are identical in configuration and each are essentially circular disk-shaped, although any other suitable shape can be used, such as square, oval, octagonal, and the like. Each of the first and second locking caps 28, 30 includes a central panel spacer member receiving portion 80 and a circumferential insulating panel contacting portion 82. Each of the locking caps 28, 30 includes a generally flat foam insulating panel contacting portion 84, 86 (FIGS. 3, 11, 12), respectively, adjacent its circumferential edge and a substantially flat or flat exterior surface 87. The central panel spacer member receiving portion 80 defines an opening 88 for receiving one of the ends 44, 46 of the panel spacer member 26. The opening 88 is sized and shaped such that the four legs 60-66 will fit through the opening. Formed within the opening 88 are four latch fingers 90, 92, 94, 96. Each latch finder 90-96 includes a plurality of teeth 98, 100, 102, 104, respectively, that are sized and shaped to mate with the teeth 72-78 on the panel spacer member 26. The latch fingers 90-96 are designed so that they can move outwardly; i.e., toward the circumferential portion 82, when one of the ends 44, 46 of the panel spacer member 26 is inserted in the opening 88 of the locking cap 28, but will tend to return to its original position due to the resiliency of the plastic material from which it is made. Thus, as the end 44 of the panel spacer member 26 is inserted into and through the opening 88, the teeth 98-104 will ride over the teeth 72-78. However, once the teeth 98-104 mate with the teeth 72-78 they prevent removal of the panel spacer member 26 from the locking cap 28. The teeth 98-104 and 72-78 therefore provide a one-way locking mechanism; i.e., the first and second locking caps 28, 30 can be relatively easily inserted onto the panel spacer member 26, but once fully inserted, the locking caps are locked in place and cannot be removed from the panel spacer member under normally expected forces.

Figure 2:
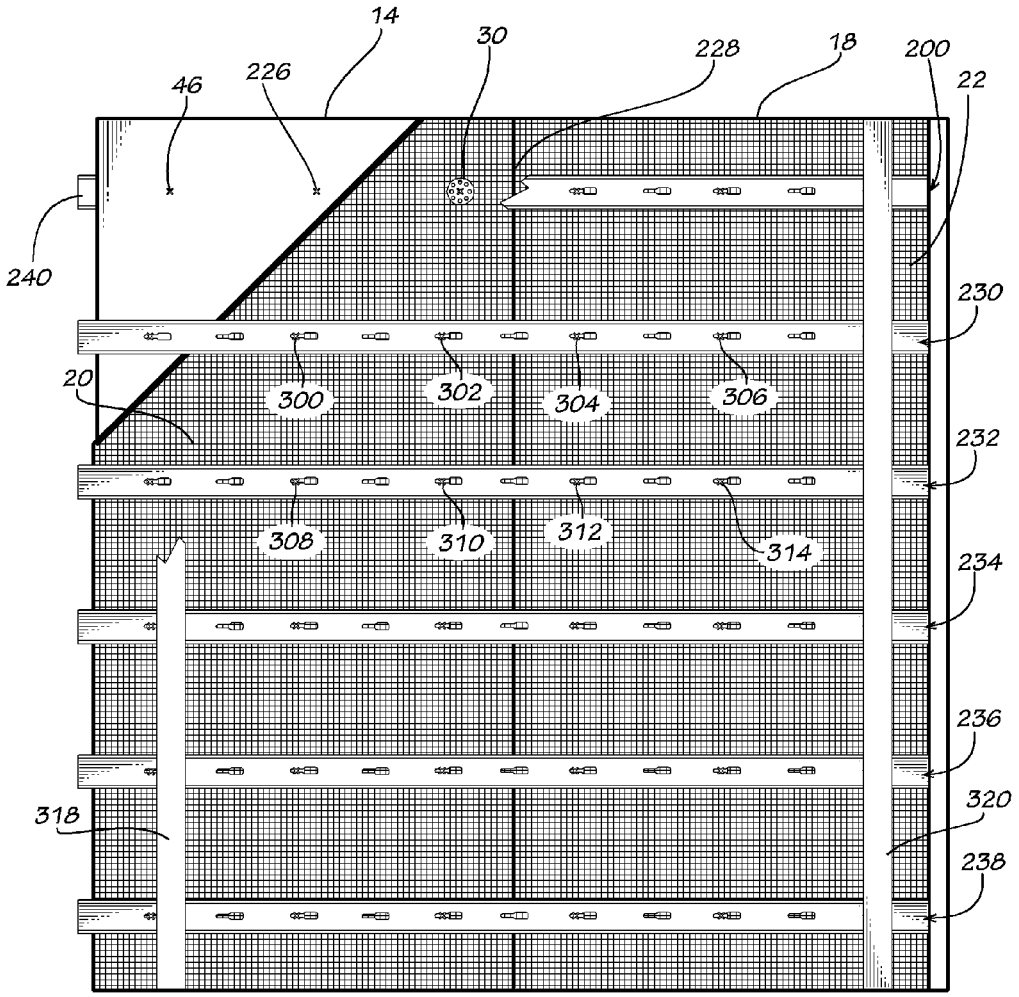
FIG. 2 is a partially broken away side view of an alternate disclosed embodiment of the insulated concrete form shown in FIG. 1.
Figure 13:
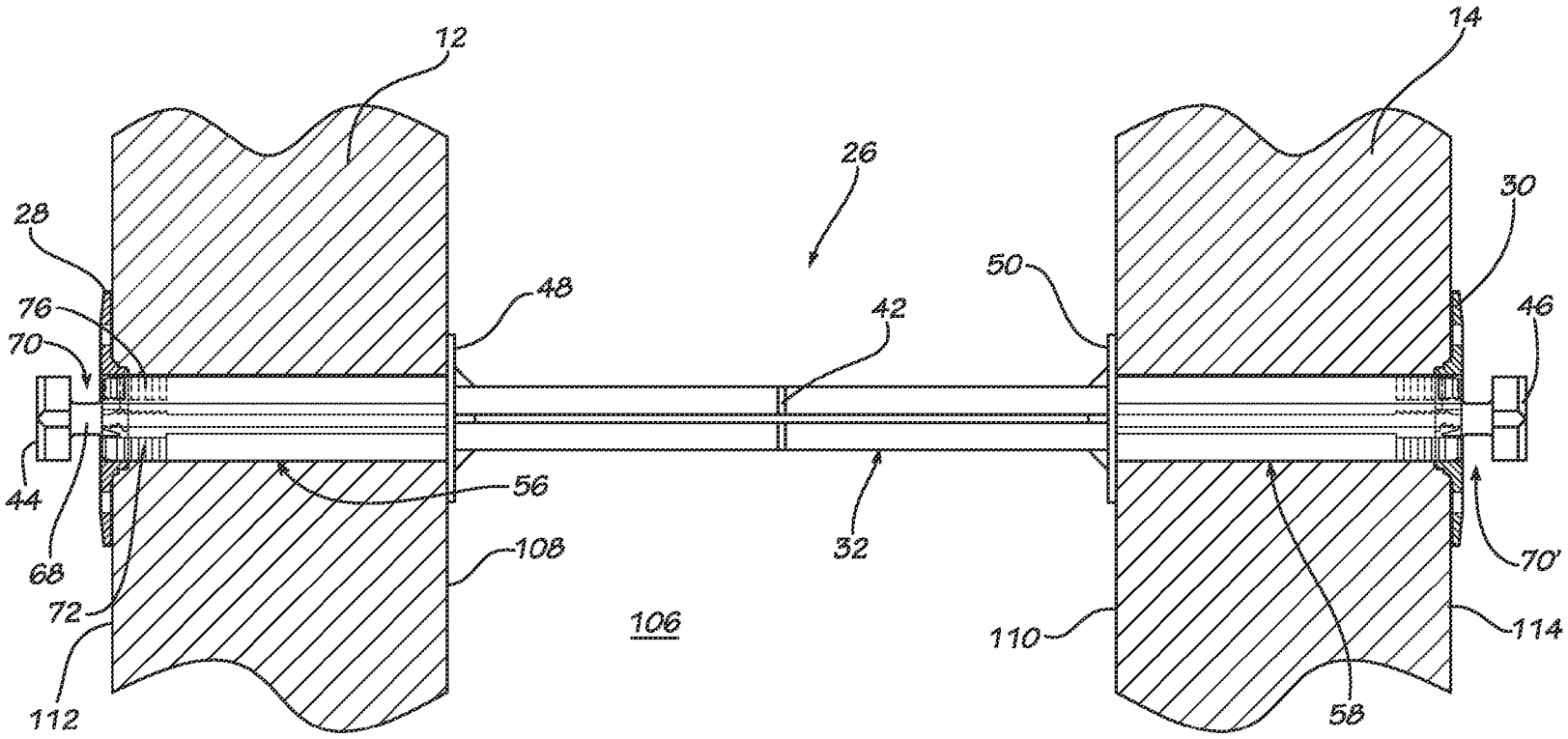
FIG. 13 is a partial cross-sectional view of the insulated concrete form shown in FIG. 1 without the whalers and strongbacks.
Figure 15:
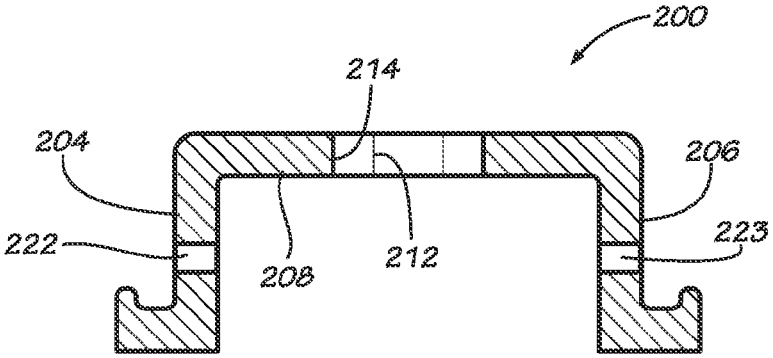
FIG. 15 is a cross-sectional view taken along the line 15-15 of the whaler shown in FIG. 14.
Figure 14:
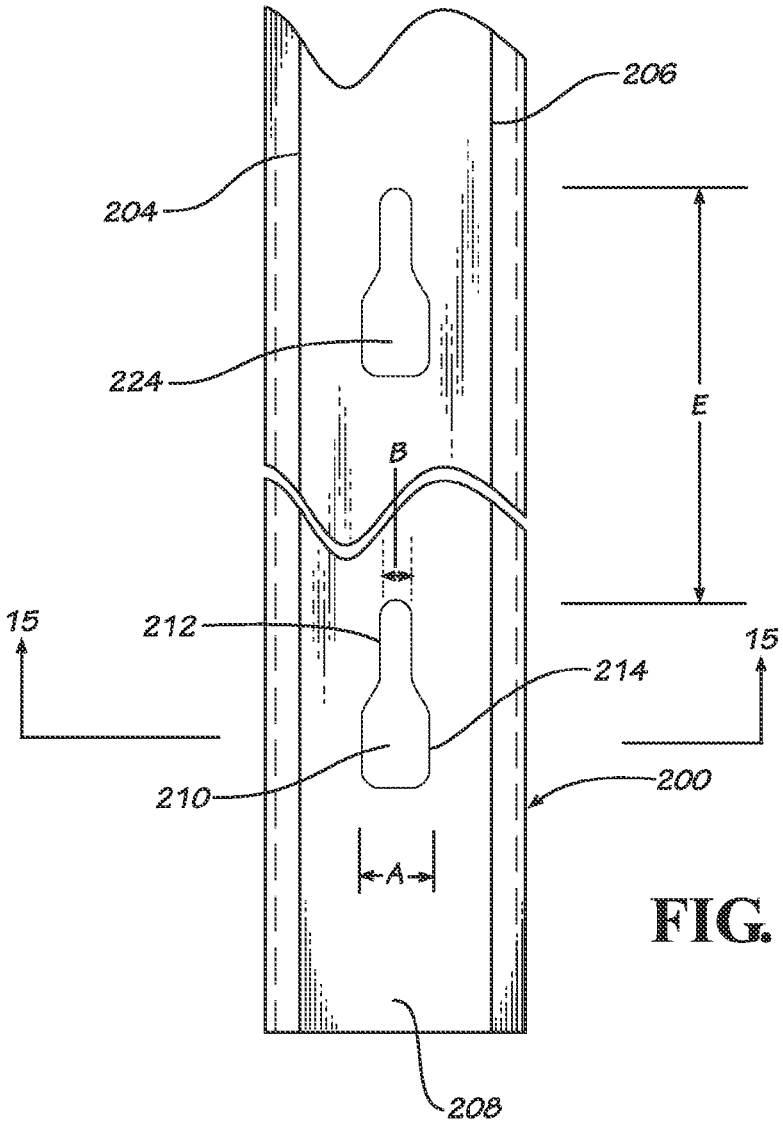
FIG. 14 is a top plan view of one of the whalers shown in FIG. 1.
Figure 16:
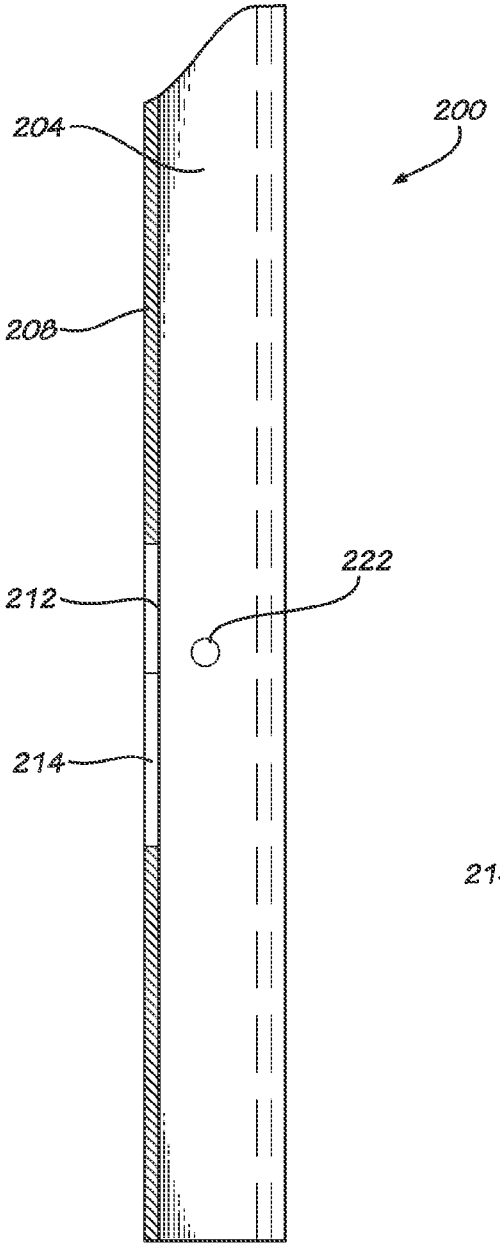
FIG. 16 is a partial side view of the whaler shown in FIG. 14.
Figure 20:
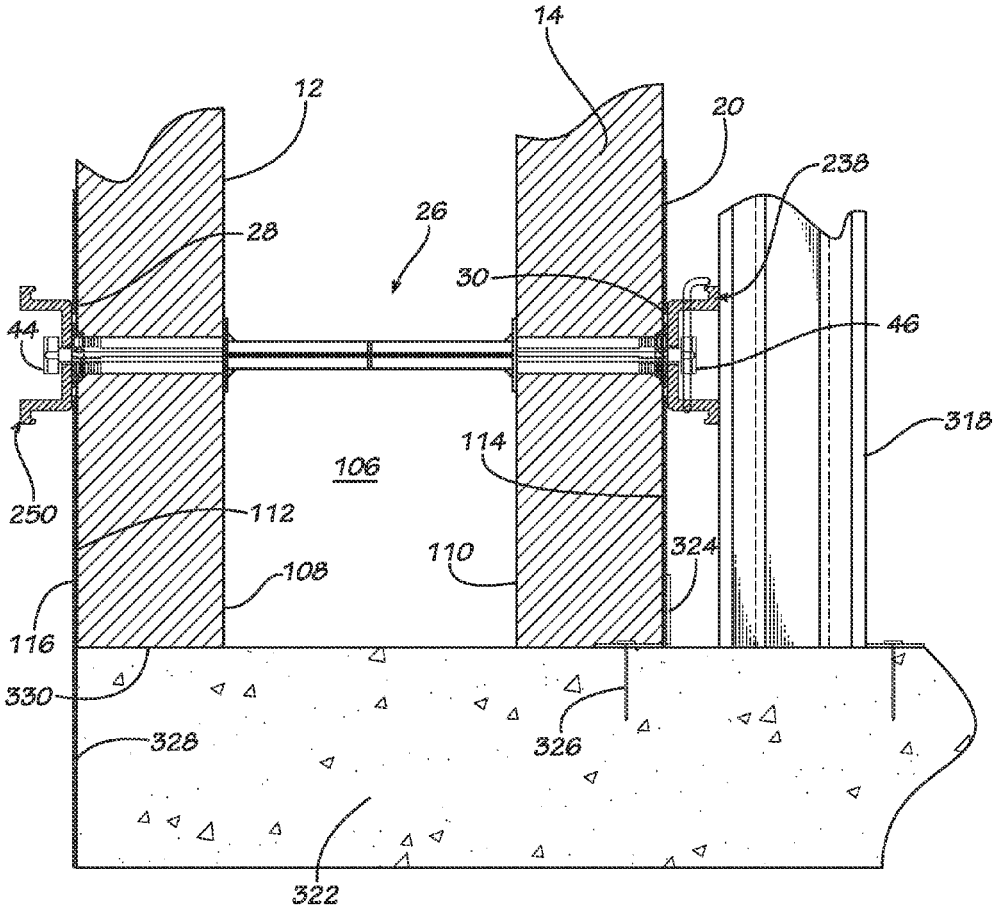
FIG. 20 is a partial detail view of the insulated concrete form shown in FIG. 19.

Insulated concrete forms of the present invention can be used to form exterior walls of buildings, load-bearing interior walls, columns, piers, elevated slabs, roof systems and other similar structures. When forming such an exterior wall, one form is the exterior form and the other form is the interior form. The two forms define a concrete receiving space there between. As shown in FIG. 13, the insulated concrete forms 10 in accordance with a disclosed embodiment of the present invention comprises two parallel, spaced apart foam insulating panels 12, 14. As shown in FIGS. 1 and 2, the foam insulating panel 12 is the exterior panel and the foam insulating panel 14 is the interior panel. The two foam insulating panels 12, 14 define a concrete receiving space 106 there between. Each of the foam insulating panels 12, 14 has an inner surface 108, 110 and an outer surface 112, 114, respectively. The inner surfaces 108, 110 of the foam insulating panels 12, 14 face toward and define the concrete receiving space 106. It is optional, but highly desirable, to adhere a layer of reinforcing material 116, 20 to each of the outer surfaces 112, 114, respectively, of the foam insulating panels 12, 14 (FIG. 20). The layers of reinforcing material 116, 20 are disposed between the outer surfaces 112, 114 of the foam insulting panels 12, 14 and the locking caps 28, 30. The layers of reinforcing material 116, 20 helps to distribute the pulling force from the locking caps 28, 30 across the outer surfaces 112, 114 of the foam insulating panels 12, 14. The layers of reinforcing material 116, 20 also help the foam insulating panels 12, 14 withstand the forces exerted by plastic concrete in the concrete receiving space 106. The layers of reinforcing material 116, 20 can be made from material such as polymers, for example polyethylene or polypropylene, from fibers, such as fiberglass, basalt fibers, aramid fibers or from composite materials, such as carbon fibers in polymeric materials, or from metal sheets, such as steel or aluminum sheets or corrugated sheets, and foils, such as metal foils, especially aluminum foil. The layer of reinforcing material 116, 20 can be in the form of a continuous layer, films or sheet or in the form of a discontinuous layer, fabric, mesh or web. The layers of reinforcing material 116, 20 can be adhered to outer surfaces 112, 114 of the foam insulating panels 12, 14 by a conventional adhesive. The adhesive can be applied to the outer surfaces 112, 114 of the foam insulating panels 12, 14 by any means, such as by brushing or spraying, and then the layer of reinforcing material 116, 20 can be applied on top of the adhesive. Or, the layer of reinforcing material can be embedded in the liquid applied weather membrane, as describe above. Fiberglass mesh useful in the present invention is commercially available under the designation reinforced fiberglass mesh from JPS Composites of Anderson, S.C. Preferably, after the layers of reinforcing material 116, 20 are adhered to the outer surfaces 112, 114 of the foam insulating panels 12, 14, a polymeric moisture barrier is then applied to the outer surfaces of the reinforcing material/foam insulating panels. The term "composite foam insulating panel" as used herein shall mean the combination of a foam insulating panel and a layer of reinforcing material on an exterior surface of the foam insulating panel.

The insulated concrete form 10 is prepared by forming holes in the composite foam insulating panels 12, 14 to receive the ends 44, 46 and panel penetrating portions 56, 58 of the panel spacer member 26. Holes (not shown) in the composite foam insulating panels 12, 14 can be formed by conventional drilling, such as with a rotating drill bit, by water jets or by hot knives. When the foam insulating panels 12, 14 include a layer of reinforcing material 116, 20, the layer of reinforcing material is preferably adhered to the foam insulating panels before the holes are formed in those panels. It is also preferable to form the holes in the composite foam insulating panels 12, 14 after the moisture barrier is applied to the outer surfaces 112, 114 of the composite foam insulating panels. First, in each of the composite foam insulating panels 12, 14, round holes are formed through the thickness of the panels extending from the inner surfaces 108, 110 to the outer surfaces 112, 114. The inner diameter of the holes is the equal to the outer diameter of the central round core 68 of the panel spacer member 26 so as to form a tight fit when the panel penetrating portions 56, 58 are inserted into the holes. Then, slots (not shown) radiating outwardly from the initial hole and spaced circumferentially 90 degrees from each other are drilled in the composite foam insulating panels 12, 14 to accommodate the legs 60-66 of the panel spacer member 26 and to form a tight fit therewith. Alternately, a hole matching the cross-sectional shape of the ends 44, 46 of the panel spacer member 26, including the central round core 68 and the legs 60-68, can be formed in the composite foam insulating panels 12, 14 using a hot knife. The holes formed in the composite foam insulating panels 12, 14 extend from the inner surfaces 108, 110 to the outer surfaces 112, 114, respectively, of the composite foam insulating panels so that the foam panel penetrating portions 56, 58 of the panel spacer member 26 can be inserted complete through the composite foam insulating panels, as shown in FIG. 13.

The insulated concrete form 10 is assembled by inserting the foam panel penetrating portion 56 of the panel spacer member 26 through the hole in the first composite foam insulating panel 12 until the panel contacting portion 52 of the flange 48 contacts the inner surface 108 of the first composite foam insulating panel and the end 44 of the panel spacer member extends outwardly from the outer surface 112 of the first composite foam insulating panel, such that the legs 60-68 are flush with the outer surface and the slot 70 extends outwardly from the outer surface of the first composite foam insulating panel (FIG. 13). The locking cap 28 is then attached to the panel spacer member 26 by inserting the end 44 thereof protruding from the first form insulating panel 12 into the opening 88 in the locking cap such that the panel contacting portion 84 thereof contacts the outer surface 112 of the first composite foam insulating panel. As the panel penetrating portion 56 of the panel spacer member 26 is inserted into the locking cap 28, the latch fingers 90-96 deflect outwardly such that the teeth 72-78 on the legs 60-68 will slide over the teeth 98-104 of the latch fingers and permit the locking cap 28 to be slipped onto the panel penetrating portion of the panel spacer member. When the locking cap 28 is fully inserted onto the panel spacer member 26, the teeth 98-104 of the latch fingers 90-96 of the locking cap 28 and the teeth 72-78 on the legs 60-68 mate preventing movement of the locking cap outwardly away from the composite foam insulating panel 12, thereby locking the locking cap and the panel spacer member 26 together and capturing the first composite foam insulating panel between the flange 48 on the panel spacer member and the locking cap. When the panel contacting surface 84 of the locking cap 28 contacts the outer surface 112 of the first composite foam insulating panel 12 sufficient addition pressure is applied pushing the locking cap and the panel spacer member 26 together such that the foam of the first composite foam insulating panel is compressed slightly thereby providing a tight seal between the panel contacting portion 84 of the locking cap 28 and the panel contacting portion 52 of the flange 48 and the inner surface 108 thereby providing a water-proof or substantially water-proof seal. It should be noted that when the layer of reinforcing material 116, 20 is used on the outer surfaces 112, 114 of the composite foam insulating panels 12, 14, the layer of reinforcing material 116 will be captured between the panel contacting portion 84 of the locking cap 28 and the outer surface 112 of the composite foam insulating panel 12 (see for example FIG. 20). After the locking cap 28 has been secured to the panel spacer member 26, as described above, the liquid applied weather membrane can optionally be applied to the locking cap and to the composite foam insulating panel surrounding the locking cap so that the weather membrane forms a continuous protective layer over the surface of the composite foam insulating panel.

The second composite foam insulating panel 14 and the panel spacer member 26 are then brought together such that the end 46 of the panel spacer member is inserted into the hole in the second composite foam insulating panel, until the panel contacting portion 54 of the flange 50 contacts the inner surface 110 of the second composite foam insulating panel and the end 46 of the panel spacer member extends outwardly from the outer surface 114 of the second composite foam insulating panel, such that the legs are flush with the outer surface and the slot 70' extends outwardly from the outer surface of the second composite foam insulating panel, as shown in FIG. 13. The second locking cap 30 is then attached to the panel spacer member 26 by inserting the end 46 thereof protruding from the second form insulating panel 14 into the opening 88 in the locking cap such that the panel contacting portion 86 thereof contacts the outer surface 114 of the second composite foam insulating panel 14. As the panel penetrating portion 58 of the panel spacer member 26 is inserted into the locking cap 30, the latch fingers 90-96 deflect outwardly such that the teeth on the legs will slide over the teeth 98-104 of the latch finger and permit the locking cap 30 to be slipped onto the panel penetrating portion of the panel spacer member. When the locking cap 30 is fully inserted onto the panel spacer member 26, the teeth 98-104 of the latch fingers 90-96 of the locking cap 30 and the teeth on the legs of the panel penetrating portion 58 mate preventing movement of the locking cap outwardly away from the composite foam insulating panel 14, thereby locking the locking cap 30 and the panel spacer member 26 together and capturing the second composite foam insulating panel 14 between the flange 50 on the panel spacer member and the locking cap. When the panel contacting surface 86 of the locking cap 30 contacts the outer surface 114 of the second composite foam insulating panel 14 sufficient addition pressure is applied pushing the locking cap and the panel spacer member 26 together such that the foam of the second composite foam insulating panel is compressed slightly thereby providing a tight seal between the panel contacting portion 86 of the locking cap 30 and the panel contacting portion 54 of the flange 50 and the inner surface 110 thereby providing a water-proof or substantially water-proof seal. It should be noted that when the layer of reinforcing material 116, 20 is used on the outer surfaces 112, 114 of the composite foam insulating panels 12, 14, the layer of reinforcing material 20 will be captured between the panel contacting portion 86 of the locking cap 30 and the outer surface 114 of the composite foam insulating panel 14 (see for example FIG. 20). After the locking cap 30 has been secured to the panel spacer member 26, as described above, the liquid applied weather membrane can optionally be applied to the locking cap and to the composite foam insulating panel surrounding the locking cap so that the weather membrane forms a continuous protective layer over the surface of the composite foam insulating panel.

As shown in FIG. 1, a plurality of identical panel spacer members, such as the panel spacer members 26, 26' and 26", and identical mating locking caps, such as the locking caps 30, 30' and 30", are positioned in spaced rows and columns across the width and height of the composite foam insulating panels 12, 14. When unhardened concrete is introduced into the concrete receiving space 106, the hydrostatic pressure of the unhardened concrete pushes outwardly on the composite foam insulating panels 12, 14 and tends to push those panels apart. The spacer/locking cap assemblies 24 are used to prevent the composite foam insulating panels 12, 14 from moving apart due to the outwardly directed pressure exerted by the unhardened concrete (plastic concrete). The diameter of the locking caps 28, 30 should therefore be as large as practical to provide as much surface area over which to distribute the force resisting the outward movement of the composite foam insulating panels 12, 14. The diameter of the locking caps 28, 30 will depend on factors including the thickness of the concrete being poured, the height of the concrete pour, the thickness of the composite foam insulating panels and the distance between adjacent spacer/locking cap assemblies 24. However, it is found as a part of the present invention that locking caps 28, 30 having diameters of approximately 2 to 4 inches, especially approximately 3 inches, are useful in the present invention. Furthermore, the spacing between adjacent panel spacer members 26, such as the horizontal distance between the ends 46, 226 or the vertical distance between the ends 300, 308 of panel spacer members (FIG. 2), will vary depending on factors including the thickness of the concrete being poured, the height of the concrete pour, the thickness of the composite foam insulating panels and the diameter of the locking caps. However, it is found as a part of the present invention that a spacing of adjacent spacer/locking cap assemblies 24 of approximately 6 inch to 24 inch centers, especially 16 inch centers, is useful in the present invention.

As indicated above, the thickness of the composite foam insulating panels 12-18 is also a factor that must be considered in designing the insulated concrete form 10 in accordance with the present invention and will vary depending on factors including the amount of insulation desired, the thickness of the concrete wall, the height of the concrete pour, the diameter of the locking caps 28, 30 and the distance between adjacent spacer/locking cap assemblies 24. There is no maximum thickness for the foam insulating panels that can be used in the present invention. The maximum thickness is only dictated by economics and ease of handing. However, it is found as a part of the present invention that thicknesses for the composite foam insulating panels 12, 14 of approximately 2 to approximately 8 inches, especially approximately 4 inches, is useful for the present invention. Remarkably, the use of the layers of reinforcing material 116, 20 permit the use of smaller locking caps 28, 30; thinner composite foam insulating panels 12, 14 and farther spacing between adjacent spacer/locking cap assemblies 24. It is believed that this results from the force applied to the composite foam insulating panels at the interface between the locking caps 28, 30 and the outer surface 112, 114, respectively, being distributed over a larger surface of the composite foam insulating panel 12, 14 through the layers of reinforcing material 116, 20. Without the layers of reinforcing material 116, 20, all of the outward force is focused on the portion of the locking caps 28, 30 that contacts the outer surfaces 112, 114 of the composite foam insulating panels 12, 14. However, the layers of reinforcing material 116, 20 increase the effective diameter of the locking caps 28, 30 and distributes the force over a larger surface area. The layers of reinforcing material 116, 20 also reduce the possibility of cracking or failure of the outer surfaces 112, 114 of the composite foam insulating panels at the interface with the locking caps 28, 30 and at positions intermediate adjacent locking caps.

It is a specific feature of the present invention that whalers 200 (also know as wales or walers) may be used in combination with the panel spacer members 26 to further reinforce the composite foam insulating panels 12, 14 and increase the pressure rating thereof; especially when wet, unhardened (i.e., plastic) concrete is poured into the concrete receiving space 106 and the hydrostatic pressure on the composite foam insulating panels is at a maximum. The whaler 200 comprises an elongate U-shaped channel made from a material having high flexural strength, such as steel, aluminum or composite plastic materials (FIGS. 14-17). The whaler 200 includes two parallel spaced side members 204, 206 and a connecting bottom member 208. The side members 204, 206 provide extra strength and resistance to flex of the bottom member 208. Formed in the bottom member 208 is a key-shaped opening or key slot 210; i.e., the lateral dimension at 212 is narrower than the lateral dimension at 214. The key slot 210 can be formed in the whaler 200 by stamping or any other suitable technique. The whaler 200 can be formed by extrusion, pultrusion, by roll forming or by any other suitable technique.

Figure 9:
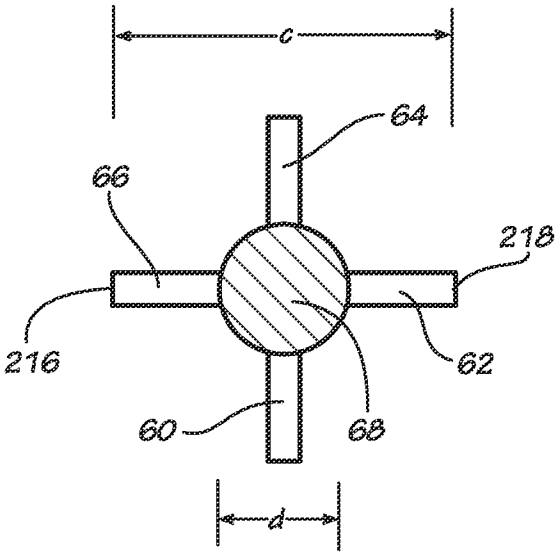
FIG. 9 is a cross-sectional view taken along the line 9-9 of the panel spacer member shown in FIG. 4.
Figure 10:
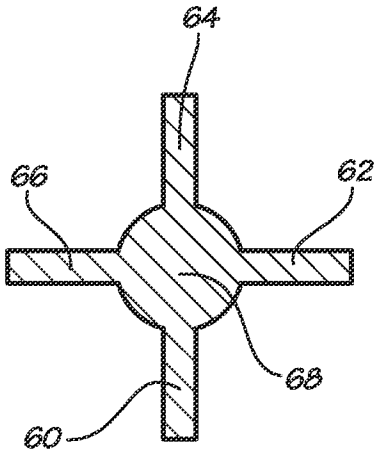
FIG. 10 is a cross-sectional view taken along the line 10-10 of the panel spacer member shown in FIG. 4.

The lateral dimension "A" of the opening 210 at 214 (the wider portion) is chosen so that it is larger than the effective diameter of the ends 44, 46 of the panel spacer member 26; i.e., the dimension "A" at 214 is greater than the dimension "C" (FIG. 9) from the ends 216, 218 of the opposite legs 66, 62, respectively, between the slot 70 and the end 44. The lateral dimension "B" of the opening 210 at 212 (the narrower portion) is chosen so that it is equal to or wider than the diameter "D" (FIG. 9) of the central round core 68 but narrower than the effective diameter of the ends 44, 46 of the panel spacer member 26; i.e., the dimension "B" at 212 is less than the dimension "C" from the ends 216, 218 of the opposite legs 62, 66, respectively, between the slot 70 and the end 44.

Figure 17:
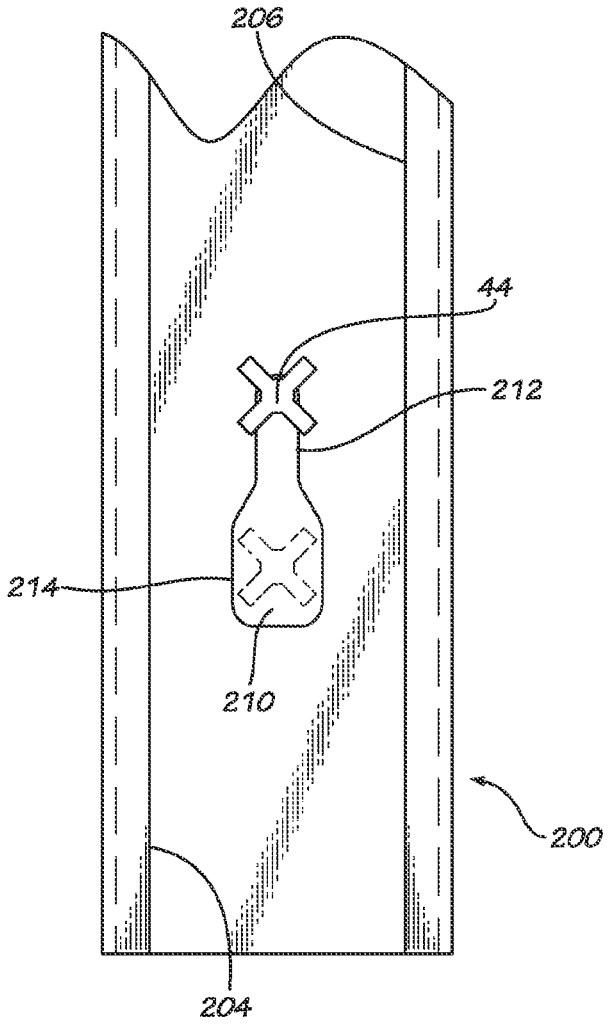
FIG. 17 is a partial detail top plan view of the whaler shown in FIG. 14 showing how the end of the spacer shown in FIG. 4 locks into the keyhole-shaped slot opening in the whaler.

Therefore, as shown in FIG. 17, the whaler 200 can be placed over the end 44 (shown in phantom) of the panel spacer member 26 such that the end of the panel spacer member fits through the wider portion 214 of the key slot 210. Then, the whaler 200 can be slid downwardly (FIG. 17) so that the end 44 of the panel spacer member 26 is positioned in the narrower portion 212 of the key slot 210 and the sides of the key slot fit in the slot 70 in the panel spacer member. When the end 44 of the panel spacer member 26 is in the narrower portion 212 of the key slot 210 (FIG. 17), the whaler 200 is locked in place and cannot be removed from the end of the panel spacer member (longitudinally with respect to the panel spacer member). A hole 222 is provided in the side wall 204 of the whaler 200 aligned with the approximate mid-point of the narrower portion 212 of key slot 210. A screw or pin (not shown) can then be screwed or inserted into the hole 222 so that the shaft of the screw or pin extends transversely across the width of the whaler 200 and across the narrow portion 212 of the key slot 210, thereby capturing the end 44 of the panel spacer member 26 in the narrow portion of the key slot. When the screw or pin (not shown) is positioned in the hole 222, as described above, the whaler 200 cannot be slid upwardly (FIG. 17), thereby locking the whaler in position.

The length of the whaler 200 will depend on the width of the foam insulating panels that are used. However, it is contemplated that the length of the whaler 200 can be at least as long as the width of one of the composite foam insulating panels 12, 14 and, preferable, the whaler has a length equal to the width of multiple foam insulating panels, such as the width of 2 to 5 foam insulating panels. Also the distance from the key slot 210 to the next adjacent key slot 224 (FIG. 14) is the same as the center-to-center distance from the end 46 of one panel spacer member 26 to the end 226 of the next horizontally adjacent panel spacer member (FIG. 2). Thus, each whaler 200 has a plurality of key slots, such as the key slots 210, 224, spaced along the length thereof and the number and spacing of the key slots corresponds to the number and spacing of the ends, such as the ends 46, 226, of the panel spacer members 26 used in the composite foam insulating panels 14, 18. To add flexibility, the whalers 200, 230-238 have key slots spaced one-half the distance between ends 46, 226. This allows the whalers 200-230-238 to accommodate a different spacing of panel spacer members 26. For example, as can be seen in FIG. 2, the ends 300, 302 of the panel spacer members fit in every other key slot in the whaler 230. Also, the panel spacer members 26 in the presently disclosed embodiment are spaced on 16 inch centers in four foot wide panels 14, 18. However, the whalers 200, 230-238 can also be used with panel spacer members 26 spaced every 8 inches or combinations of 8 inches and 16 inches. For example, at a corner it might be desirable to space the panel spacer members 8 inches apart, but the rest of the wall would only require a spacing of 16 inches. The whalers 200, 230-238 can accommodate these types of spacings.

It is also specifically contemplated that the whaler 200 should span the joints between horizontally adjacent foam insulating panels, such as the joint 228. For example, FIG. 2 shows an interior composite foam insulating panel 14 and a horizontally adjacent composite foam insulating panel 18. Each composite foam insulating panel 14, 18 includes a plurality of spaced panel spacer members aligned in vertical columns and horizontal rows. For example, the interior composite foam insulating panel 14 includes a horizontal row of panel spacer members 300, 302 (only the plus-shaped "+" ends of which is visible); the interior composite foam insulating panel 18 includes a horizontal row of panel spacer members 304, 306 (only the plus-shaped "+" ends of which is visible). The composite foam insulating panel 12 also includes an adjacent horizontal row of panel spacer members 308, 310 (only the plus-shaped "+" ends of which is visible); the composite foam insulating panel 18 includes an adjacent horizontal row of panel spacer members 312, 314 (only the plus-shaped "+" ends of which is visible). The whaler 230 is interlocked with the ends 300-302 of the panel spacer members of the composite foam insulating panel 14 and with the ends 304-306 of the panel spacer members of the composite foam insulating panel 18. A second whaler 232 is interlocked with the ends 308-310 of the panel spacer members of the composite foam insulating panel 14 and with the ends 312-314 of the panel spacer members of the composite foam insulating panel 18. Thus, the whalers 230, 232 span the vertical joint 228 formed between the composite foam insulating panels 12, 18.

As a part of the present invention it has been found that the use of horizontal whalers attached to the portion of the panel spacer members 26 that extend beyond the outer surface 112, 114 of the composite foam insulating panels 12, 14 provides superior strength to the insulated concrete form 10 of the present invention. Therefore, when the horizontal whalers are used, as described above, the locking caps and the connection of the locking caps to the panel spacer members does not have to be strong enough to withstand the hydrostatic pressure of the concrete when it is poured into the concrete receiving space 106; that pressure is born instead by the panel spacer members and the horizontal whalers. As a result, the diameter of the locking caps only has to be sufficient to retain the foam insulating panels in their spaced configuration during manufacture, transport and erection at a work site. After the whalers are installed on the panel spacer members, the foam insulating panels can withstand many times more hydrostatic pressure than the foam insulating panels could without the whalers. Therefore, when horizontal whalers are used, not only may the diameter of the locking caps be reduced, but the spacing of adjacent panel spacer members can be increased over systems that do not employ the whalers, as described herein. Thus, in an insulated concrete form system in accordance with the present invention that does not use the whalers, adjacent panel spacer members may be spaced on 6 to 8 inch centers. However, when the whalers are used in accordance with the present invention, the panel spacer members can be spaced on 12 to 24 inch centers, such as standard 16 inch spacing for vertical or horizontal studs used in conventional construction. By increasing the spacing of the panel spacer members, the total number of panel spacer members and locking caps for each foam insulating panel is reduced, which thereby reduces the cost of production.

By placing the whalers so that they span the joints between adjacent composite foam insulating panels, such as shown in FIGS. 1 and 2, the whalers provide additional strength to the weakest point in the insulated concrete form system; i.e., the vertical joints between adjacent panels, such as the joint 228. The whalers therefore prevent, or significantly reduce, bulging of the composite foam insulating panels at vertical joints between adjacent panel members under the hydrostatic pressure of the concrete. Therefore, with the concrete forms of the present invention there is no significant limitation to the height of each lift of concrete that is placed in the concrete receiving space 106. Optionally, a strip of reinforcing material, such as the layer of reinforcing material 20, can be used to bridge the vertical joints between adjacent composite foam insulating panels by adhesively applying to adjacent panels in the field after the forms have been erected and before the whalers are installed. Also, the liquid applied weather membrane can optionally be applied to the vertical joints between adjacent composite foam insulating panels after the forms have been erected and before the whalers are installed, thereby providing a continuous water-resistant weather membrane from one panel to the next.

It is preferred that whalers are used on both the interior composite foam insulating panel 14 and the exterior composite foam insulating panel 12. FIGS. 2, 18, 19, 20, 21 and 22 show whalers 200, 230, 232, 234, 236, 238 on the interior composite foam insulating panel 14 and whalers 240, 242, 246, 248, 250 on the exterior composite foam insulating panel 12. For single story or low-rise construction it is desirable to use strongbacks to plumb the insulated concrete forms 10 to vertical and to further reinforce the composite foam insulating panels. FIGS. 2, 19, 20, 21 and 22 show the use of strongbacks with the insulated concrete form 10 reinforced with U-shaped whalers on both the interior and exterior composite foam insulating panels. Strongbacks are well known in the art and are typically U-shaped or I-shaped heavy gauge metal beams that are erected vertically adjacent conventional metal concrete forms to help true and align the forms to vertical. Each strongback 318, 320 is an elongate metal reinforcing member. The strongbacks 318, 320 can be any typical design but are usually an extruded U-shaped or I-shaped cross-sectional shape made of heavy gauge steel or aluminum.

Figure 19:
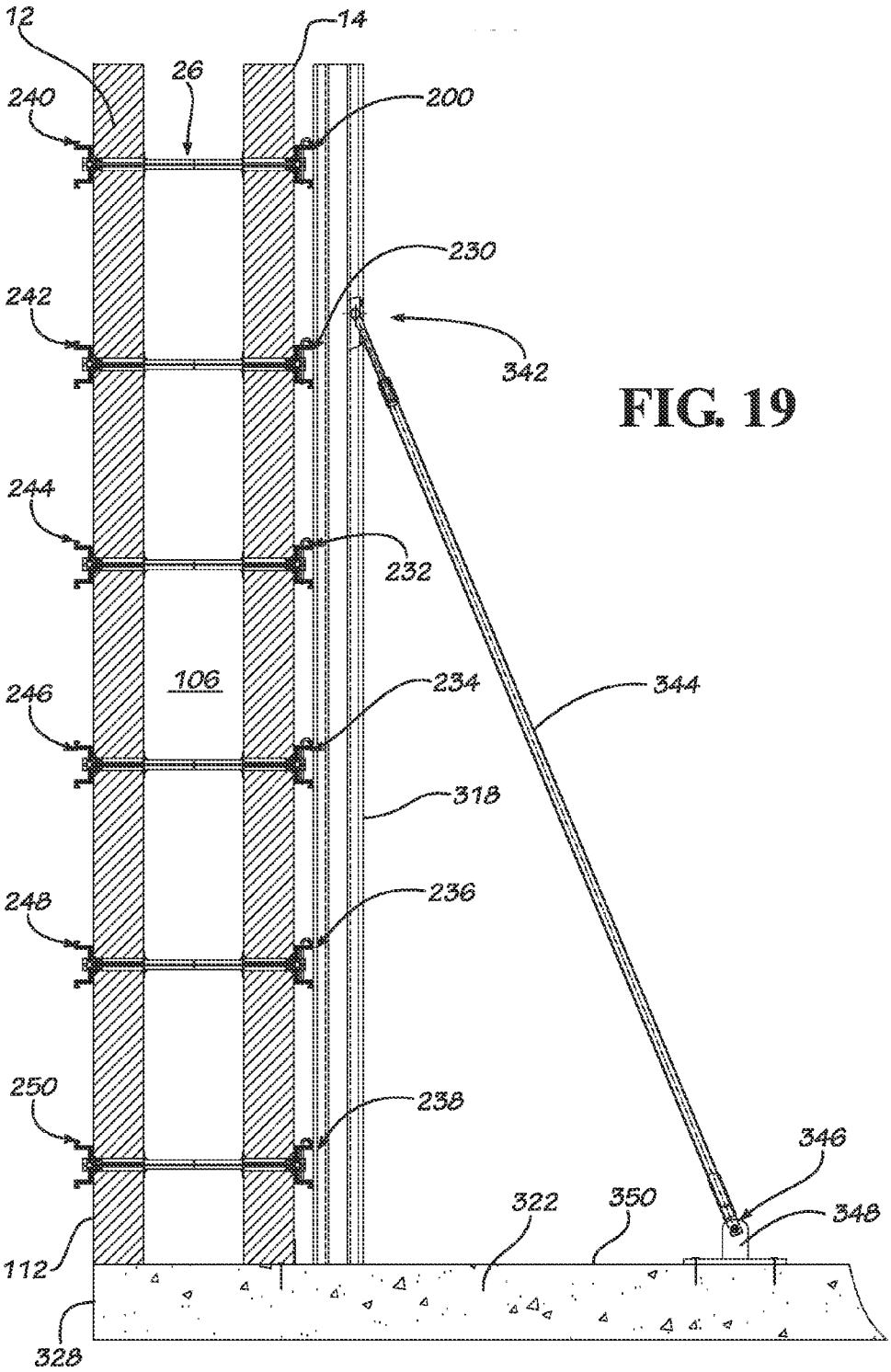
FIG. 19 is a cross-sectional side view of an alternate disclosed embodiment of an insulated concrete form in accordance with the present invention.

FIGS. 19 and 20 show the insulated concrete form 10 installed on a concrete slab 322. Before the insulated concrete form 10 is set in place on the concrete slab 322, an elongate L-shaped angle 324 (FIG. 20) is anchored to the concrete slab 322, such as by shooting a nail 326 through the L-shaped bracket into the concrete slab. The L-shaped angle 324 extends the full width of the interior composite foam insulating panel 14; e.g., 4 feet wide or more to span multiple composite foam insulated panels. The L-shaped angle 324 is positioned on the concrete slab 322 so that when the outer surface 114 (or the layer of reinforcing material 20, if present) of the interior composite foam insulating panel 14 is placed against the L-shaped angle, the outer surface 116 of the exterior composite foam insulating panel 12 is flush with an end 328 of the concrete slab 322. It should be noted that the layer of reinforcing material 116 on the outer surface 112 of the exterior composite foam insulating panel 12 extends beyond a bottom edge 330 of the panel and can be attached to the end 328 of the concrete slab 322 with an adhesive to help maintain the exterior composite foam insulating panel in alignment with the end of the concrete slab and to prevent lift up of the exterior composite foam insulating panel, thereby preventing a blowout of concrete under the bottom edge 330 of the exterior composite foam insulating panel when concrete is placed in the concrete receiving space 106.

After the insulated concrete form 10 has been installed on the concrete slab 322, as shown in FIG. 19, the strongback 318 is placed on the concrete slab adjacent the bottom of the insulated concrete form and the whalers 200, 230-238 are attached to the strongback with clips (not shown) in a manner well known in the art. One end 342 of a brace/turnbuckle 344 is pivotable attached to the strongback 318 adjacent the top of the insulated concrete form 10. The other end 346 of the brace/turnbuckle 344 is pivotably attached to a bracket 348 that is anchored to the concrete slab 322, such as by screws or by shooting a nail through the bracket into the concrete slab. Rotation of the brace/turnbuckle 344 lengthens or shortens the brace/turnbuckle, thereby enabling fine adjustment of the strongback 318 to plumb or true vertical. The strongbacks are placed at intervals along the horizontal width of adjacent foam insulating panels, such as the composite foam insulating panels 14, 18. By attaching the horizontal whalers, such as the whalers 200, 230-238, to the vertical strongbacks, such as the strongback 344, the whalers will all be aligned vertically as well. Since the whalers, such as the whalers 200, 230-238, are attached to the panel spacer members, such as the panel spacer member 26, the panel spacer members will be aligned vertically, also. Since the panel spacer members, such as the panel spacer member 26, are all of the exact same dimensions; i.e., the distance between the flanges 48, 50 and the distance from the flanges to the slots 70, 70' are identical for all panel spacer members, and since the panel spacer members are attached to the composite foam insulating panels, such as 12, 14, 16, 18, the composite foam insulating panels will be vertically aligned, as well, thus making a perfectly uniform, straight, vertical concrete wall forming system.

Use of the concrete insulated form 10 in accordance with various disclosed embodiments of the present invention will now be considered. In order to form an exterior wall of a building, or other structure, multiple composite foam insulating panels must be positioned adjacent like panels and connected together to form an insulated concrete form of a desired shape, length and/or height. FIG. 1 shows a pair of composite foam insulating panels 12, 14 joined together by a plurality of spacer/locking cap assemblies 24. It is contemplated that the composite foam insulating panels 12, 14 and the spacer/locking cap assemblies 24 would be preassembled, as described above, at a manufacturing facility and then transported to a building site for assembly into a desired wall configuration. FIGS. 1 and 2 show a pair of rectangular interior composite foam insulating panels 14, 18 joined side-by-side at their longitudinal edges. Each of the foam insulation panels 14, 18 has the same shape configuration. The panels 14, 18 preferably have a shiplap edge, such as shown in applicant's U.S. Pat. No. 8,555,583, which is incorporated herein by reference. Thus, when the panels 14, 18 are placed side-by-side, a Z-shaped joint 228 is formed therebetween (FIG. 1). Before the composite foam insulating panels 14, 18 (or 12, 16) are joined together, a water-proof adhesive is applied to the longitudinal edges thereof. Such adhesive can be applied by any conventional means, such as by brushing, rolling, spraying, spreading, and the like. When the composite foam insulating panels 14, 18 are joined at their longitudinal edges, as shown in FIGS. 1 and 2, the adhesive fills the joints formed there between, such as the joint 228, and renders the joints water-proof or substantially water-proof. Any water-proof adhesive suitable for adhering polystyrene to polystyrene, or the specific type of foam used for the foam insulating panels, can be used. One such adhesive is a sprayable polyurethane adhesive that is commercially available under the designation Great Stuff available from Dow Chemicals, Midland, Mich.

As stated above, the composite foam insulating panels, such as the panels 12, 14, 16, 18 are designed to extend from the floor to the height of the ceiling, or next floor slab, in a single sheet of expanded polystyrene. FIG. 19 shows the use of a disclosed embodiment of the insulated concrete forms of the present invention in the construction of a single-story building. The building has a concrete slab 322, which is the floor of the first or ground floor story of the building. The concrete slab 322 has an upper horizontal surface 350 and an exterior vertical end 328. Sitting on the upper surface 350 of the concrete slab 342 is an insulated concrete form 10 in accordance with a disclosed embodiment of the present invention. The insulated concrete form 10 comprises the exterior composite foam insulating panel 12 and the interior composite foam insulating panel 14. The exterior composite foam insulating panel 12 sits on the upper surface 350 of the concrete slab 322 adjacent the exterior vertical end 328 thereof such that the outer surface 116 is in vertical alignment with the exterior vertical end of the concrete slab. Spaced from the exterior composite foam insulating panel 12 is the interior composite foam insulating panel 14. The interior composite foam insulating panel 14 sits on the upper surface 350 of the concrete slab 322, as shown in FIG. 19. A plurality of panel spacer members, such as the panel spacer member 26, and locking caps, such as the locking caps 28, 20 30, maintain the composite foam insulating panels 12, 14 in their spaced relationship in the same manner as shown in FIGS. 1 and 19.

The composite foam insulating panels 12, 14 and the concrete slab 322 define a concrete receiving space 106 for receiving unhardened (i.e., plastic) concrete. In order to allow plastic concrete in the concrete receiving space 106 to achieve its maximum hardness, it is desirable to retain as much of the water portion of the plastic concrete in the concrete receiving space for as long as possible. The interface between the upper surface 350 of the concrete slab 322 and the composite foam insulating panels 12, 14 form joints through which water from unhardened concrete in the concrete receiving space 106 can leak out of the concrete receiving space. Therefore, it is specifically contemplated that the joints between the upper surface 350 of the concrete slab 322 and the composite foam insulating panels 12, 14 should be made water-proof, or substantially water-proof. Accordingly, before the composite foam insulating panels 12, 14 are placed on the upper surface 350 of the concrete slab 322, a water-proof adhesive is applied to the lower transverse edges of the composite foam insulating panels. Such adhesive can be applied by any conventional means, such as by brushing, rolling, spraying, spreading, and the like. Therefore, when the composite foam insulating panel 12, 14 are placed on the upper surface 350 of the concrete slab 322, the adhesive on the lower transverse edges of the composite foam insulating panels seals the joints formed between the composite foam insulating panels and the concrete slab thereby rendering the joints water-proof, or substantially water-proof. The adhesive also adheres the composite foam insulating panel 12, 14 to the concrete slab 322. Any water-proof adhesive that is suitable for adhering polystyrene to concrete can be used. A useful adhesive is Senergy EPS insulation adhesive base coat by BASF Wall Systems. For adhering the composite foam insulating panels 12, 14 to the concrete slab 322, it is desirable to add Portland cement to the Senergy EPS insulation adhesive base coat in the ratio of approximately 1:1.

In order to further secure the composite foam insulating panel 12 to the concrete slab 322 and to prevent uplift by the force of the fluid plastic concrete, the layer of reinforcing material 116 on the outer surface 112 of the exterior composite foam insulating panel 12 is adhered to the concrete slab. Specifically, the portion of the layer of reinforcing material 116 extending beyond to bottom 330 of the exterior composite foam insulating panel 12 is adhered to the vertical end 328 of the concrete slab 322 (FIG. 20). An adhesive is applied to the exterior vertical end 328 of the concrete slab 322 and to the portion of the layer of reinforcing material 116 extending beyond bottom 330 of the exterior composite foam insulating panel 12. The portion of the layer of reinforcing material 116 extending beyond to bottom 330 of the exterior composite foam insulating panel 12 is then brought into contact with the exterior vertical end 328 of the concrete slab 322. Any adhesive that is suitable for adhering fiberglass to concrete can be used. A useful adhesive is Senergy EPS insulation adhesive base coat by BASF Wall Systems. For adhering the layer of reinforcing material 116 to the concrete slab 322, it is desirable to add Portland cement to the Senergy EPS insulation adhesive base coat in the ratio of approximately 1:1. Such adhesive can be applied by any conventional means, such as by spreading, and the like.

Additional exterior and interior composite foam insulating panel members, such as the composite foam insulating panel 16, 18 (FIG. 1), are positioned adjacent the composite foam insulating panel 12, 14 so as to form a concrete form of a desired length. The exterior composite foam insulating panel 16 and its corresponding interior composite foam insulating panel 18 are adhered at their adjacent longitudinal edges to the composite foam insulating panels 12, 14, respectively, and are adhered at their lower transverse edges to the upper surface 350 of the concrete slab 322 in the manner previously described.

Whalers, such as the whalers 200, 230-238, are attached to the panel spacer members, such as by inserting the ends of the panel spacer members protruding from the outer surface 114 of the panels 12, 18, such as the ends 300, 302, into the wider portion 214 of the key slots 210, 224 and sliding the whaler such that the slots 70 of the panel spacer members are received in the narrower portion 212 of the key slots, thereby locking the whaler to the panel spacer member in the manner described above. A pin can then be placed into the hole 222 to prevent the whaler from moving to a position where the ends 46 of the panel spacer members are in the wider portion 214 of the key slots 210. As described above, the whalers, such as the whalers 200, 230-238, span the joint 228 between the adjacent panels 14, 18. It is desirable that the whaler be attached to at least one, and preferably all, of the panel spacer members in a horizontal row of one composite foam insulating panel and at least one, and preferably more, of the panel spacer members in the corresponding row of the adjacent composite foam insulating panel. In FIG. 2, the whaler 230 is shown attached to the panel spacer members 300-302 of the panel 14 and to the panel spacer members 304-306 of the adjacent panel 18.

After the horizontal whalers are secured to all of the panel spacer members of the interior foam insulating panels, such as the composite foam insulating panels 14, 18, identical horizontal whalers, such as the whalers 240-248, are secured to the ends of all of the panel spacer members of the exterior foam insulating panels, such as composite foam insulating panels 12, 16, in the same manner as described above for the interior composite foam insulating panels 14, 18. FIG. 19 shows whalers installed on both the interior and the exterior composite foam insulating panels 12, 14 in accordance with the present invention.

After the whalers are installed on the interior and exterior composite foam insulating panels, the strongbacks, such as the strongbacks 318, 320, are erected adjacent the interior composite foam insulating panels 14, 18. The strongbacks, such as the strongbacks 318, 320, are attached to the whalers, such as the whalers 200, 230-238, by clips (not shown). The end 342 of the brace/turnbuckle 344 is attached to the strongback 342 and the other end 346 is attached to the bracket 348, which is anchored to the concrete slab 322. The brace/turnbuckle 344 is adjusted so that the strongback 318 is perfectly vertical. Multiple additional strongbacks (not shown) are secured to the whalers on the interior composite foam insulating panels in the same manner as described above. The strongbacks 318, 320 are spaced horizontally from each other at various intervals along the width of the insulated concrete forms of the present invention depending on the height and thickness of the concrete wall being constructed. However, strongbacks can be used with the present invention at intervals of approximately 4 feet to 8 feet; preferably, approximately 6 feet.

The insulated concrete forms 10 are then ready to be filled with concrete. The composite foam insulating panels 12-18 are selected to be of a thickness sufficiently strong to bear the weight of the plastic concrete that they will contain. Portions of concrete mix are added to the concrete receiving space 106 of the insulated concrete forms 10 until the concrete receiving space is filled from the horizontal surface 350 of the concrete slab 322 to the top of the insulated concrete forms. Furthermore, since the concrete receiving space 106 is water tight or substantially water tight; i.e., all possible joints and holes have been sealed such that they are water proof or substantially water-proof, the water portion of the plastic concrete mix is retained within the concrete receiving space, and, therefore, retained in the concrete mix. By retaining the water in the concrete mix in the concrete receiving space 106 and since that space is insulated by the composite foam insulating panels 12-18, the heat of hydration is retained within the insulated concrete form such that the concrete mix will achieve its maximum potential hardness, thereby producing a stronger concrete wall. In addition, the absence of cold joints in the concrete wall also produces a stronger concrete wall, or other concrete structure.

Surprisingly, it has been found as a part of the present invention that when the whalers and strongbacks are used in conjunction with the composite foam insulating panels, as described above, there is essentially no limitation to the height of each lift of concrete that can be added to the concrete receiving space 106. Also, when the whalers and strongbacks are used in accordance with the present invention, the thickness of the composite foam insulating panels can be reduced because the whalers and strongbacks provide additional strength to the concrete forms. Building concrete walls, columns, piers and other elevated concrete structures using the insulated concrete forms of the present invention has an additional advantage in that it's use will not be as foreign to persons skilled in the art compared to the modular insulated concrete forms of the prior art. The insulated concrete forms of the present invention can do everything that conventional steel and plywood forms of the prior art can do, and they are erected in much the same way and will have similar pressure ratings. Therefore, the amount of training necessary to design and build elevated concrete structures using the insulated concrete forms of the present invention is less that that required for the modular insulated concrete forms of the prior art.

After the concrete mix in the concrete receiving space 106 has hardened sufficiently, the strongbacks and the whalers can be removed from the insulated concrete forms 10. The strongback 318 is removed by detaching the clips (not shown) that attach the strongback to all of the whalers, such as the whalers 200, 230-238, on the interior composite foam insulating panels 14, 18. Then, the screws (not shown) anchoring the bracket 348 to the concrete slab 322 are removed. All of the whalers, such as the whalers 200, 230-238 and 240-250, are then removed from both the interior and the exterior composite foam insulating panels 12-18. The whalers, such as the whalers 200, 230-238, are removed from the panel spacer members, such as the panel spacer member 26, by first removing the pin (not shown) from the hole 222, and, then sliding the whaler so that the ends 44, 46 of the panel spacer members are disposed in the wider portion 214 of the key slot 210. The whalers can then simply be pulled off of the panel spacer members and away from the composite foam insulating panels.

Figure 21:
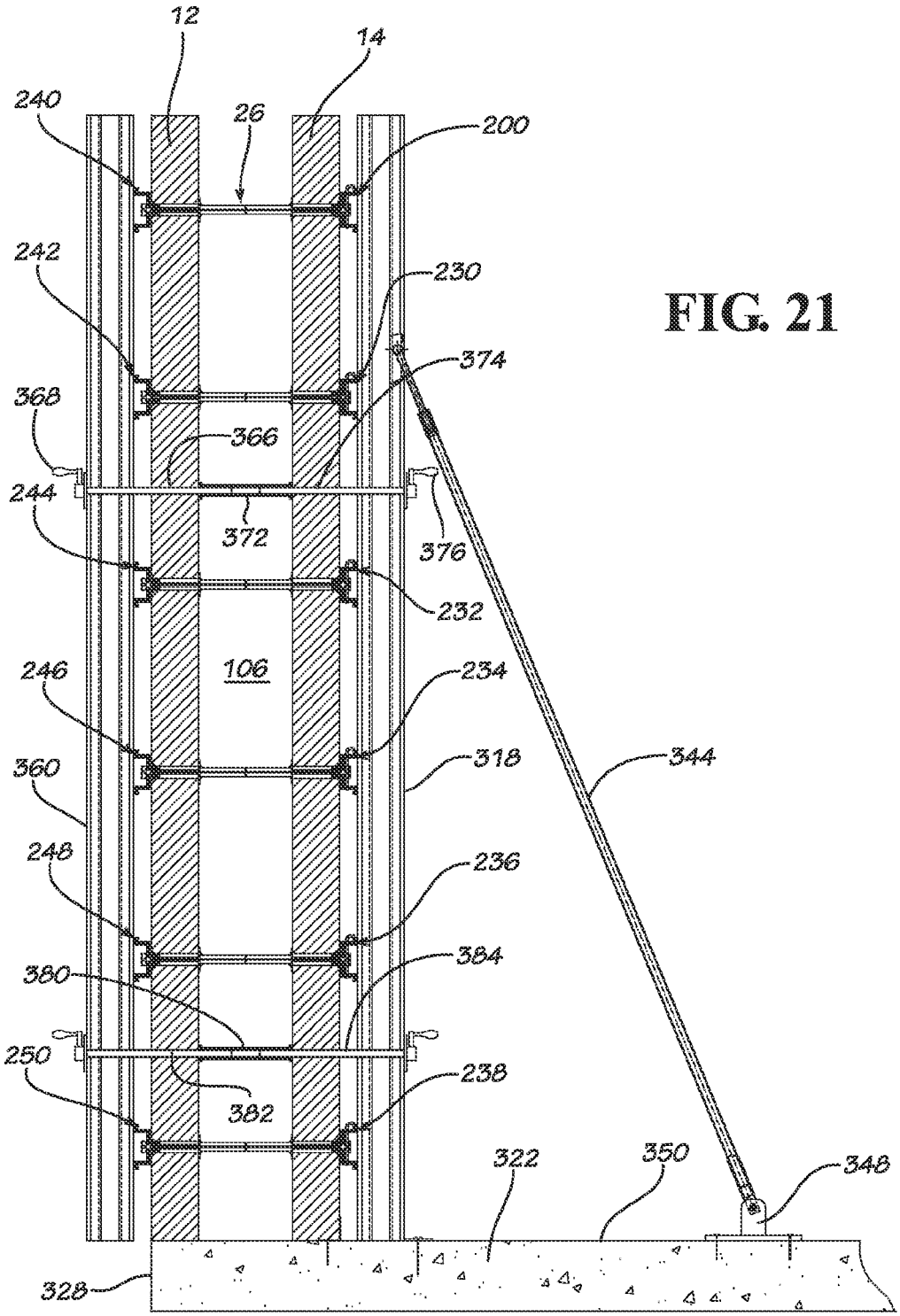
FIG. 21 is a cross-sectional side view of an alternate disclosed embodiment of an insulated concrete form in accordance with the present invention.
Figure 22:
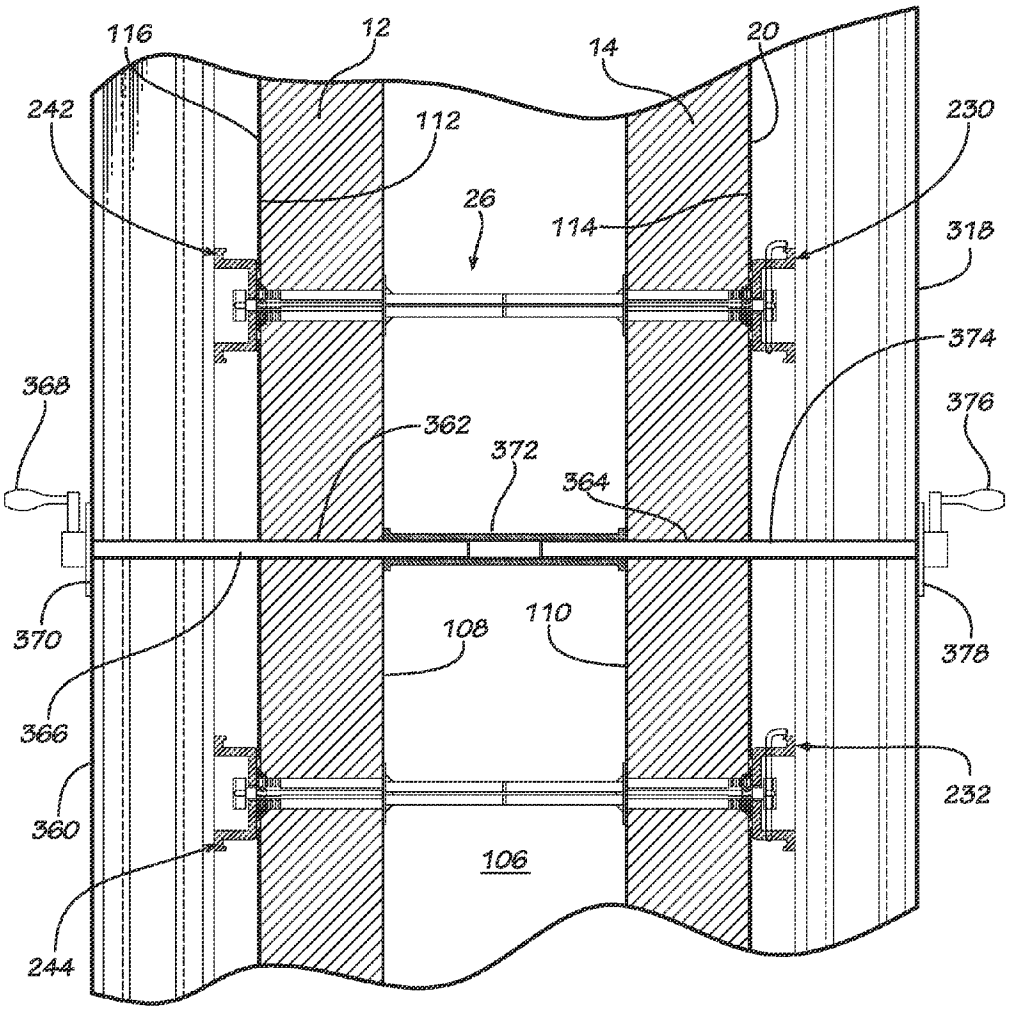
FIG. 22 is a partial detail view of the insulated concrete form shown in FIG. 21.

FIGS. 21 and 22 show an alternate disclosed embodiment of the insulated concrete form of the present invention. For multiple story buildings, it is necessary to provide extra reinforcement to the insulated concrete forms of the present invention. Such a reinforced insulated concrete form is shown in FIGS. 21 and 22. The insulated concrete form shown in FIGS. 21 and 22 is identical to the insulated concrete form shown in FIGS. 19 and 20, except the form shown in FIGS. 21 and 22 includes a strongback 360 on the exterior composite foam insulating panel 12. The strongback 360 is attached to each of the whalers 240-250, as described above. A first clamping device is formed in the upper portion of the insulated concrete form 10, as shown in FIG. 21. A first hole 362 is formed in the exterior composite foam insulating panel 12, such as by drilling. A second hole 364 in axial alignment with the first hole 362 is formed in the interior composite foam insulating panel 14. A first elongate rod 366 having male threads formed thereon, an eccentric hand crank 368 on one end thereof and a flange 370 adjacent the hand crank is insert through the hole 362. An elongate sleeve 372 of exactly the same length as the distance between the inner surface 108 of the exterior composite foam insulating panel 12 and the inner surface 110 of the interior composite foam insulating panel 14 (which is also equal to the distance between the composite foam insulating panel contacting portion 52 of the flange 48 and the composite foam insulating panel contacting portion 54 of the flange 50 of the panel spacer member 26) is disposed between composite foam insulating panels 12, 14 in axial alignment with the holes 362, 364. The sleeve 372 has female threads formed inside the sleeve such that the rod 366 can be screwed into the sleeve by turning the hand crack 368. A second elongate rod 374 having male threads formed thereon, an eccentric hand crank 376 on one end thereof and a flange 378 adjacent the hand crank is insert through the hole 364. The female threads in the sleeve 372 are such that the rod 374 can be screwed into the sleeve by turning the hand crank 376. Both rods 366, 374 are screwed into the sleeve 372 until the flanges 370, 378 are tight against the strongbacks 360, 318, respectively. Typically, the rods 366, 374 pass through a gap between two adjacent strongbacks (not shown) such that the flanges 370, 378 contact both adjacent strongbacks. An identical sleeve 380 and threaded rods 382, 384 clamping device is formed in the lower portion of the insulated concrete form 10, as shown in FIG. 21. By clamping the strongback 318 to the strongback 360, as described above, the strongback 360 will automatically be held parallel to the strongback 318. It will also provide extra reinforcement to both the exterior and interior composite foam insulating panels 12, 14 so that they can withstand higher pressure loads. After concrete in the concrete receiving space 106 hardens sufficiently, the rods 366, 374 are unscrewed from the sleeve 372, 380 and removed from the holes 362, 364 in the composite foam insulating panels 12, 14. The sleeves 372, 380 remain embedded in the solidified concrete. The sleeves 372, 380 can then be used as anchors for attaching wall cladding or for attaching construction elevators or scaffolding thereto for high-rise construction.

Figure 23:
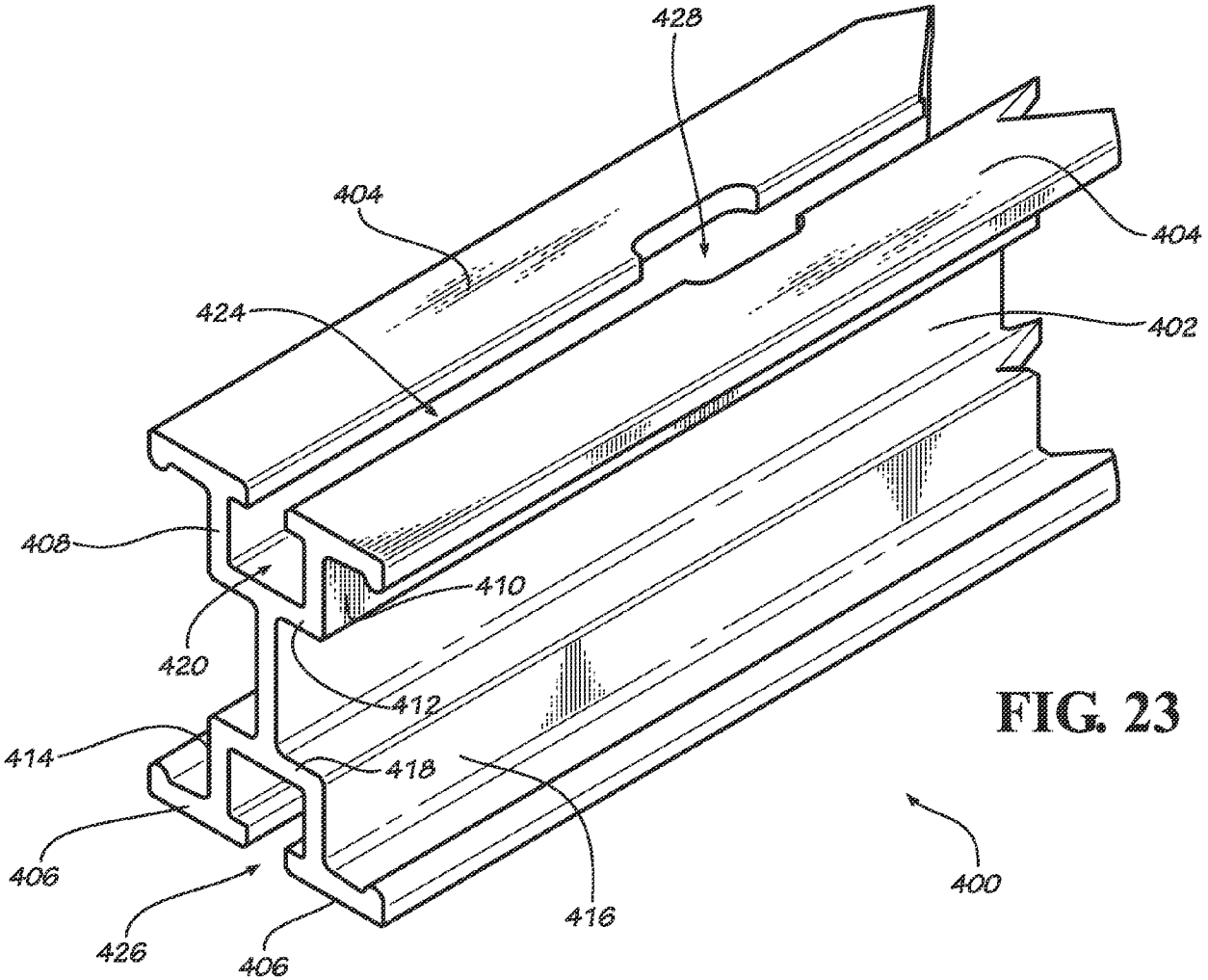
FIG. 23 is a partial perspective view of an alternate disclosed embodiment of an I-beam whaler made in accordance with the present invention.

FIGS. 23-28 show an alternate disclosed embodiment of a whaler in accordance with the present invention. FIG. 23 shows a whaler 400 in the form of an I-beam. I-beams useful in the present invention generally have the cross-sectional appearance of the letter "I", but can take on many different shapes, some simple and others more complex, yet still be an I-beam. Generally, the I-beam must have at least one central support member and at least one orthogonal flange member, but usually two, each at opposite ends of the central support member. The I-beam's shape adds rigidity, both longitudinally and laterally, which are desired properties for whalers used in the present invention.

In the embodiment disclosed herein, the whaler 400 has an elongate central support member 402 and two elongate flanges 404, 406 arranged orthogonally to the central support member and at opposite lateral ends thereof. The central support member 402, at one end thereof splits into two opposed legs 408, 410 and a base 412 and at the other end into two opposed legs 414, 416 and a base 418. The legs 408, 410 and the base 412 define a first channel 420; the legs 414, 416 and the base 418 define a second channel 422. Formed in the flanges 404, 406 are openings 424, 428, which lead to the channels 420, 422, respectively. The channels 420, 422 are of identical size and shape, although they could be made differently for different purposes. When use as a whaler, only one flange 404, 406 at a time is used to attach the whaler 400 to the panel spacer members 26, as described below. Thus, either the flange 404 or the flange 406 can be used for attachment to the panel spacer member 26, thus making the flanges 404, 406 both equally useful for the same purpose. However, it might be desirable to design one of the flanges 404, 406 differently from the other to perform a different task or serve a different purpose. Therefore, for purposes of the present invention, the I-beam whaler 400 only needs at least one of the flanges 404, 406. The I-beam whaler 400 is preferably made from metal, such as steel or aluminum, or thermosetting plastics, such as vinyl ester fiberglass, and can be made by extrusion, pultrusion or other suitable forming processes.

At longitudinal intervals along the length of the whaler 400 in the flanges 404, 406 are formed opening; such as in the flange 404 are formed openings 428, 430, and in the flange 406 is formed the opening 432. The lateral dimension "H" of the openings 428, 430 is greater than the lateral dimension "J" of the openings 424, 426. The opening 428 can be formed by drilling, routing or any other suitable means. The lateral dimension "H" of the opening 428 is greater than the effective diameter of the ends 44, 46 of the panel spacer member 26; i.e., the dimension "H" is greater than the dimension "C" from the ends 216, 218 of the opposite legs 44, 46, respectively, between the slot 70 and the end 44. The lateral dimension "J" of the opening 424 (which is the same as the opening 426) is equal to or wider than the diameter "D" of the central round core 68 but narrower than the effective diameter "C" of the ends 44, 46 of the panel spacer member 26; i.e., the dimension "J" is less than the dimension "C" but equal to or wider than the dimension "D".

Figure 24:
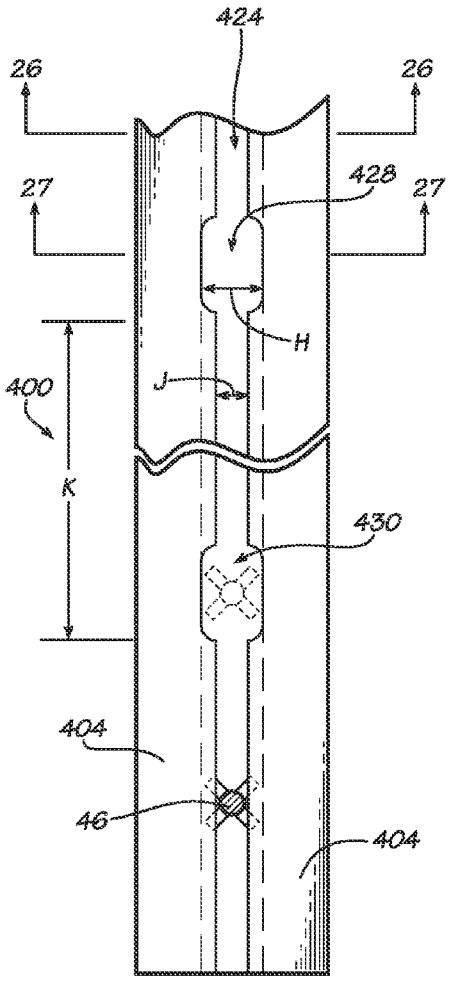
FIG. 24 is a bottom plan view of the I-beam whaler shown in FIG. 23 showing how the end of the panel spacer member shown in FIG. 4 locks into the channel in the whaler.
Figure 25:
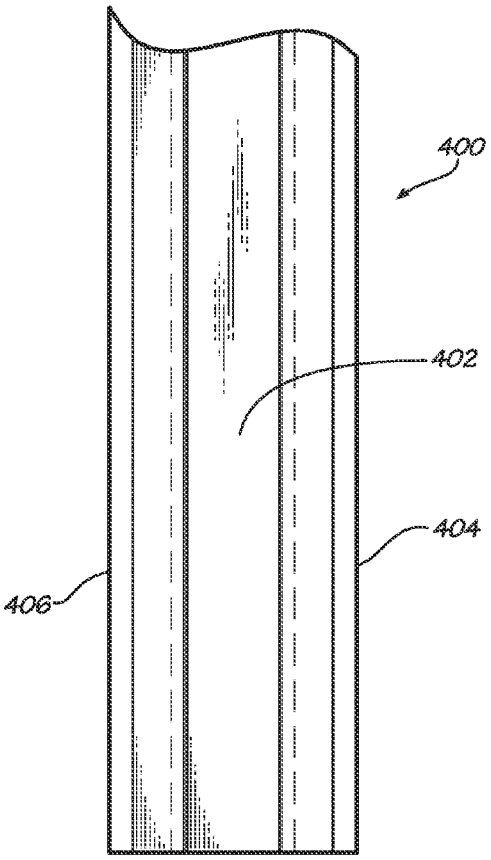
FIG. 25 is a side view of the I-beam whaler shown in FIG. 24.
Figure 27:
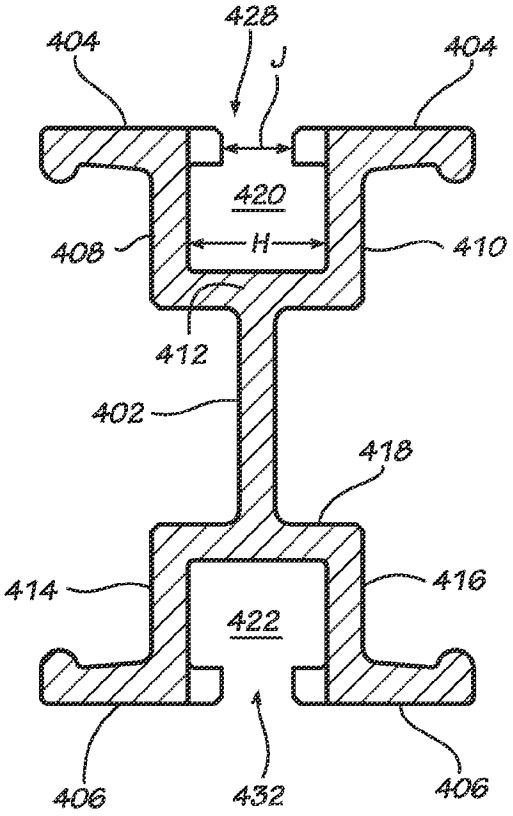
FIG. 27 is a cross-sectional view taken along the line 27-27 of the I-beam whaler shown in FIG. 24.
Figure 26:
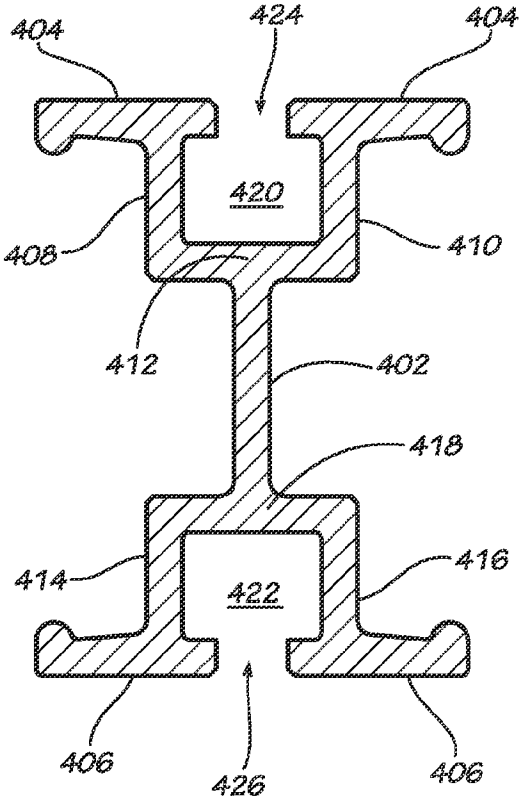
FIG. 26 is a cross-sectional view taken along the line 26-26 of the I-beam whaler shown in FIG. 24.

Therefore, as shown in FIG. 24, the I-beam whaler 400 can be placed over the end 46 of the panel spacer member 26 such that the end of the panel spacer member fits through the opening 430 and into the channel 420. Then, the I-beam whaler 400 can be slid to the left or the right (up or down in FIG. 24) so that the end 46 of the panel spacer member 26 is positioned in the channel 420 and the sides of the flange 404 that define the opening 424 fit in the slot 70 in the panel spacer member. When the end 46 of the panel spacer member 26 is in the channel 420 and is not in the opening 428 (FIG. 24), the I-beam whaler 400 is locked in place and cannot be removed from the channel in the I-beam whaler.

The length of the I-beam whaler 400 will depend on the width of the foam insulating panels that are used. However, it is contemplated that the length of the I-beam whaler 400 can be at least as long as the width of one of the foam insulating panels, and, preferable, the I-beam whaler has a length equal to the width of multiple foam insulating panels, such as the width of 2 to 5 foam insulating panels. Also the distance "K" from the opening 428 to the next adjacent opening 430 is the same as the center-to-center distance from one panel spacer member 26 to the next horizontally adjacent panel spacer member. Thus, each I-beam whaler 400 has a plurality of openings, such as the openings 428, 430, spaced along the length thereof and the number and spacing of such openings corresponds to the number and spacing of the panel spacer members 26 aligned horizontally in the composite foam insulating panels, such as the panels 14, 18, or alternately, one-half of the spacing between horizontally adjacent panel spacer members 26. For example, horizontally adjacent panel spacer members may be space on 16 inch centers and the I-beam whalers may have the openings 428, 430 spaced at either 16 inches or 8 inches. It is also specifically contemplated that the I-beam whaler 400 should span the joints between horizontally adjacent composite foam insulating panels, such as the joint 228 between the panels 14, 18, as shown in FIG. 1. The whaler 400 can be removed from the panel spacer member 26 by moving the whaler left or right until the end, such as the end 46, of the panel spacer member is positioned in one of the openings, such as the opening 428, 430. The I-beam whaler 400 can then be removed by pulling it away from the composite foam insulating panels, such as panels 14, 18.

Figure 29:
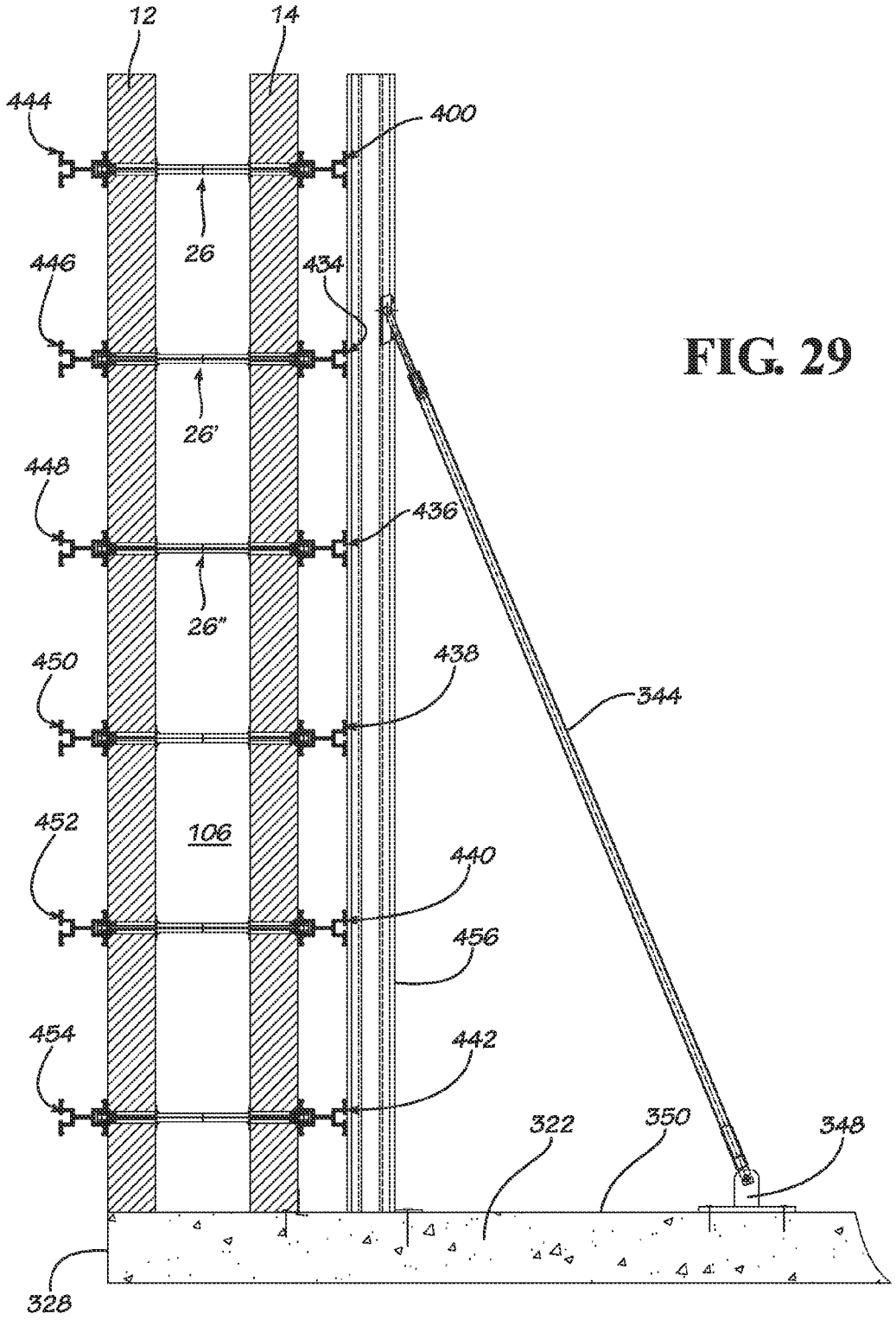
FIG. 29 is an alternate disclosed embodiment of an insulated concrete form in accordance with the present invention showing the I-beam whalers shown in FIG. 23 attached to the ends of the panel spacer members shown in FIG. 4 on both the interior and exterior foam insulating panels and a strongback attached to the I-beam whalers on the interior foam insulating panel.

The I-beam whaler 400 can also be used as an I-beam strongback. FIGS. 1 and 29 show the horizontal I-beam whaler 400 installed on a plurality of ends, such as the end 46, of a plurality of panel spacer members, such as the panel spacer members 26, 26', 26", installed between the exterior composite foam insulating panels 12, 16 and the interior composite foam insulating panels 14, 18. The whalers 434, 436, 438, 440, 442, which are identical to the whaler 400, are similarly installed on the interior composite foam insulating panels 14, 18 at spaced vertical intervals. Identical whalers 444, 446, 448, 450, 452, 454 are installed on a plurality of ends, such as the end 44, of a plurality of panel spacer members, such as the panel spacer members 26, 26', 26", at spaced vertical intervals on the exterior composite foam insulating panels 12, 16. I-beam whalers identical to the whaler 400 are then used as I-beam strongbacks 456, 458. The I-beam strongbacks 456, 458 are used in the identical manner as the strongbacks 318, 320 described above. The insulated concrete forming system in accordance with the present invention shown in FIG. 29 can be used for single story or low-rise construction.

Figure 30:
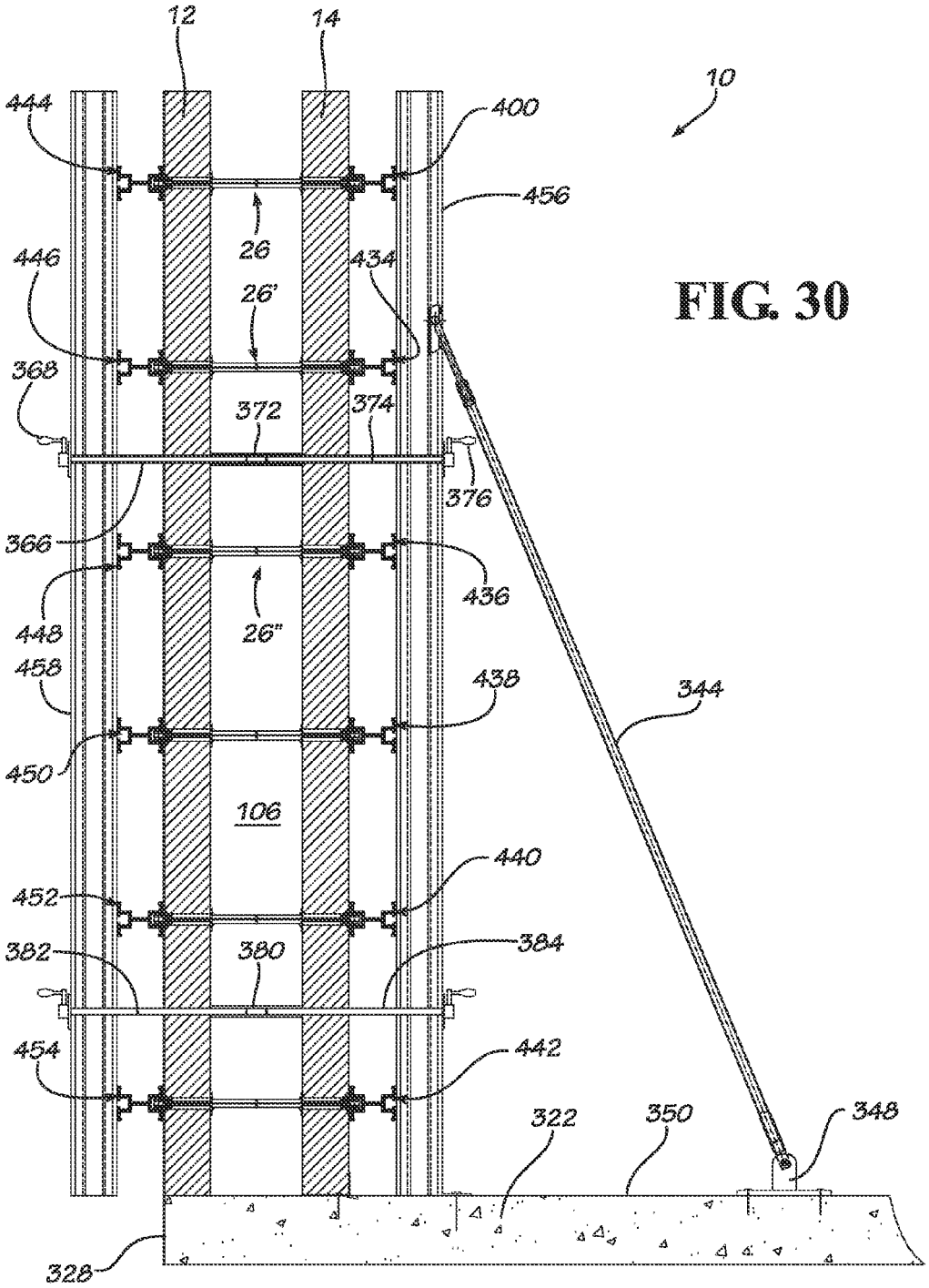
FIG. 30 is an alternate disclosed embodiment of an insulated concrete form in accordance with the present invention showing the I-beam whalers shown in FIG. 23 attached to the ends of the panel spacer members shown in FIG. 4 on both the interior and exterior foam insulating panels and strongbacks attached to the whalers on both the interior and exterior foam insulating panels.
Figure 31:
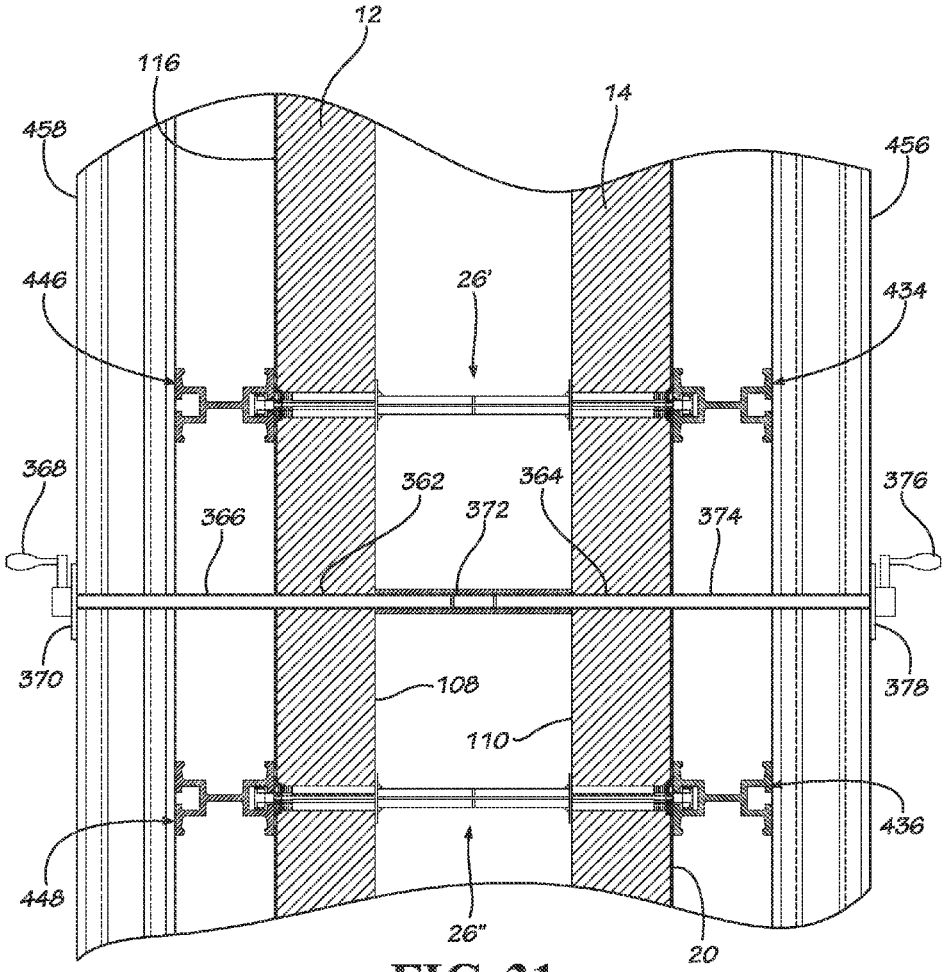
FIG. 31 is a partial detail view of the insulated concrete form shown in FIG. 30.

FIGS. 30 and 31 show an insulated concrete forming system in accordance with the present invention that can be used for high-rise construction or for forming columns and piers of larger dimensions. For multiple story buildings, columns and piers, it is necessary to provide extra reinforcement to the insulated concrete forms of the present invention. Such a reinforced insulated concrete form is shown in FIGS. 30 and 31. The insulated concrete form shown in FIGS. 30 and 31 is identical to the insulated concrete form shown in FIG. 29, except the form shown in FIGS. 30 and 31 includes an I-beam strongback 458 on the exterior composite foam insulating panel 12. The strongback 458 is attached to each of the whalers 444-454 with clips (not shown). A first clamping device is formed in the upper portion of the insulated concrete form 10, as shown in FIG. 21. A first hole 362 is formed in the exterior composite foam insulating panel 12, such as by drilling. A second hole 364 in axial alignment with the first hole 362 is formed in the interior composite foam insulating panel 14. A first elongate rod 366 having male threads formed thereon, an eccentric hand crank 368 on one end thereof and a flange 370 adjacent the hand crank is insert through the hole 362. A elongate sleeve 372 of exactly the same length as the distance between the inner surface 108 of the exterior composite foam insulating panel 12 and the inner surface 110 of the interior composite foam insulating panel 14 (which is also equal to the distance between the foam insulating panel contacting portion 52 of the flange 48 and the foam insulating panel contacting portion 54 of the flange 50 of the panel spacer member 26) is disposed between composite foam insulating panels 12, 14 in axial alignment with the holes 362, 364. The sleeve 372 has female threads formed inside the sleeve such that the rod 366 can be screwed into the sleeve. A second elongate rod 374 having male threads formed thereon, an eccentric hand crank 376 on one end thereof and a flange 378 adjacent the hand crank is insert through the hole 364. The female threads in the sleeve 372 are such that the rod 374 can be screwed into the sleeve. Both rods 366 and 374 are screwed into the sleeve 372 until the flanges 370, 378 are tight against the strongbacks 456, 458, respectively. Typically, the rods 366, 374 pass through a gap between two adjacent strongbacks (not shown) such that the flanges 370, 378 contact both adjacent strongbacks. An identical sleeve 380 and threaded rods 382, 384 clamping device is formed in the lower portion of the insulated concrete form 10, as shown in FIG. 21. By clamping the strongback 456 to the strongback 458, as described above, the strongback 458 will automatically be held parallel to the strongback 456. It will also provide extra reinforcement to both the exterior and interior composite foam insulating panels 12, 14 so that they can withstand higher pressure loads. After concrete in the concrete receiving space 106 hardens sufficiently, the rods 366, 374 are unscrewed from the sleeves 372, 380 and removed from the holes 362, 364 in the composite foam insulating panels 12, 14. The sleeves 372, 380 remain embedded in the solidified concrete. The sleeves 372, 380 can then be used as anchors for attaching wall cladding or for attaching construction elevators, guardrails, working platforms or scaffolding thereto for high-rise construction.

Figure 33:
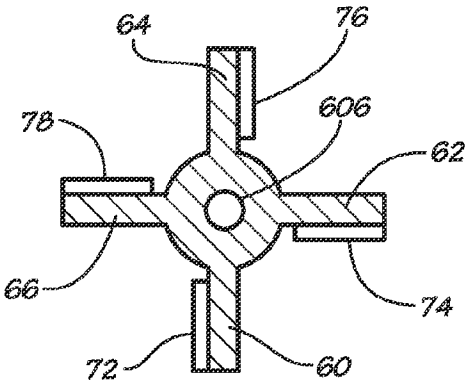
FIG. 33 is a cross-sectional view taken along the lines 33-33 of the panel spacer member shown in FIG. 32.
Figure 32:
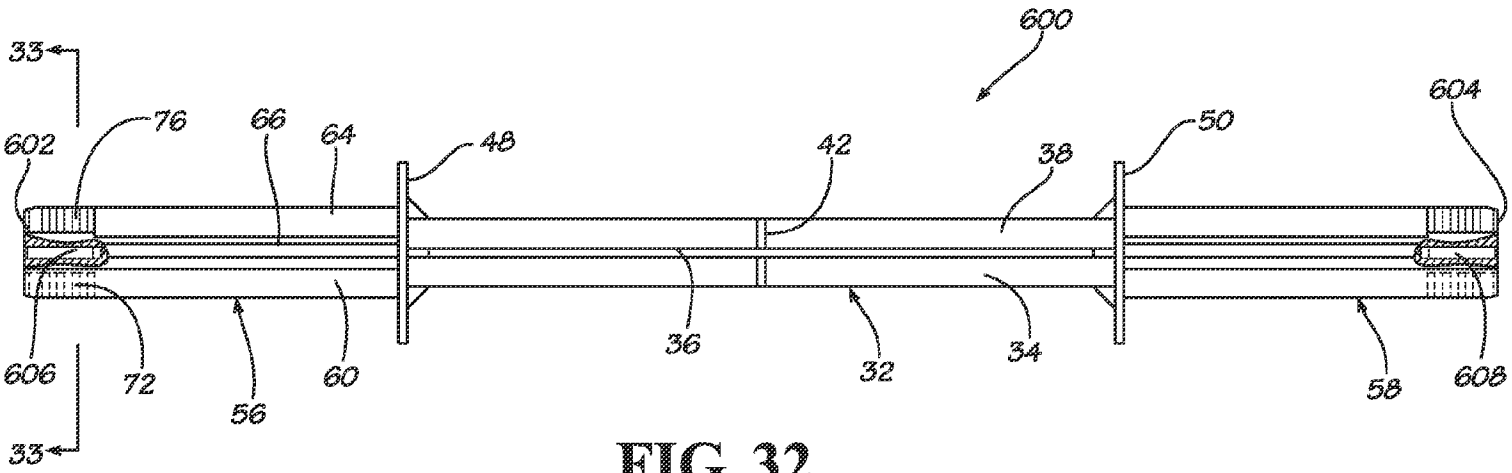
FIG. 32 is an alternate disclosed embodiment of a panel spacer member in accordance with the present invention.
Figure 34:
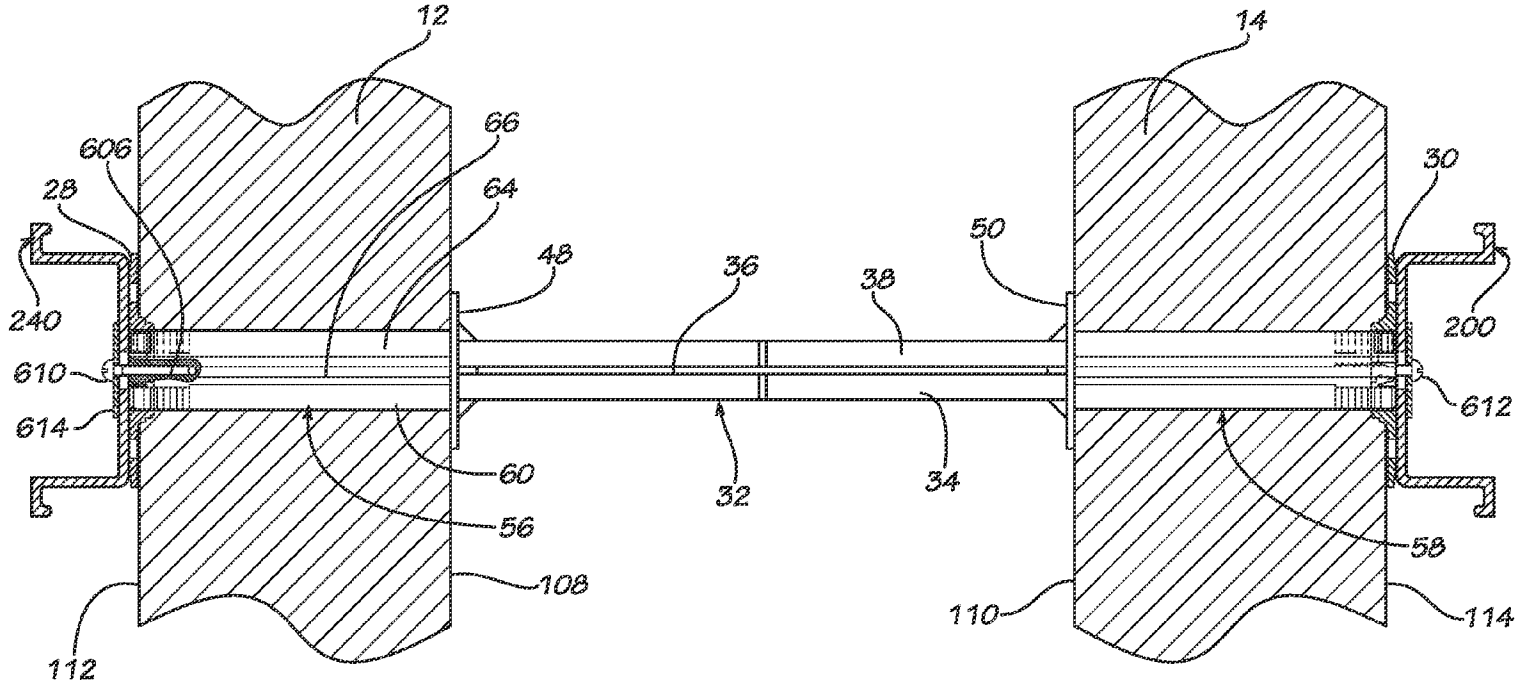
FIG. 34 is a partial cross-sectional side view of an alternate disclosed embodiment of an insulated concrete form in accordance with the present invention showing use of the panel spacer member shown in FIG. 32 with whalers as shown in FIG. 14 attached to each end of the panel spacer member.
Figure 38:
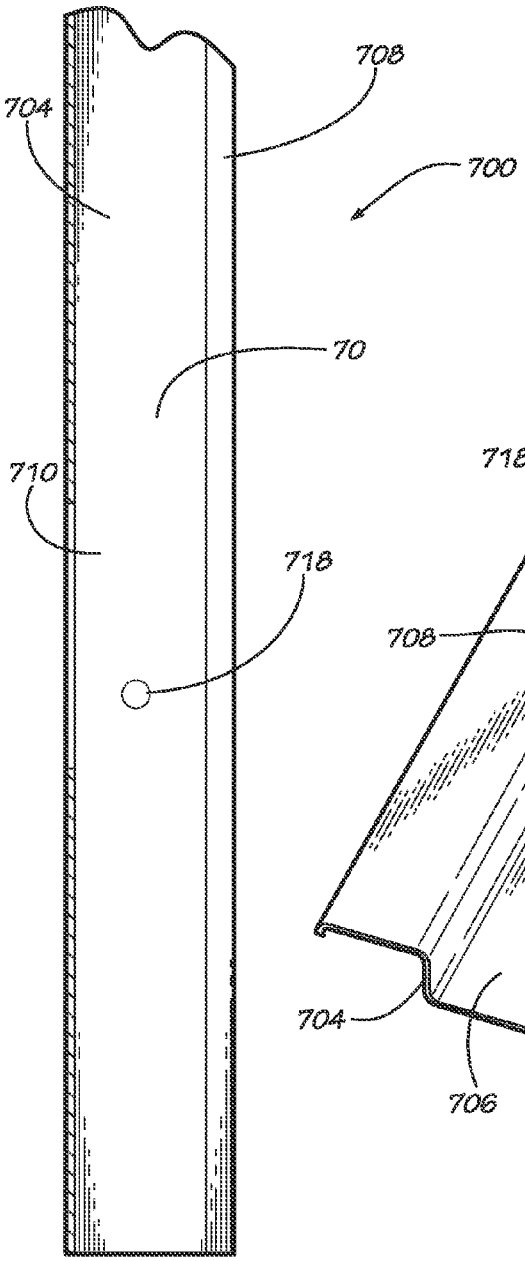
FIG. 38 is a partial side view of the vertical wall stud shown in FIG. 36.
Figure 35:
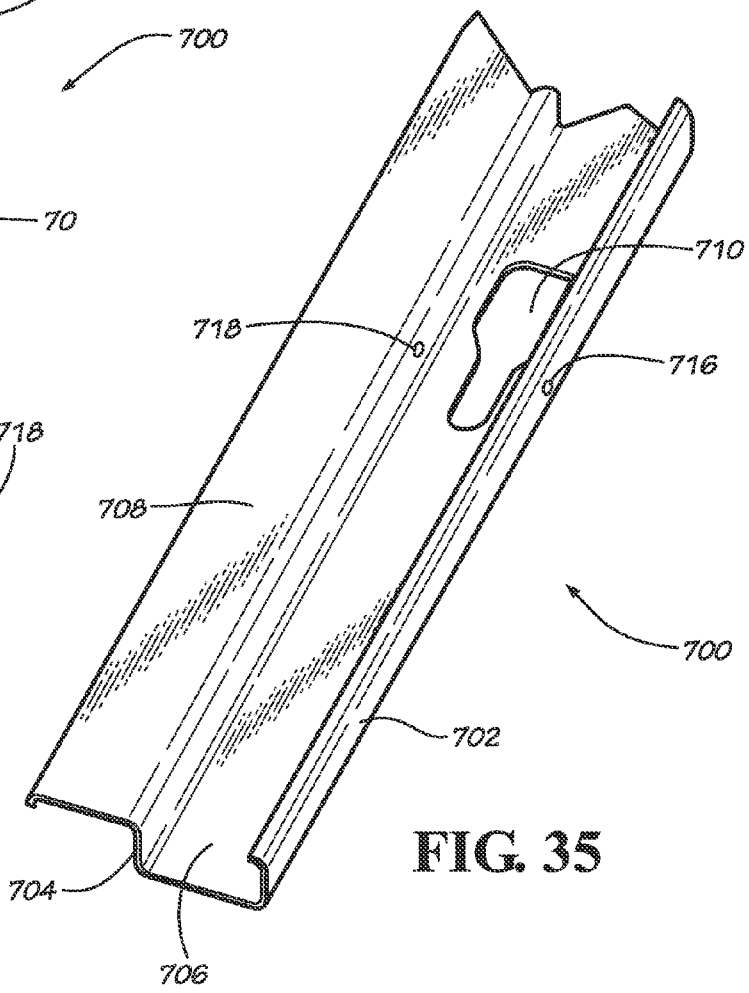
FIG. 35 is a partial perspective view of a disclosed embodiment of a vertical wall stud in accordance with the present invention.
Figure 36:
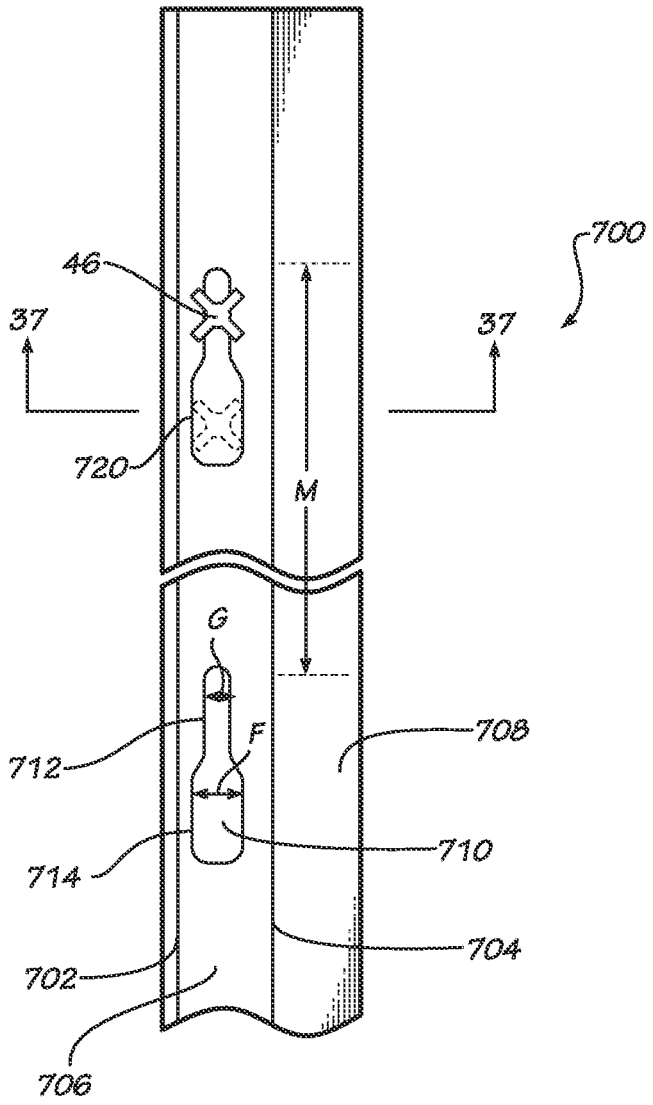
FIG. 36 is a partial top plan view of the vertical wall stud shown in FIG. 35.
Figure 37:
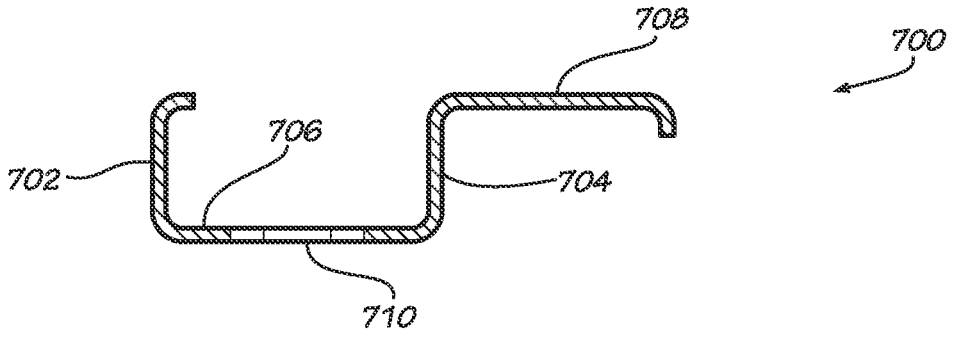
FIG. 37 is a cross-sectional view taken along the line 37-37 of the vertical wall stud shown in FIG. 36.

FIGS. 32-34 show an alternate disclosed embodiment of a panel spacer member in accordance with the present invention. The panel spacer member 600 is identical in construction to the panel spacer member 26 except for the way the whalers and studs are attached to the panel spacer member. The panel spacer member 600 is identical in construction to the panel spacer member 26 up to the slot 70, 70'. The panel spacer member 600 is constructed as if the ends 44, 46 and core member 68 of the panel spacer member 26 were cut off thereby leaving the panel spacer member flush at the ends 602, 604 of the teeth 72-78. Formed in the ends 602, 604 of the panel spacer member 600 are longitudinally extending holes 606, 608 axially aligned with the longitudinal axis of the panel spacer member. The holes 606, 608 can be formed by drilling or by molding. The holes 606, 608 are sized and shaped to receive screws 610, 612.

The distance between the flanges 48, 50 and the ends 602, 604, respectively, of the panel spacer member 600 is equal to the thickness of the composite foam insulating panels 12, 14. Therefore, when the panel penetrating portions 56, 58 of the panel spacer member 600 are inserted through the composite foam insulating panels 12, 14, as shown in FIG. 34, the ends 602, 604 of the panel spacer member will be flush with the exterior surface 112, 114, respectively, of the composite foam insulating panels. The locking caps 28, 30 are placed on the ends 602, 604 of the panel spacer member 600 in the same manner as described above, so that the latch fingers 90-96 of the locking caps latch with the teeth 72-78 of the panel spacer member. When the locking caps 28, 30 are latched on the ends 602, 604 of the panel spacer member 600, they are pushed on with sufficient force to slightly compress the polystyrene foam, so that the opposite side of the locking caps is flush with the exterior surface 112, 114 of the composite foam insulating panels 12, 14.

If it is desired to attach horizontal whalers or vertical wall studs to the panel spacer member 600, it can easily be done by inserting a self-tapping screw 610 through, for example, a hole (not shown) in a whaler 240 and into the hole 606 in the end 602 of the panel spacer member 600. The screw 610 can then be tightened so that the whaler 240 is held firmly in place. It may be desirable to place a washer 614 between the screw head and the whaler 240 so as to spread the load over a larger surface area. Similarly, a whaler 200 can be attached using a screw 612 and a washer and inserting the screw through a hole in the whaler (not shown) and into the opening 608 in the end 604 of the panel spacer member 600. A vertical wall stud (not shown) can be attached to the panel spacer member 600 in the same manner. The whalers 200, 240 can be removed from the panel spacer member 600 by merely removing the screws 610, 612 from the holes 606, 608 and pulling the whalers away from the foam insulating panels 12, 14. Thus, the panel spacer member 600 provides a relatively easy way to temporarily attach and remove a whaler, such as the whaler 240, or to permanently attach a vertical wall stud.

The panel spacer members 26, 600 not only function for attachment of horizontal whalers, but also for the attachment of vertical walls studs. Thus, after the whalers are removed, they can be replaced with vertical wall studs. The vertical wall studs allow for the installation of many different types of wall claddings without penetrating the foam, the concrete or the weather membrane. FIGS. 35-38 show a disclosed embodiment of a vertical wall stud in accordance with the present invention. The wall stud 700 comprises an elongate U-shaped channel made from a material having high flexural strength, such as steel or aluminum. The wall stud 700 includes two parallel spaced side members 702, 704 and a connecting bottom member 706. Extending outwardly from the top of the side member 704 is a flange 708. The side members 702, 704 provide extra strength and resistance to flex of the bottom member 706. Formed in the bottom member 706 is a key-shaped opening or key slot 710; i.e., the lateral dimension "G" at 712 is narrower than the lateral dimension "F" at 714. The key slot 710 can be formed in the wall stud 700 by stamping or any other suitable technique. The wall stud 700 can be formed by extrusion, by roll forming or by any other suitable manufacturing technique.

The lateral dimension "F" of the key slot 710 at 714 (the wider portion) is chosen so that it is larger than the effective diameter of the ends 44, 46 of the panel spacer member 26; i.e., the dimension "F" at 714 is greater than the dimension "C" from the ends 216, 218 of the opposite legs 62, 66, respectively, between the slot 70 and the end 44. The lateral dimension "G" of the key slot 710 at 712 (the narrower portion) is chosen so that it is equal to or wider than the diameter "D" of the central round core 68 but narrower than the effective diameter "C" of the ends 44, 46 the panel spacer member 26; i.e., the dimension "G" at 712 is less than the dimension "C" from the ends 216, 218 of the opposite legs 62, 66, respectively, between the slot 70 and the end 44. Therefore, the wall stud 700 can be placed over the end 44 of the panel spacer member 26 such that the end of the panel spacer member fits through the wider portion 714 of the key slot 710. Then, the wall stud 700 can be slid so that the end 44 of the panel spacer member 26 is positioned in the narrower portion 712 of the key slot 710 and the sides of the key slot fit in the slot 70 in the panel spacer member. When the end 44 of the panel spacer member 26 is in the narrower portion 712 of the key slot 710, the wall stud 700 is locked in place and cannot be removed from the end of the panel spacer member (longitudinally with respect to the panel spacer member). Holes 716, 718 are provided in the side wall 702, 704, respectively, aligned with the approximate mid-point of the narrower portion 712 of key slot 710. A screw or pin (not shown) can then be screwed or inserted into the holes 716, 718 so that the shaft of the screw or pin extends transversely across the width of the wall stud 700 and across the narrow portion 712 of the key slot 710, thereby capturing the end 44 of the panel spacer member 26 in the narrow portion of the key slot. When the screw or pin (not shown) is positioned in the holes 716, 718 as described above, the wall stud 700 cannot be slid up or down, thereby locking the wall stud in position.

Figure 39:
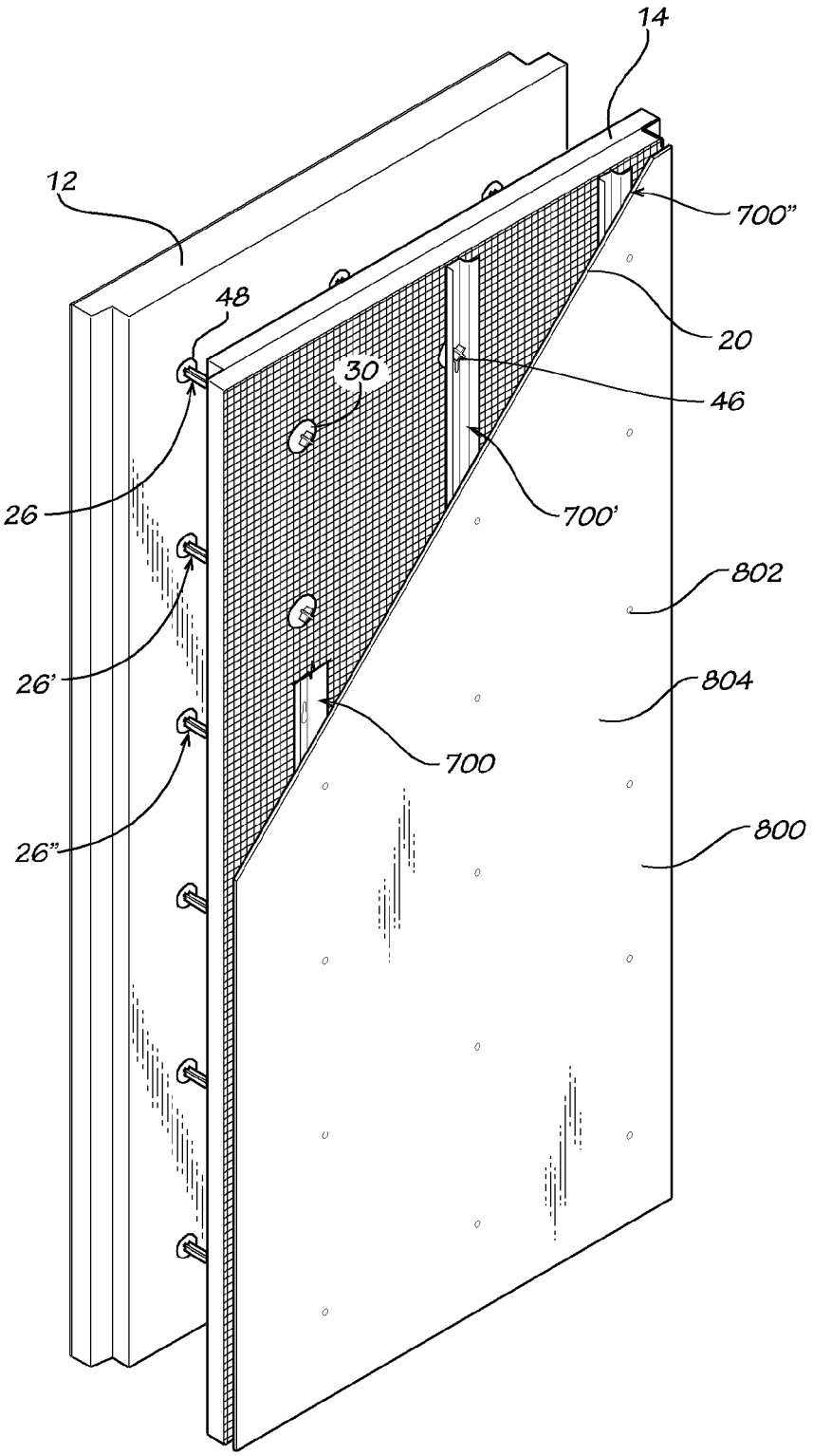
FIG. 39 is a partially broken away perspective view of an alternate disclosed embodiment of an insulated concrete form in accordance with the present invention showing the vertical wall studs, as shown in FIG. 35, attached to the ends of the panel spacer members, as shown in FIG. 4, and also showing a sheet rock panel attached to the vertical wall studs.

The length of the wall stud 700 will depend on the height of the composite foam insulating panels 12-18 that are used. However, it is contemplated that the length of the wall stud 700 will be equal to the height of the composite foam insulating panels used in the building being constructed, such as 8, 9, 10 or 12 feet long. Also, the distance M from the key slot 714 to the next adjacent key slot 720 is the same as the center-to-center distance from one panel spacer member to the next vertically adjacent panel spacer member; e.g., from panel spacer member 26 to panel spacer member 26' (FIGS. 39-41), or halfway between adjacent panel spacer members. Thus, each wall stud 700 has a plurality of key slots, such as the key slots 710, 720, spaced along the length thereof and the number and spacing of the key slots corresponds to the number and spacing of the vertically aligned panel spacer members, such as the panel spacer members 26, 26', 26" (FIG. 1), used in the foam insulating panels, such as composite foam insulating panels 12-18.

The wall studs, such as the wall studs 700, 700', can be installed on the foam insulating panels, such as the composite foam insulating panels 12, 14 (FIG. 39), by inserting the ends, such as the end 46, of the panel spacer members that form a vertical column, such as panels spacer members 26, 26', 26" and the other panel spacer members vertically aligned therewith, into the wide portion 714 of the key slot 710 in the wall stud. The wall studs, such as the wall studs 700, 700', are then slid vertically downward so that the ends, such as the end 46, of the panel spacer members, such as the panel spacer members 26, 26' 26", are positioned in the narrower portion 712 of the key slot 710, thereby locking and securing the wall stud to the panel spacer members. A screw or pin (not shown) is then screwed or inserted into the holes 716, 718 so that the body of the screw or pin extends across the key slot 710, thereby capturing the end 44 of the panel spacer member 26 in the narrow portion 712 of the key slot 710 and preventing the wall stud 700 from being moved up or down. Similar wall studs 700', 700" are installed on the ends, such as the end 44, of other panel spacer members at desired horizontal intervals along the horizontal width of the foam insulating panels that form the desired wall configuration. After the wall studs 700, 700', 700" are installed on the interior foam insulating panel, a desired interior finished wall material, such as gypsum board 800, can be affixed to the flange 708 of the wall studs using sheet rock screws, such as the screws 802, 804, through the gypsum board into the flange 708 of the wall studs. In addition to the holes 716, 718 formed in the side members 702, 704 of the wall stud 700, other openings (not shown) can be provided or formed in the side members so that conventional electrical wiring and/or plumbing can be run through the wall studs behind the gypsum board in the cavity created by the studs. Such other openings can be made by partially pre-punching the openings so that the opening can be made by knocking out partially pre-punched portions of the openings. Alternately, opening can simply be drilled or cut in the side members where needed.

Figure 40:
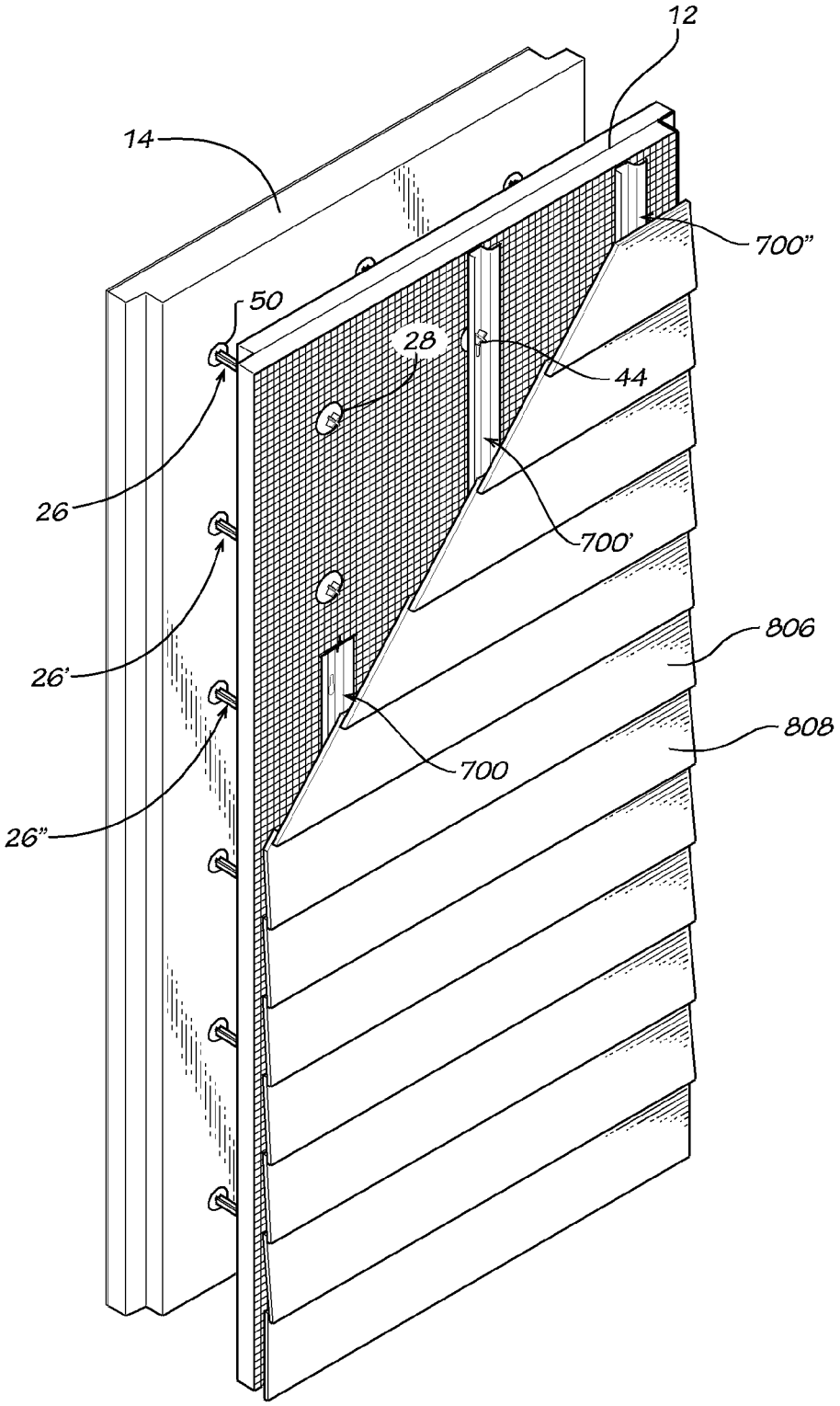
FIG. 40 is a partially broken away perspective view of an alternate disclosed embodiment of an insulated concrete form in accordance with the present invention showing the vertical wall studs, as shown in FIG. 35, attached to the ends of the panel spacer members, as shown in FIG. 4, and also showing horizontal siding members attached to the vertical wall studs.

FIG. 40 shows vertical walls studs, such as the wall studs 700, 700', 700", mounted on the ends, such as the end 44, of the panel spacer members, such as the panel spacer members 26, 26', 26", mounted between the composite foam insulating panels 12, 14. Attached to the wall studs 700, 700', 700", are a plurality of horizontal wood, aluminum or composite exterior siding members, such as the siding members 806, 808. The siding members are affixed to the wall studs 700, 700', 700" by driving nails or screws (not shown) through a flange of the siding member into the flange 708 of the wall studs. The studs 700, 700', 700" used in this exterior wall cladding system provide a drainage cavity between the outer surface 112 of the exterior composite foam insulating panel 12 (which includes the weather membrane) and the siding members, such as the siding members 806, 808. Therefore, if any water penetrates the siding members 806, 808, the weather membrane on the outer surface 112 of the exterior composite foam insulating panel 12 will repel the water and the water will drain to the bottom of the wall, thereby eliminating the possibility of water intrusion through the concrete wall.

Figure 41:
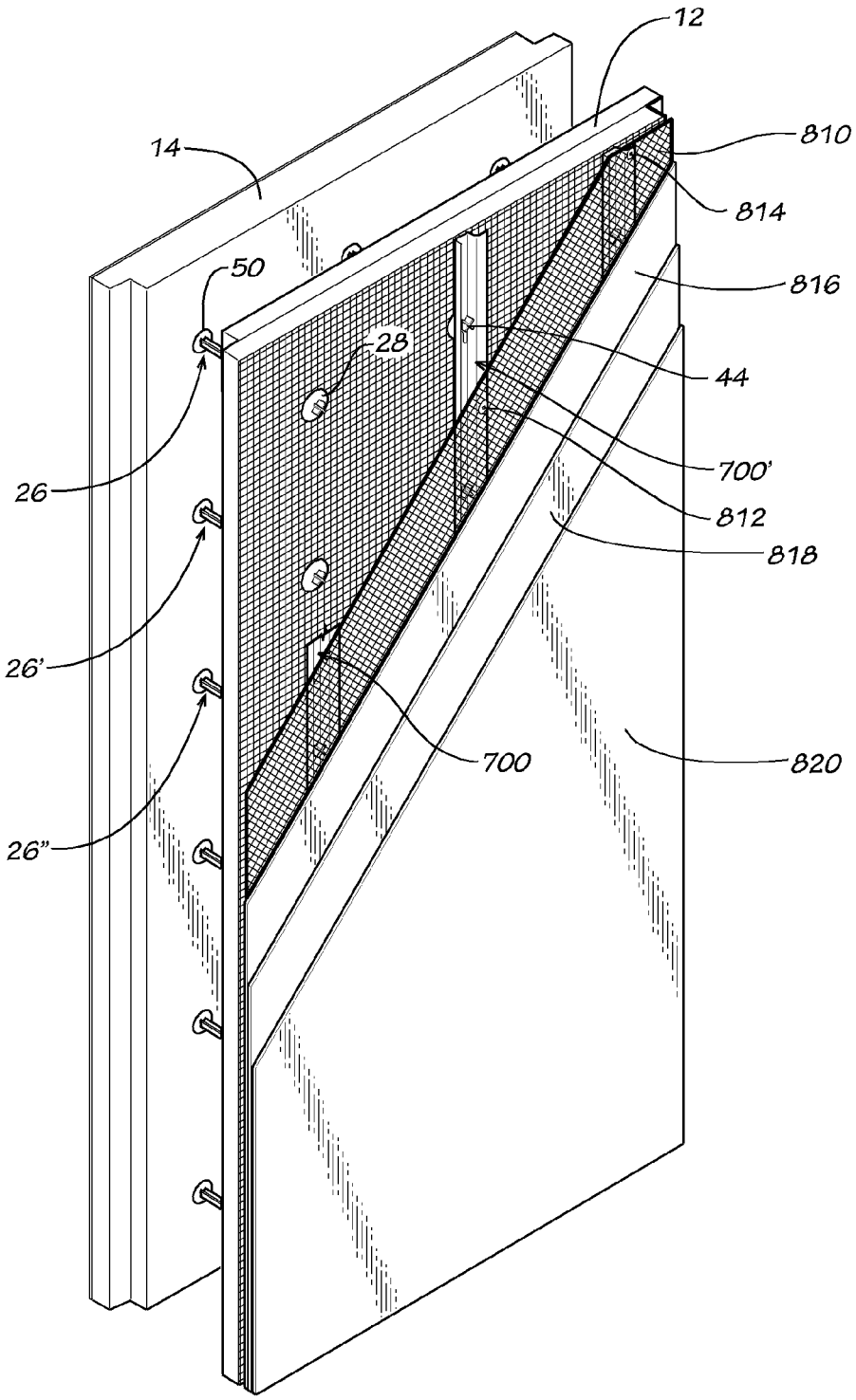
FIG. 41 is a partially broken away perspective view of an alternate disclosed embodiment of an insulated concrete form in accordance with the present invention showing stucco lathe attached to the vertical wall studs, as shown in FIG. 35, and a scratch coat, finish coat and color coat of stucco applied to the lathe.

FIG. 41 shows another type of wall cladding that can be used with the insulted concrete forming system of the present invention. FIG. 41 shows vertical wall studs, such as the wall studs 700, 700', 700", mounted on the ends, such as the end 44, of panel spacer members, such as the panel spacer members 26, 26', 26", mounted between the composite foam insulating panels 12, 14. Attached to the wall studs 700, 700', 700", is lathe sheeting 810. The lathe 810 is affixed to the wall studs 700, 700', 700" by driving nails or screws, such as the screws 812, 814, through the lathe into the flanges, such as the flange 708, of the wall studs. A scratch coat of stucco 816 is applied to the lathe 810. A finish coat 818 of stucco is applied over the scratch coat 816. A color coat 820 of stucco is then applied over the finish coat 818. The studs 700, 700', 700" used in this exterior wall cladding system provide a drainage cavity between the outer surface 112 (which includes the weather membrane) of the exterior composite foam insulating panel 12 and the lathe 810. Therefore, if any water penetrates the stucco coatings 816-820, the weather membrane on the outer surface 112 of the exterior composite foam insulating panel 12 will repel the water and the water will drain to the bottom of the wall, thereby eliminating the possibility of water intrusion through the concrete wall.

Figure 42:
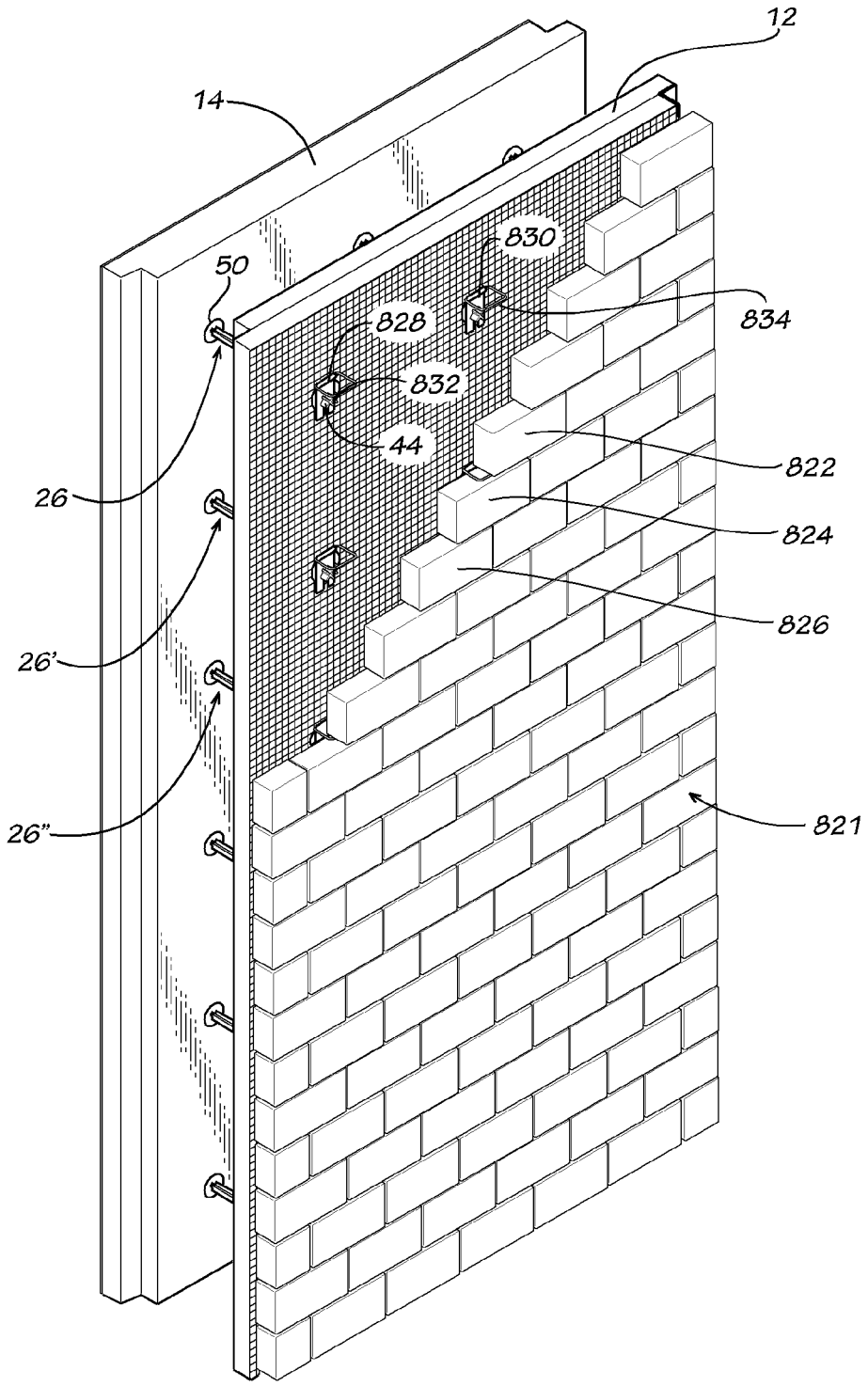
FIG. 42 is a partially broken away perspective view of an alternate disclosed embodiment of an insulated concrete form in accordance with the present invention showing a brick veneer wall attached to clips attached to the ends of panel spacer members, as shown in FIG. 4.

FIG. 42 shows another type of wall cladding that can be used with the insulted concrete forming system of the present invention. FIG. 42 shows a brick veneer wall 821 formed of vertically stacked rows of individual bricks, such as the bricks 822, 824, 826. On the ends, such as the end 44, of the panel spacer members, such as the panel spacer members 26, 26', 26", are clips, such as the brick ties 828, 830. The brick ties 828, 830 have a slot formed therein for sliding into engagement with the slot 70 of the panel spacer members, such as the panel spacer member 26. The brick ties 828, 830 include a wire loop, such as the wire loops 832, 834. As the bricks are stacked to form the brick wall 821, mortar is placed between the joints between adjacent bricks, such as between the bricks 822, 824, 826. The wire loops 832, 834 are placed in the joints between adjacent bricks, such as between the bricks 822, 824, 826, and embedded in the mortar that fills the joints between the adjacent bricks. Thus, when the mortar hardens, the wire loops are embedded and held in place by the hardened mortar. Therefore, the wire loops, such as the wire loops 832, 834, connect the brick wall 821 to the brick ties, such as the brick ties 828, 830, that are attached to the ends, such as the end 44, of the panel spacer members, such as panel spacer members 26, 26', 26". This system securely ties the brick wall 821 to the hardened concrete in the concrete receiving space 106.

All of the above wall cladding systems have in common the drainage cavity, the weather membrane on the outer surface of the composite foam insulating panels that repeals water intrusion and the fact that the panel spacer member 26 embedded into the concrete becomes an integrated cast in place anchor for the studs. Also, the attachment of the wall studs to the panel spacer members, such as the panel spacer member 26, at the ends thereof, such as the end 44, does not damage or penetrated the weather membrane. Furthermore, all attachments to the studs do not penetrate the weather membrane. Therefore, the present invention not only provides a drainage cavity for any water that may penetrate the exterior cladding, but also provides a continuous weather membrane on the outer surface of the exterior composite foam insulating panels such that water cannot penetrate through the concrete wall to the inside of the building.

While some of the disclosed embodiments of the present invention do not show the use of steel rebar, it is preferred that the concrete be reinforced vertically with steel rebar and horizontally with fibers, such as steel fibers or plastic fibers. Many different types of steel fibers are known and can be used in the present invention, such as those disclosed in U.S. Pat. Nos. 6,235,108; 7,419,543 and 7,641,731, the disclosures of which are incorporated herein by reference in their entireties.

Plastic fibers can also be used, such as those disclosed in U.S. Pat. Nos. 6,753,081; 6,569,525 and 5,628,822, the disclosures of which are incorporated herein by reference in their entireties. The steel fibers in the concrete can be used as a replacement for horizontal rebar. The vertical steel rebar, such as the rebar 840 (FIG. 43), can be placed in the concrete receiving space 106 by merely inserting the vertical steel rebar through the open top of the form and attaching the steel rebar to the elongate central member 32 of the panel spacer member 26 using conventional metal wire ties.

In the prior art modular insulated concrete form systems, the panel spacer members are used to hold the opposed forms together and to keep them from moving apart when the concrete is placed in the form. In the present invention, the panel spacer members perform many more tasks. In addition to the aforementioned functions, the panel spacer members provide mountings for horizontal whalers, for vertical wall studs and clips for attaching various types of wall cladding, such as brick, marble, stone, metal panels, wood or cement siding or the like.

Without wall studs, the exterior surface 112 of the exterior composite foam insulating panel 12 can be finished with coatings, such as stucco or thin brick. If it is desired to have a flat interior wall surface, such as would be required for stucco, the portion of the panel spacer member 26 that extends beyond the locking caps 28, 30 can be removed by sawing, cutting or grinding. Similarly, if it is desired to have a flat exterior wall surface, the portion of the panel spacer member 26 that extends beyond the locking caps 28, 30 can be removed by sawing, cutting or grinding.

Figure 43:
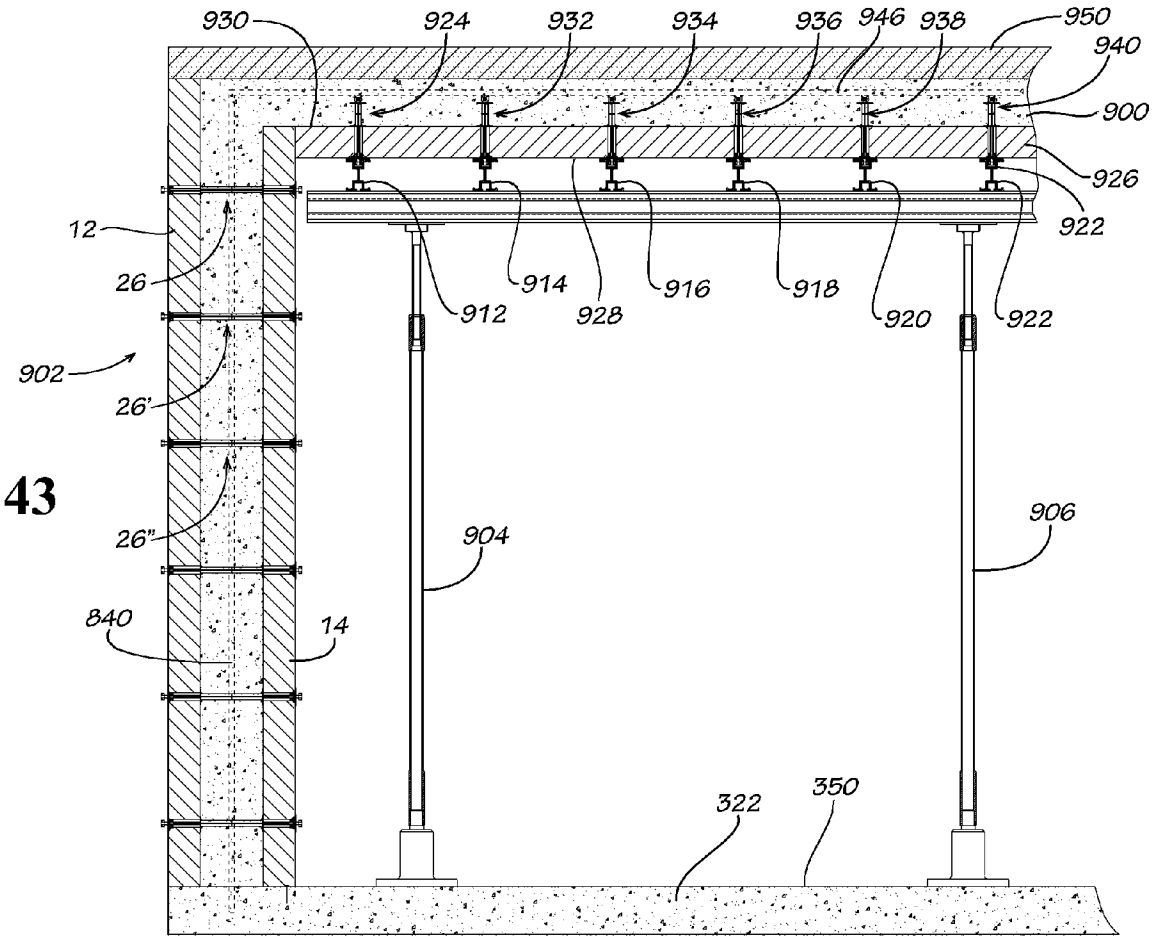
FIG. 43 is a cross-sectional side view of an alternate disclosed embodiment of an insulated concrete form in accordance with the present invention showing the form used to construct an elevated concrete slab.
Figure 45:
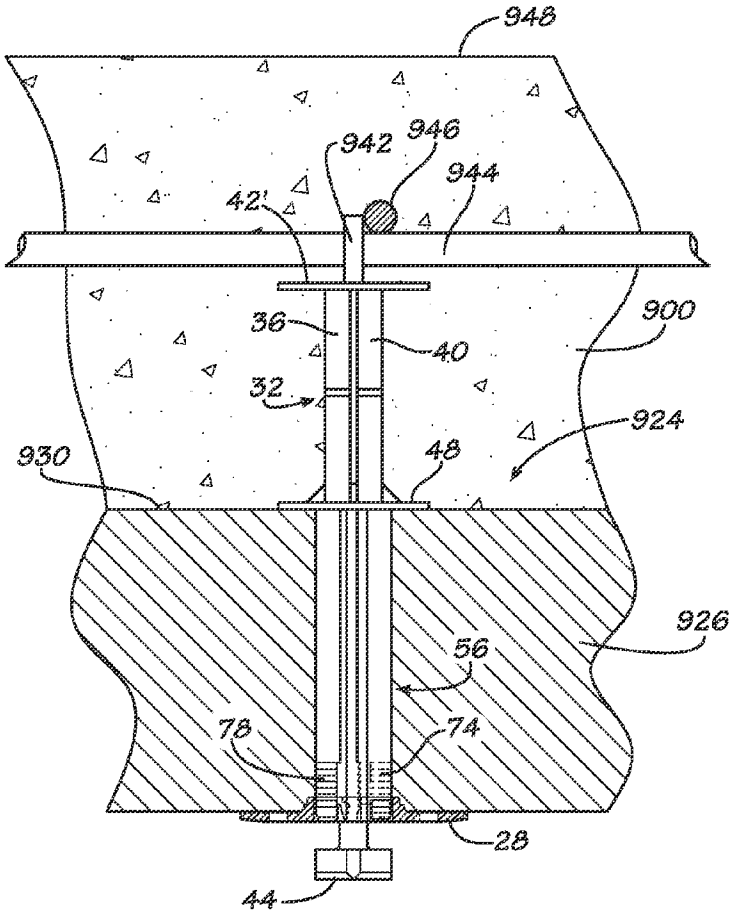
FIG. 45 is a partial detail cross-sectional end view of a portion of the insulated concrete form shown in FIG. 43.

FIGS. 43-48 show an alternate disclosed embodiment of the present invention where the insulated concrete form is used for an elevated concrete slab 900. FIG. 43 shows a horizontal concrete slab 322 upon which has been built a vertical concrete wall 902 using the insulated concrete forms described above, such as with respect to FIGS. 19-22 and 29-31. Since the vertical concrete wall 902 has already hardened sufficiently, the whalers, such as whalers 200, 230-250 and whalers 400, 434-454; strongbacks, such as the strongbacks 318, 360; and brace/turnbuckles, such as the brace/turnbuckle 344, have been removed.

The insulated concrete form for the elevated concrete slab or roof structure is then prepared by first erecting a supporting structure. The supporting structure comprises a plurality of post shores, such as the post shores 904, 906, the bottoms of which sit on the top surface 350 of the concrete slab 322. The top portion of the post shores, such as post shores 904, 906 support a plurality of horizontal elongate beams, such as the beam 910. The beams, such as the beam 910, can be of any conventional design, but can conveniently be of the same design as the strongbacks 318, 360. The beams, such as the beam 910, extend laterally from the vertical wall 902 to the opposing wall (not shown). The plurality of beams, such as the beam 910, support a plurality of stringers, such as the stringers 912, 914, 916, 918, 920, 922. The stringers, such as the stringers 912-922, can be of any conventional design, but are preferably of the same design as the whalers, such as the whalers 200, 230-250 disclosed above, especially the I-beam whalers, such as the I-beam whalers 400, 434-454. Each of the stringers 912-922 is connected to the end of an alternated disclosed embodiment of the panel spacer member 26 as described below.

Figure 44:
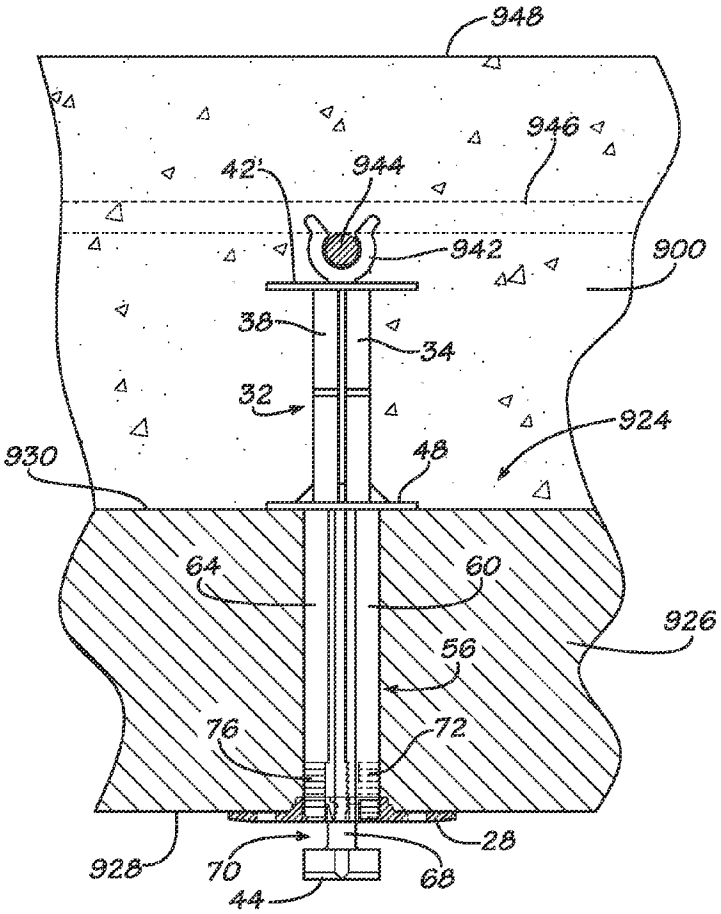
FIG. 44 is a partial detail cross-sectional side view of a portion of the insulated concrete form shown in FIG. 43.

For elevated slab construction, an alternated disclosed embodiment of the panel spacer member 26 is used. As shown in FIG. 44, there is a panel anchor member 924. The panel anchor members 924 is identical in construction to the panel spacer member 26, except that the central portion 32 terminates adjacent the flange 42, thereby eliminating half of the central portion and the panel penetrating portion 58 from the panel spacer member. Preferably, the flange 42 of the panel spacer member 26 is enlarged to form the flange 42' of the panel anchor member 924 so that the flange 42' extends radially outwardly beyond the legs 34-40 thereby providing a larger surface area to be embedded in the hardened concrete. The flange 42' is therefore approximately the same size and shape as the flange 48. The panel anchor member 924 also attaches to the first locking cap 28 in the same manner as the panel spacer member 26, as described above.

FIGS. 44-47 show the panel anchor member 924 attached to a horizontal composite foam insulating panel 926 having a lower surface 928 and an upper surface 930. The composite foam insulating panel 926 can optionally include a layer of reinforcing material 931 attached to the lower surface 928 thereof. The panel anchor member 924 attaches to the foam insulating panel 926 in the same manner that the panel spacer member 26 attaches to the composite foam insulating panel 12, as described above, such that the horizontal composite foam insulating panel is captured between the flange 48 of the panel anchor member and the locking cap 28, as shown in FIG. 44. When attached to the horizontal composite foam insulating panel 926, the flange 48 of the panel anchor member 924 contacts the upper surface 930 of the horizontal composite foam insulating panel, the locking cap 28 contacts the lower surface 928 and the central portion 32 extends upwardly from the upper surface of the horizontal composite foam insulating panel.

Figure 18:
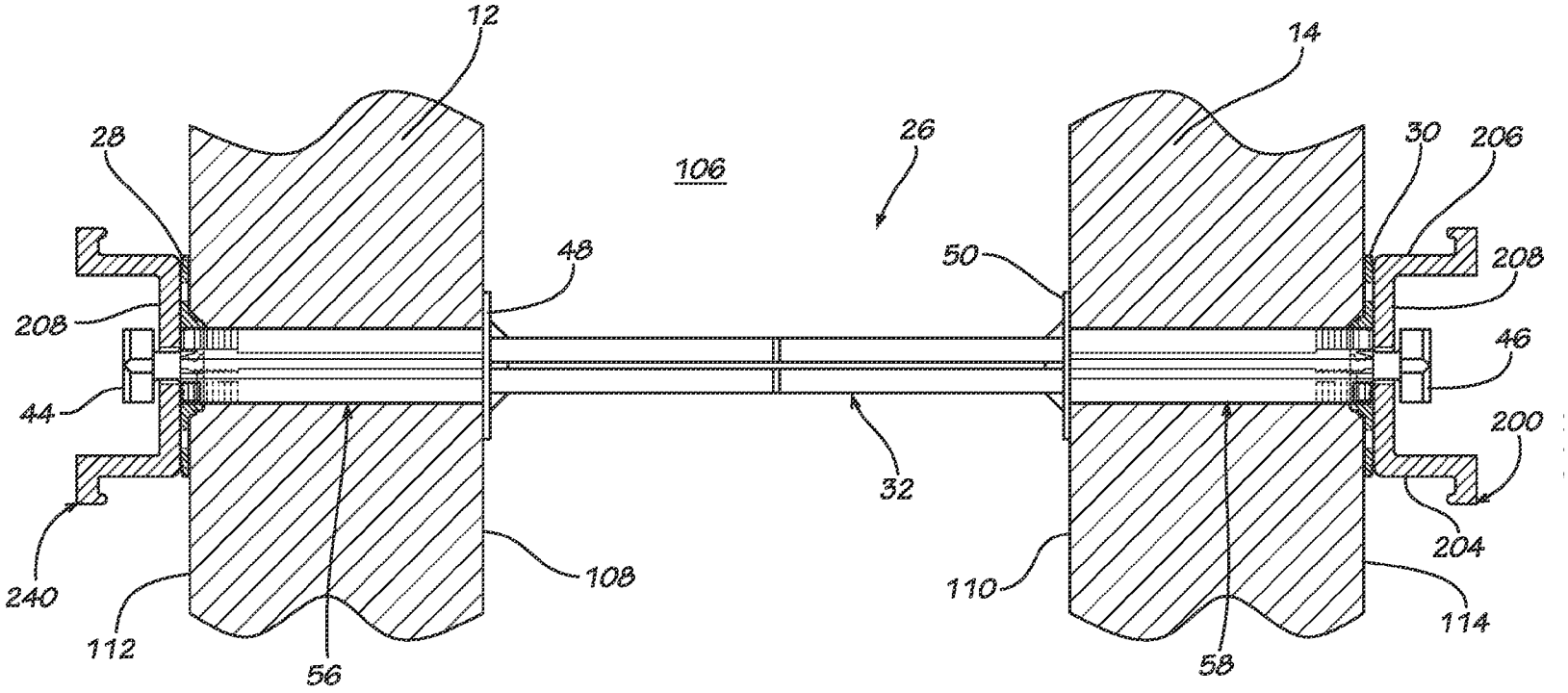
FIG. 18 is a partial cross-sectional view of the insulated concrete form shown in FIG. 2 shown with the whalers attached to each end of the panel spacer member.
Figure 28:
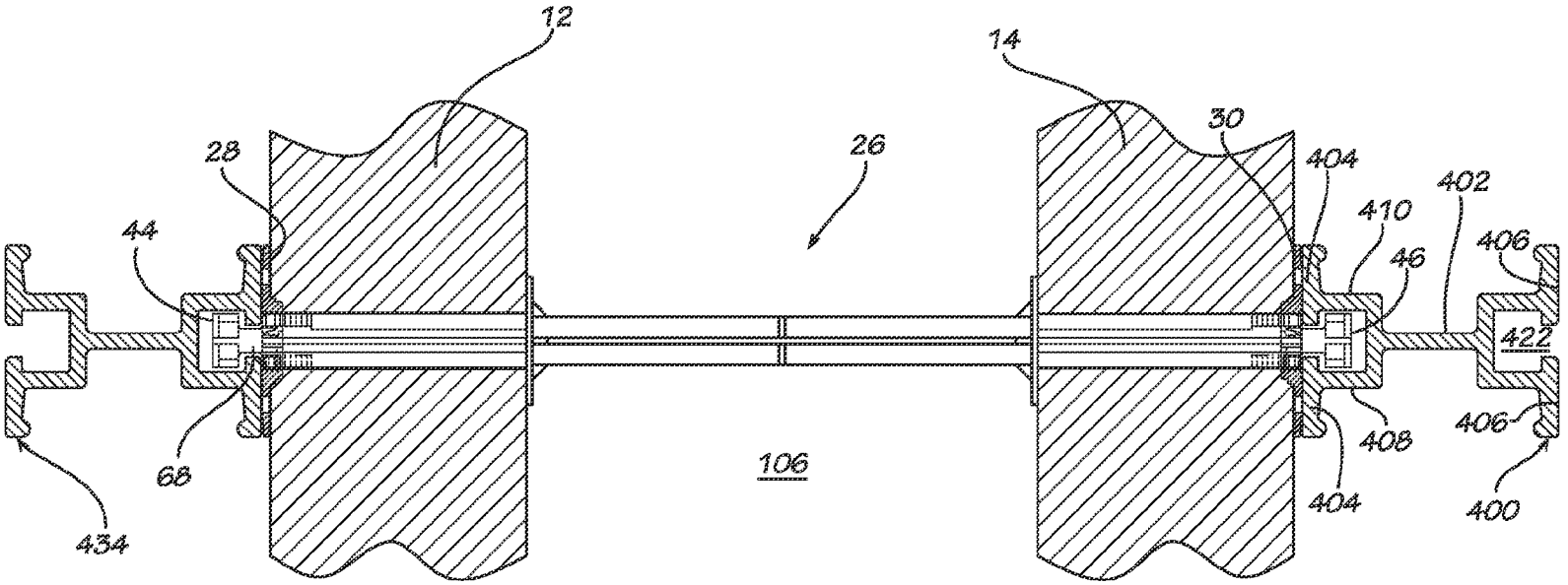
FIG. 28 is a partial cross-sectional side view of the insulated concrete form shown in FIG. 28 showing the I-beam whalers shown in FIG. 23 attached to each end of the panel spacer member.
Figure 47:
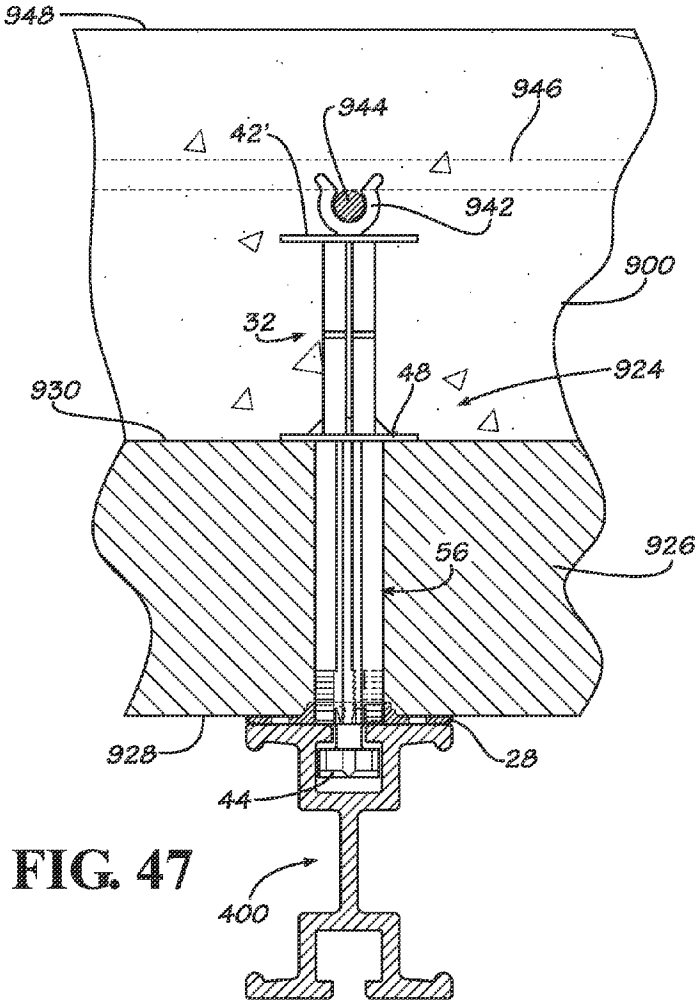
FIG. 47 is a partial detail cross-sectional side view of a portion of the insulated concrete form shown in FIG. 43 showing the use of an alternate disclosed embodiment of a stringer.
Figure 46:
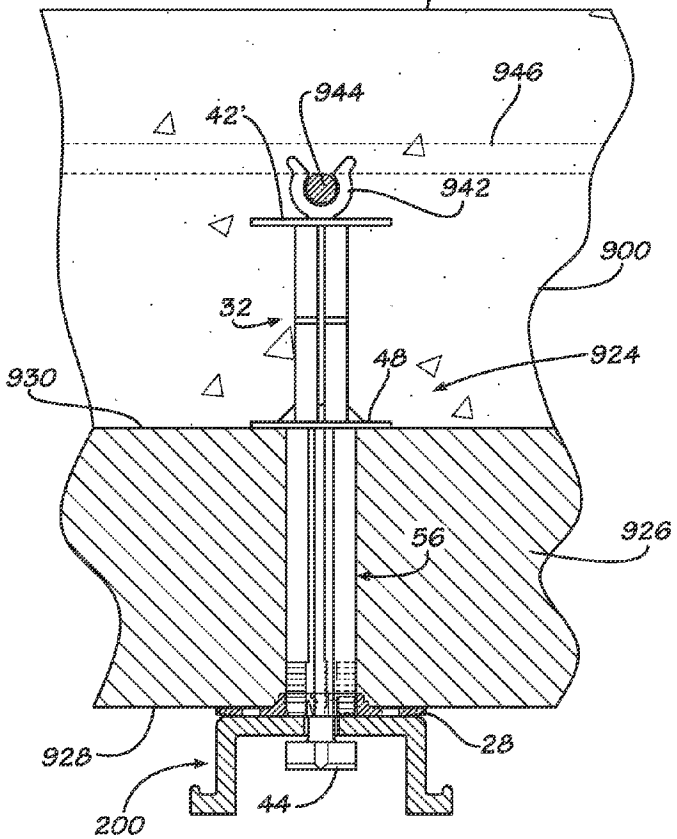
FIG. 46 is a partial detail cross-sectional side view of a portion of the insulated concrete form shown in FIG. 43 showing the use of a disclosed embodiment of a stringer.

As stated above, the stringers 912-922 can be in the same form as the U-shaped whalers 200, 230-250 or the I-beam whalers 400, 434-454. FIG. 46 shows the whaler 200 attached to the panel anchor member 924 in the same manner as the whaler 200 is attached to the panel spacer member 26, as shown in FIG. 18. Similarly, FIG. 47 shows the I-beam whaler 400 attached to the panel anchor member 924 in the same manner that the I-beam whaler 400 is attached to the panel spacer member 26, as shown in FIG. 28.

The horizontal composite foam insulating panel 926 is identical in size and shape to the foam insulating panels 12, 14, such as 9 feet 6 inches long and 4 feet 1 inches wide, although any desired size can be used. The horizontal composite foam insulating panels 926 should also have the same insulating properties as the foam insulating panels 12, 14. If the horizontal composite foam insulating panel is made from a material other than polystyrene, the horizontal composite foam insulating panel should have insulating properties equivalent to at least 1 inch of expanded polystyrene foam; preferably, between 2 and 8 inches of expanded polystyrene foam; especially at least 2 inches of expanded polystyrene foam; more especially at least 3 inches of expanded polystyrene foam; most especially, at least 4 inches of expanded polystyrene foam.

Before the horizontal composite foam insulating panel 926 is placed on top of the beam 910, the panel anchor members, such as the panel anchor members 924, 932, 934, 936, 938, 940, are attached to the horizontal composite foam insulating panel at spaced intervals in rows and columns in the same manner as the panel spacer member 26, as shown in FIGS. 1 and 2. Then, the stringers, such as the stringers 912-922, are attached to the panel anchor members, such as the panel anchor members 924, 932-940. After the stringers 912-922 have been attached to the panel anchor members 924, 932-940, the horizontal composite foam insulating panel 926 will look identical to the foam insulating panels 14 as shown in FIG. 2 (without the strongbacks 318, 320). Then, the horizontal composite foam insulating panel 926 is laid on top of the beams, such as the beam 910, such that the beams contact and support the stringers 912-922. The post shores, such as the post shores 904, 906, can be adjusted up or down in order to level the beams, such as the beam 910. Additional horizontal composite foam insulating panels (not shown) are assembled in the same manner and are positioned adjacent each other so as to form a continuous form floor for the elevated concrete slab 900. Joints between adjacent horizontal composite foam insulating panels are adhered to each other in the same manner as described above, such as by using Great Stuff available from Dow Chemicals, Midland, Mich. Similarly, the horizontal composite foam insulating panel 926 and the interior composite foam insulating panel 14 are adhered to each other so as to seal the joint there between in the same manner as described above.

The panel anchor members, such as the panel anchor member 924, each optionally includes a C-shaped clamping member 942 extending upwardly from the flange 42' (FIGS. 44-48). The clamping member 942 is sized and shaped to form a chair receive and retain an elongate round steel rebar, such as the rebar 944. The clamping member 942 has a degree of resilience to it so that the rebar 944 can be pushed into the clamping member and the clamping member will hold the rebar with sufficient force such that the rebar will not be dislodged from the clamping member when plastic concrete is poured on top of the horizontal foam insulating panels, such as the horizontal foam insulating panel 926. Aligned rows of panel anchor members 924 provide aligned rows of clamping members 942 such that adjacent parallel rows of rebar, such as the rebar 944, 945, of desired length can be attached to the rows of panel anchor members. Crossing columns of rebar, such as the rebar 946, can be laid on top of the rows of rebar 944, 945 to form a conventional rebar grid. Where the rebar 946 intersects the rebar 944, the two rebar can be tied together with wire ties in a conventional manner known in the art.

After the rebar 944, 945, 946 grid has been formed, unhardened concrete mix is poured on top of the top surface 930 of the horizontal foam insulating panel 926 to a desired depth, but in any case deep enough such that the clamping member 942 (or the flange 42' if no clamping member is used) and the rebar 944, 946 are positioned at the appropriate depth of the concrete slab 900, as required by structural design calculations. Of course, for an elevated concrete slab, such as shown here, it may be desirable to use lightweight concrete instead of conventional concrete.

As shown in FIG. 43, the exterior composite foam insulating panel 12 extends higher than the interior foam insulating panel 14, thereby forming the perimeter of the mold space for the elevated concrete slab 900. After the plastic concrete mix has been placed on the horizontal composite foam insulating panel 926, the upper surface 948 of the plastic concrete is finished in a conventional manner. After the upper surface 948 of the concrete has been finished in a desired manner, a layer of insulation 950 is temporarily placed on the upper surface of the uncured concrete. The layer of insulation 950 is preferably another horizontal foam insulating panel identical to the panel 926. Alternately, the layer of insulation 950 can be anything that provides insulation equivalent to about 1 inch to 12 inches of expanded polystyrene, preferably insulation equivalent to at lease 2 inches of expanded polystyrene. The layer of insulation 950 can also be a concrete insulating blanket or an electrically heated concrete insulating blanket, both of which are known in the art and are typically used in northern climates to keep the concrete from freezing. The layer of insulation 950 should remain on the upper surface 948 of the concrete mix until it has achieved a desired degree of cure. Then, the layer of insulation 950 is removed.

After the elevated concrete slab 900 has achieved a sufficient degree of cure so that it is self-supporting, the post shores, such as the post shores 904, 906, the beams, such as beam 910, and the stringers, such as the stringers 912-922 are removed. The stringers, such as the stringers 912-922, can be removed from the panel anchor members, such as the panel anchor members 924, 932-940, in the same manner that the I-beam whaler 400 is removed from the panel spacer member 26, as described above.

Figure 48:
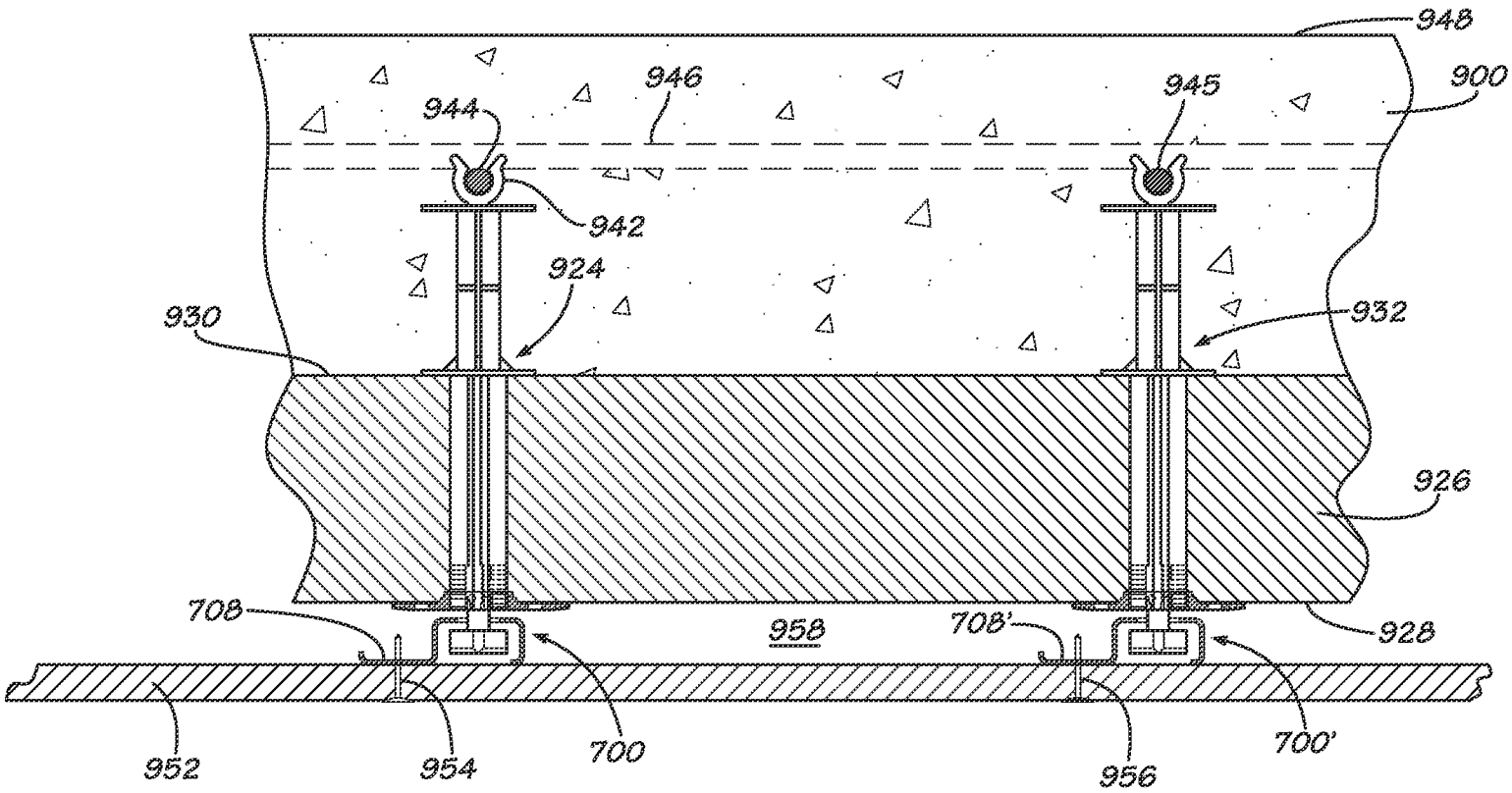
FIG. 48 is a partial detail cross-sectional side view of a portion of the form shown in FIG. 43 showing the use of a disclosed embodiment of a horizontal ceiling stud and a ceiling surface cladding.

If it is desired to add a cladding surface to the lower surface 928 of the horizontal foam insulating panel 926, studs identical to the vertical wall studs 700 (FIGS. 35-39) can be attached to the panel anchor members. As shown in FIG. 48, the studs 700, 700' are attached to the panel anchor members 924, 932. A cladding surface, such as a sheet of gypsum board 952, is attached to the studs with screws 954, 956 that penetrate through the board and into the flanges 708, 708' of the studs 700, 700', respectively. The space 958 between the gypsum board 952 and the lower surface 928 of the horizontal foam insulating panel 926 provides a place to run electrical wiring, plumbing or the like. And, as stated above, the side members 702, 704 of the studs 700, 700' can be provided with openings for electrical wires, plumbing and the like to pass through.

Although the elevated slab 900 has been shown as being supported on the edges by a poured-in-place vertical concrete wall, such as the shown in FIG. 43, the elevated slab 900, and insulated form therefor, can be supported by tilt-up concrete panels, concrete columns, steel columns, steel roof trusses or other support systems well known in the art. Furthermore, although the elevated concrete slab 900 has been shown as being the floor for two story building, the elevated concrete slab in accordance with the present invention can also be used to for a roof.

In an alternate disclosed embodiment, the elevated concrete slab can be used as a roofing system. In such a case, instead of supporting the horizontal composite foam insulating panel 926 with post shores, such as the post shores 904, 906, the beams, such as beam 910, and stringers, such as the stringers 912-922, the horizontal composite foam insulating panel can be supported by metal roof joists.

As stated above, the present invention can be used for the construction of columns and piers. To form a column or pier, the composite foam insulating panels, such as the panels 12, 14, are placed on opposite sides of where the pier or column is to be formed. If the column or pier is to be of a larger dimension than the wall, panel spacer members of a desired dimension are used to space the foam insulating panels 12, 14 at the desired distance. The open ends of the form are then covered with another piece of a composite foam insulating panel on each open end. Whalers are then used to wrap the four composite foam insulating panels like a belt. Plastic concrete mix can then be poured into the form. After the concrete has achieved a sufficient cure, the whalers are removed. Then, the composite foam insulating panels covering the ends of the panels 12, 14 are removed. And, if desired the foam insulating panels 12, 14 can be removed or they can be left in place, as desired. If it is desired to remove the composite foam insulating panels 12, 14, they can be removed by cutting the locking caps 28, 30 off the panel spacer members 26 and pulling the foam insulating panels off the panel penetrating portions 56, 58, respectively, of the panel spacer member. Then, any portion of the panel spacer member 26 extending outwardly from the surface of the column or pier can be cut off or ground down to provide a flush surface on the pier or column.

The concrete form system of the present invention provides a very versatile building system. And, unlike the modular insulated concrete forms of the prior art, the concrete form system of the present invention provides a building system that can perform all of the same tasks as conventional steel and/or wood concrete form systems, including building high-rise buildings.

It should be understood, of course, that the foregoing relates only to certain disclosed embodiments of the present invention and that numerous modifications or alterations may be made therein without departing from the spirit and scope of the invention as set forth in the appended claims.

What is claimed is:

1. A form for concrete comprising:

a first foam insulating panel;

a second foam insulating panel spaced from the first foam insulating panel defining a space therebetween;

a plurality of spacer members attached to the first and second foam insulating panels, wherein a first portion of each of the plurality of spacer members extends through the first foam insulating panel;

a first elongate panel bracing member removably supporting the first foam insulating panel in a vertical position;

a first layer of reinforcing material attached to, contacting and substantially covering a primary surface of the first foam insulating panel such that the first layer of reinforcing material is disposed between the first foam insulating panel and the first elongate panel bracing member;

a first cap member attached to the first portion of each of the plurality of panel spacer members, such that at least a portion of the first layer of reinforcing material is captured between the first foam insulating panel and the first cap member;

a second elongate panel bracing member removably supporting the second foam insulating panel in a vertical position; and a second layer of reinforcing material attached to, contacting and substantially covering a primary surface of the second foam insulating panel such that the second layer of reinforcing material is disposed between the second foam insulating panel and the second elongate panel bracing member.

2. The form of claim 1 further comprising an elongate hollow sleeve extending from the first foam insulating panel to the second foam insulating panel, the elongate hollow sleeve being disposed in the space between the first and second foam insulating panels and spaced from the plurality of spacer members.

3. The form of claim 2 further comprising a connecting rod extending through the first foam insulating panel, through the elongate hollow sleeve and through the second foam insulating panel.

4. The form of claim 3, wherein one portion of the connecting rod contacts the first elongate panel bracing member and another portion contacts the second elongate panel bracing member.

5. The concrete form of claim 1, wherein the first and second layers of reinforcing material each comprise a woven fabric, a nonwoven fabric, a continuous material or a discontinuous material.

6. The form of claim 1, wherein first and second layers of reinforcing material each comprise a mesh.

7. The form of claim 1, wherein first and second layers of reinforcing material are each made from plastic or fiberglass.

8. The form of claim 1, wherein first and second layers of reinforcing material each comprise a fiberglass mesh.

9. The form of claim 1 further comprising a second cap member attached to a second portion of each of the plurality of panel spacer members, such that at least a portion of the second layer of reinforcing material is captured between the second foam insulating panel and the second cap member.

10. A concrete form comprising:

a first foam insulating panel;

a second foam insulating panel spaced from the first foam insulating panel defining a space therebetween;

a plurality of spacer members attached to the first and second foam insulating panels;

a first elongate panel bracing member removably supporting the first foam insulating panel in a vertical position;

a first layer of reinforcing material attached to, contacting and substantially covering a primary surface of the first foam insulating panel such that the first layer of reinforcing material is disposed between the first foam insulating panel and the first elongate panel bracing member;

a second elongate panel bracing member removably supporting the second foam insulating panel in a vertical position;

a second layer of reinforcing material attached to, contacting and substantially covering a primary surface of the second foam insulating panel such that the second layer of reinforcing material is disposed between the second foam insulating panel and the second elongate panel bracing members; and wherein each spacer member comprises a first enlarged portion and an elongate portion, wherein the first enlarged portion is adjacent a first end of the elongate portion, the spacer member being disposed such that the elongate portion extends through the first foam insulating panel and at least a portion of the first reinforcing member is disposed between the first primary surface of the first foam insulating panel and the first enlarged portion of the spacer member.

11. The concrete form of claim 10, wherein each spacer member comprises a second enlarged portion opposite the first enlarged portion adjacent a second end of each spacer member and wherein each spacer member is disposed such that the elongate portion extends through the second foam insulating panel and at least a portion of the second reinforcing member is disposed between the first primary surface of the second foam insulating panel and the second enlarged portion of each of the spacer members.

12. The concrete form of claim 10 further comprising an elongate hollow sleeve extending from the first foam insulating panel to the second foam insulating panel, the elongate hollow sleeve being disposed in the space between the first and second foam insulating panels and spaced from the plurality of spacer members.

13. The concrete form of claim 12 further comprising a connecting rod extending through the first foam insulating panel, through the elongate hollow sleeve and through the second foam insulating panel.

14. The form of claim 13, wherein one portion of the connecting rod contacts the first elongate panel bracing member and another portion contacts the second elongate panel bracing member.

15. The concrete form of claim 10, wherein the first and second layers of reinforcing material each comprise a woven fabric, a nonwoven fabric, a continuous material or a discontinuous material.

16. The form of claim 10, wherein first and second layers of reinforcing material each comprise a woven fabric or a nonwoven fabric.

17. The form of claim 10, wherein first and second layers of reinforcing material are each made from plastic or fiberglass.

18. The form of claim 10, wherein first and second layers of reinforcing material each comprise a fiberglass mesh.

* * * * *